US005391471A

United States Patent [19]

Ohshima et al.

[11] Patent Number: 5,391,471

[45] Date of Patent: Feb. 21, 1995

[54] SILVER HALIDE COLOR PHOTOGRAPHIC MATERIAL

[75] Inventors: Naoto Ohshima; Kentaro Okazaki; Shigeaki Ohtani, all of Kanagawa, Japan

[73] Assignee: Fuji Photo Film Co., Ltd., Kanagawa, Japan

[21] Appl. No.: 76,143

[22] Filed: Jun. 14, 1993

[30] Foreign Application Priority Data

Jul. 8, 1992 [JP] Japan ..... 4-203220
Jul. 15, 1992 [JP] Japan ..... 4-209491
Jul. 16, 1992 [JP] Japan ..... 4-210749

[51] Int. Cl.[6] ..... G03C 1/76

[52] U.S. Cl. ..... 430/523; 430/538; 430/607; 430/642; 430/604; 430/605; 430/611; 430/613; 430/631; 430/510; 430/567; 430/950

[58] Field of Search ..... 430/523, 538, 607, 642, 430/604, 605, 611, 613, 631, 510, 567, 950

[56] References Cited

U.S. PATENT DOCUMENTS

| | | | |
|---|---|---|---|
| 4,224,403 | 9/1980 | Toda et al. | 430/631 |
| 4,755,454 | 7/1988 | Aotsuka et al. | 430/538 |
| 4,923,790 | 5/1990 | Kato et al. | 430/523 |
| 4,945,035 | 7/1990 | Keevert, Jr. et al. | 430/567 |
| 5,198,329 | 3/1993 | Noguchi et al. | 430/523 |
| 5,252,456 | 10/1993 | Ohshima et al. | 430/605 |

FOREIGN PATENT DOCUMENTS

| | | |
|---|---|---|
| 0244184 | 11/1987 | European Pat. Off. . |
| 0312999 | 4/1989 | European Pat. Off. . |
| 0423765 | 4/1991 | European Pat. Off. . |
| 3-156449 | 7/1991 | Japan . |
| 4-9034 | 1/1992 | Japan . |
| 4-9035 | 1/1992 | Japan . |
| 4-200206 | 7/1992 | Japan . |

*Primary Examiner*—Thomas R. Neville
*Attorney, Agent, or Firm*—Sughrue, Mion, Zinn, Macpeak & Seas

[57] ABSTRACT

A novel silver halide color photographic material comprising on a support at least one light-sensitive emulsion layer and at least one hydrophilic colloidal layer containing a white pigment between said support and said light-sensitive emulsion layer is provided, wherein (i) said white pigment is incorporated in such an amount that the coated amount thereof in said hydrophilic colloidal layer is in the range of 2 g/m$^2$ or more, at least one of layers constituting said light-sensitive emulsion layer comprises a silver halide emulsion having a silver chloride content of 90 mol % or more and containing at least one of metal complexes of Fe, Ru, Re, Os and Ir in silver halide grains and at least one mercapto heterocyclic compound, (ii) said white pigment is incorporated in such an amount that the density thereof is in the range of 20% by weight or more, at least one of layers constituting said light-sensitive emulsion layer comprises silver bromochloride emulsion grains or silver chloride emulsion grains having a silver chloride content of 90 mol % or more sensitized with a gold compound, and either said light-sensitive layer or said light-insensitive layer comprises at least one of specific compounds represented by the general formulae (I) to (IX) as is defined in claims, or (iii) said white pigment is incorporated in such an amount that the density thereof in said hydrophilic colloidal layer is in the range of 20% by weight or more, at least one of layers constituting said light-sensitive emulsion layer comprises silver bromochloride emulsion grains or silver chloride emulsion grains containing substantially no silver iodide and having a silver chloride content of 95 mol % or more, and the film pH and film pAg of said light-sensitive material are in the range of 5.0 to 6.5 and 6.0 to 10.0, respectively.

8 Claims, No Drawings

SILVER HALIDE COLOR PHOTOGRAPHIC MATERIAL

FIELD OF THE INVENTION

The present invention relates to a silver halide color photographic material. More particularly, the present invention relates to a silver halide color photographic material excellent in image sharpness and storage stability. The present invention further relates to a silver halide color photographic material which can undergo a highly rapid processing, exhibits a high sharpness and is little subject to sensitivity drop in the portion to which a mechanical strength had been applied before exposure and sensitivity drop during the storage in the form of photographic light-sensitive material. Moreover, the present invention relates to a silver halide color photographic material which can undergo a highly rapid processing, exhibits a high sharpness, and is subject to a small sensitivity change against the humidity fluctuations upon exposure and the fluctuations of time interval between exposure and development.

BACKGROUND OF THE INVENTION

Commercially available silver halide photographic materials and image formation methods using these photographic light-sensitive materials are diversified and find application in all fields. The halogen composition of silver halide emulsions to be incorporated in these photographic light-sensitive materials, particularly photographic light-sensitive materials for picture taking, mostly comprises silver bromoiodide mainly composed of silver bromide for the purpose of attaining a high sensitivity. Products for use in a market having a strong demand for rapid delivery of large amounts of prints, such as photographic light-sensitive materials for color photographic paper, comprise silver bromide or silver bromochloride substantially free of silver iodide under the necessity of expediting the development speed.

In recent years, a silver bromochloride emulsion having a relatively high silver chloride content has been put into practical use to meet the demand for the improvement of the processability of color photographic papers. For example, a remarkable enhancement of the development speed has been attained as disclosed in JP-A-64-26837 (the term "JP-A" as used herein means an "unexamined published Japanese patent application").

On the other hand, rapidly processable silver halide photographic materials which provide a high picture quality have been desired in the art.

Silver halide photographic materials are normally subjected to continuous processing by an automatic developing machine installed in laboratories. In order to accomplish services for customers, it is required that photographic light-sensitive materials be developed and returned to the customers within the day of application. Further, it has recently be even required that photographic light-sensitive materials be returned to the customers within a hour from the time of application. Thus, the demand for rapid processing is growing. Further, the reduction in the processing time provides an enhancement of productivity, enabling a cost reduction. This also requires rapid processing.

In this situation, it has been known that the crystal form, size and composition of silver halide grains in the emulsion to be incorporated in the photographic light-sensitive materials have a great effect on the development speed, etc. It has been further known that the halogen composition of silver halide grains has a particularly great effect on the development speed, and a remarkable development speed is shown particularly when a high silver chloride coherent emulsion having a high silver chloride content is used.

On the other hand, with respect to picture quality, a further enhancement of sharpness has been expected for the purpose of thoroughly attaining the desired properties of color negative films or meeting the demand for diversified exposure systems caused by the expansion of a use of color prints. In the latter case, a high sharpness has been recently required for the purpose of reproducing ordinary photographic images as well as images requiring a high contrast in a small area such as graphic and character.

One of the requirements for color photographic light-sensitive materials is "high density recording". In order to thoroughly provide high density recording, the color photographic light-sensitive materials must exhibit a high sharpness. Thus, various techniques for enhancing sharpness have been developed depending on the demand for photographic light-sensitive materials and the application form thereof and have been actually applied.

As factors lowering the sharpness in photographic light-sensitive materials there have been known two phenomena, i.e., halation caused by the reflection of incident light at the interface between emulsion layer and support or the interface between support and air and irradiation caused by the scattering of light by silver halide grains themselves.

As a method for improving sharpness there has been known an approach which comprises the coloring of constituent layers of a photographic light-sensitive material with a dye or the like as described in U.S. Pat. No. 3,625,694.

Further, a method which comprises dyeing a specific layer in a photographic light-sensitive material with a fine solid dye dispersion is disclosed in, e.g., JP-A-2-282244.

However, the method which comprises the use of a dye to improve sharpness is disadvantageous in that the processed photographic light-sensitive material shows much stain on the white background. Accordingly, the amount of the dye to be incorporated cannot be increased high enough to thoroughly improve sharpness. In particular, when the photographic light-sensitive material is rapidly processed, the dye used can easily remain in the processed prints, causing more stain on the white background.

In silver halide color photographic materials, stain on the white background is a key to the quality of the white background of the image. It also adds to color turbidity in color images or impairs the visual sharpness. In particular, when a reflective support is used, the reflective density of stain is theoretically emphasized several times its transmission density. Accordingly, even minute stain can remarkably impairs the image quality. Thus, the elimination of stain on the white background is an important assignment.

A method which comprises coating a colloidal silver-containing layer to improve sharpness is disclosed in, e.g., JP-A-2-84637. However, this method is similarly disadvantageous in that when the photographic light-sensitive material is rapidly processed, the residual amount of silver at blix step is increased, causing a stain increase on the white background.

As an effective approach for improving sharpness there has been known a method which comprises providing a white pigment-containing layer on a support. For example, JP-A-3-156454 discloses a method which comprises a high density dispersion of titanium oxide grains in a waterproof resin layer to improve sharpness.

The inventors tried the foregoing approach. As a result, it was found that although stain on the white background is not worsened, the rise in the density of the white pigment to an extent to improve sharpness causes a remarkable drop of the strength of the waterproof resin layer and a remarkable deterioration of the smoothness of the coated layer.

An approach for dispersing a white pigment in a hydrophilic colloidal layer to improve sharpness is disclosed in, e.g., JP-A-59-177542 and JP-A-57-64235.

The inventors tried the foregoing approach. As a result, the white pigment density can be raised without causing the aforementioned troubles, enabling a thorough enhancement of sharpness. However, the use of the foregoing approach is disadvantageous in that a photographic light-sensitive material particularly suitable for rapid processing comprising a silver halide emulsion having a silver chloride content of 95 mol % or higher shows a great sensitivity drop when exposed under high humidity conditions and a great sensitivity change with the fluctuations of the time interval between exposure and development. Accordingly, this approach was found greatly disadvantageous in the supply of prints having a stable quality to customers.

A high silver chloride content color photographic material which has been improved in its sharpness by the foregoing methods is disadvantageous in that it is subject to sensitivity drop on the portion to which a mechanical force has been applied before exposure. This results in the density drop in the finished image on that portion. In particular, it is likely that the photographic light-sensitive material can be bent when handled with hands or can be twisted when carried through an automatic exposure and developing machine. In any case, the application of such a mechanical force to the photographic light-sensitive material can occur in an unspecified place. This results in an appreciable noise in the image that disadvantageously lowers the commercial value of color prints as image data.

Further, such a high silver chloride content color photographic material which has been improved in its sharpness by the foregoing methods was found disadvantageous in that it is subject to latent image instability. That is, such a photographic light-sensitive material is subject to gradual sensitivity drop during the storage in the form of photographic light-sensitive material and sensitivity change with the fluctuations of the time between the completion of exposure and the beginning of development. The sensitivity change during the storage probably makes it difficult to effect exposure under constant conditions, disadvantageously giving a heavy burden in keeping the quality of finished color prints constant.

The inventors made a study to overcome the foregoing disadvantages. As a result, it was found that the sensitivity drop on the portion to which a mechanical force has been applied before exposure depends on the degree of sulfur sensitization of emulsion, i.e., increase or decrease in the amount of a sulfur sensitizer or length of after-ripening time. It was also found that the rise in the degree of sulfur sensitization (i.e., rise in the amount of a sulfur sensitizer or extension of the after-ripening time) makes that portion less subject to sensitivity drop but makes that portion more subject to fog on the contrary. The fog on that portion results in an undesired noise on the white background. Accordingly, it is necessary that a chemical sensitization causing neither sensitivity drop nor fog be effected.

The inventors also made studies on silver halide color photographic materials having a relatively high sharpness, particularly color photographic papers. As a result, it was found that a photographic light-sensitive material comprising a white pigment-containing hydrophilic colloidal layer coated on a support is subject to the rise in fog density after a prolonged storage. This fog density rise after a prolonged storage in the form of unprocessed photographic light-sensitive material becomes remarkable when a color developer contaminated with a blix solution at a processing step is used. Taking into account the possibility of the fluctuations of the storage time between the preparation of the photographic light-sensitive materials and the processing in laboratories and the composition of the processing solutions used in laboratories, this is a great problem in the practical use.

The rapid delivery of prints having a high sharpness and a stable quality to customers is an important assignment from the standpoint of the current market need for silver halide color photographic materials.

JP-A-2-20853 discloses that the doping of a high silver chloride content emulsion with a hexacoordinated complex of Re, Ru or Os having at least 4 cyano ligands can provide a high sensitization. JP-A-1-105940 discloses that a high silver chloride content emulsion having a silver bromide-rich region selectively doped with iridium can provide an emulsion which exhibits excellent reciprocity law characteristics without impairing the latent image stability for several hours after exposure. JP-A-3-132647 discloses that the use of a high silver chloride content emulsion containing ferric or ferrous ions provides a high sensitivity and a high contrast and causes little sensitivity change with the fluctuations of illumination or temperature upon exposure and little desensitization under pressure. JP-A- 4-9034 and JP-A-4-9035 disclose that the use of a high silver chloride content emulsion containing a specific metal complex having at least two cyan ligands provides little reciprocity law failure, an excellent latent image stability and little pressure fog. JP-A-62-253145 discloses that the incorporation of metallic ions in a high silver chloride content emulsion having a high silver bromide-containing phase provides a silver halide photographic material suitable for rapid processing which exhibits little pressure fog or desensitization.

These prior art approaches on high silver chloride content emulsions containing metal dopants give no teaching of the inhibition of the fog density rise after a prolonged storage which becomes particularly remarkable when the photographic light-sensitive materials are processed with a color developer contaminated with a blix solution.

SUMMARY OF THE INVENTION

It is therefore an object of the present invention to provide an excellent silver halide color photographic material which can inhibit the aforementioned disadvantages.

The aforementioned object of the present invention will become more apparent from the following detailed description and examples.

The aforementioned object of the present invention is accomplished with (i) a silver halide color photographic material comprising on a support at least one light-sensitive emulsion layer, wherein at least one hydrophilic colloidal layer containing a white pigment in such an amount that the coated amount thereof is in the range of 2 g/m$^2$ or more is provided between said support and said light-sensitive emulsion layer, and at least one of layers constituting said light-sensitive emulsion layer comprises a silver halide emulsion having a silver chloride content of 90 mol % or more and containing at least one of metal complexes of Fe, Ru, Re, Os and Ir in silver halide grains and at least one mercapto heterocyclic compound; (ii) a silver halide color photographic material comprising on a support a photographic layer comprising at least one yellow dye-forming coupler-containing light-sensitive silver halide emulsion layer, at least one magenta dye-forming coupler-containing light-sensitive silver halide emulsion layer, at least one cyan dye-forming coupler-containing light-sensitive silver halide emulsion layer, and at least one light-insensitive hydrophilic colloidal layer, wherein (1) at least one of layers constituting said light-sensitive silver halide emulsion layer comprises silver bromochloride emulsion grains having a silver chloride content of 90 mol % or more or silver chloride emulsion grains, which are sensitized with a gold compound, (2) a hydrophilic colloidal layer containing a white pigment in such an amount that the density thereof is in the range of 20% by weight or more is provided between said support and the nearest silver halide emulsion layer, and (3) either said light-sensitive emulsion layer or said light-insensitive layer comprises at least one of compounds represented by the following general formulae (I) to (IX):

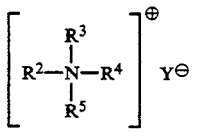
(I)

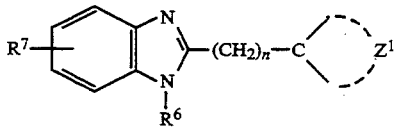
(II)

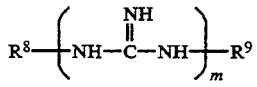
(III)

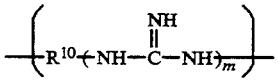
(IV)

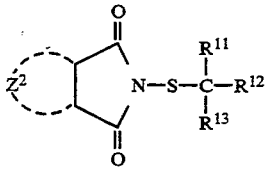
(V)

-continued

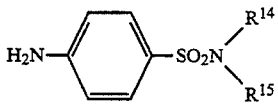
(VI)

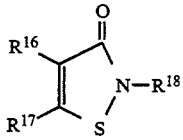
(VII)

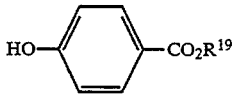
(VIII)

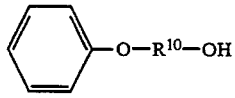
(IX)

wherein $R^2$, $R^3$, $R^4$, $R^5$, $R^6$, $R^8$ and $R^9$ each represents a hydrogen atom, alkyl group or aryl group; $R^7$ represents a hydrogen atom, alkyl group, aryl group, nitro group, carboxyl group, sulfo group, sulfamoyl group, hydroxyl group, halogen atom, alkoxy group or thiazolyl group; $R^{10}$ represents an alkylene group or arylene group; $R^{11}$, $R^{12}$ and $R^{13}$ each represents a halogen atom or alkyl group; $R^{14}$ and $R^{15}$ each represents a hydrogen atom, alkyl group, aryl group or nitrogen-containing heterocyclic residue; $R^{16}$ and $R^{17}$ each represents a hydrogen atom, halogen atom, alkyl group, aryl group or aryloxy group, with the proviso that $R^{16}$ and $R^{17}$ may be connected to each other to form a benzene ring; $R^{18}$ represents a hydrogen atom or alkyl group; $R^{19}$ represents an alkyl group or aryl group; Y represents a halogen atom; $Z^1$ represents a nonmetallic atom group necessary for the formation of a thiazolyl ring; $Z^2$ represents a nonmetallic atom group necessary for the formation of a 6-membered ring; n represents an integer 0 or 1; and m represents an integer 1 or 2; (iii) a silver halide color photographic material comprising on a support at least one yellow-developable silver halide emulsion layer, at least one magenta-developable silver halide emulsion layer, and at least one cyan-developable silver halide emulsion layer, wherein at least one of said silver halide emulsion layers comprises silver bromochloride emulsion grains or silver chloride emulsion grains containing substantially no silver iodide and having a silver chloride content of 95 mol % or more, at least one hydrophilic colloidal layer containing a white pigment in such an amount that the density thereof is in the range of 20% by weight or more is provided between said support and the nearest developable silver halide emulsion layer, and the film pH and film pAg of said light-sensitive material are in the range of 5.0 to 6.5 and 6.0 to 10.0, respectively; a silver halide color photographic material as defined in the foregoing clause (ii), wherein there is incorporated instead of or in combination with at least one compound of general formulae (I) to (IX) at least one aminoglycocide selected from the group consisting of gentamicin, amikacin, tobramycin, dibekacin, arbekacin, micronomicin, icepamicin, sisomicin, netilmicin and astromicin or at least one of compounds represented by the foregoing general formulae (VII) to (IX); a silver halide color photographic material as defined above or defined in the foregoing clause (ii), wherein at least one of layers constituting the photographic constituent layers provided on the support has a colored layer decolorable upon development; a silver halide color photographic material as defined in the foregoing clause (iii), wherein the coated amount of said white pigment to be incorporated in said hydrophilic colloidal layer is in the range of 2 g/m$^2$ or more; or a silver halide color photographic material as defined in the foregoing clause (iii), wherein said silver bromochloride emulsion grains are formed by adding to a system containing initially formed silver halide grains bromide ion-releasing compounds and/or bromine-releasing compounds in the total amount of 0.0005 to 0.05 mol per mol of the finally formed silver halide at any time of the grain formation procedure when any portion of the grain corresponding to 20% by volume or less of the whole grain is formed and/or at any time between the completion of the grain formation and the coating thereof on said support.

DETAILED DESCRIPTION OF THE INVENTION

The present invention will be further described hereinafter.

In the silver halide color photographic material (i) as disclosed above, when a hydrophilic colloidal layer containing a white pigment is coated on a support, it is necessary that the coated amount of the white pigment be in the range of 2 g/m$^2$ or more, preferably 4 g/m$^2$ or more, more preferably. 8 g/m$^2$ or more. The upper limit of the coated amount of the white pigment is preferably 40 g/m$^2$, though not specifically limited.

The "coated amount of white pigment" as specified herein indicates the value including an amount of various surface treating agents or dispersion stabilizers which are optionally incorporated in the white pigment for the purpose of improving its dispersibility or like purposes.

The proportion of the white pigment in the hydrophilic binder in the hydrophilic colloidal layer containing the white pigment can be arbitrarily predetermined in the range satisfying the aforementioned conditions but may be 10% by weight or more, preferably 20% by weight or more, more preferably 40% by weight or more, most preferably 70% by weight or more. Its upper limit is preferably 99% by weight, though not specifically limited.

The thickness of the hydrophilic colloidal layer containing a white pigment can be predetermined by the above specified content and coated amount but is preferably in the range of 0.5 to 10 μm.

Examples of the white pigment to be incorporated in the photographic light-sensitive material (i) of the present invention include titanium dioxide, barium sulfate, lithopone, carmina white, calcium carbonate, silica white, antimony trioxide, titanium phosphate, zinc oxide, white lead, and gypsum. Particularly effective among these pigments is titanium dioxide. Titanium dioxide to be used in the present invention may be of either rutile type or anatase type. Titanium dioxide to be used in the present invention may also be a product of either the sulfate process or the chloride process.

The grain diameter of the white pigment grains to be incorporated in the hydrophilic colloidal layer may be in the range of 0.1 μm to 1.0 μm, preferably 0.2 μm to 0.3 μm as calculated in terms of average grain size.

In the photographic light-sensitive material (i) of the present invention, as the binder (hydrophilic colloid) constituting the hydrophilic colloidal layer containing a white pigment, the silver halide emulsion layer and the light-insensitive interlayer there may be preferably used a gelatin. If necessary, other hydrophilic colloids may be used in an arbitrary proportion instead of gelatin.

Examples of such other hydrophilic colloids include gelatin derivatives, graft polymers of gelatin and other polymers, proteins such as albumin and casein, cellulose derivatives (e.g., hydroxyethyl cellulose, carboxymethyl cellulose, cellulose sulfate), saccharides such as sodium alginate and starch derivative, and various kinds of synthetic polymers such as polyvinyl alcohol, partially acetalated polyvinyl alcohol, poly(N-vinylpyrrolidone), polyacrylic acid, polymethacrylic acid, polyacrylamide, polyvinyl imidazole and polyvinyl pyrazole.

In the photographic light-sensitive material (i) of the present invention, the white pigment-containing hydrophilic colloidal layer may comprise various materials for use in general photographic light-sensitive materials incorporated therein besides white pigment and binder. For example, a surface active agent as coating aid, a film hardener, a dye, a fog inhibitor or the like may be used. Further, a high boiling organic solvent which has been dispersed in the form of fine oil drops may be incorporated in the white pigment-containing hydrophilic colloidal layer. When a dispersion of such a high boiling organic solvent is incorporated in the white pigment-containing hydrophilic colloidal layer, various oil-soluble materials (e.g., fluorescent brightening agent) may be dissolved therein and incorporated in the dispersion.

The photographic light-sensitive material (i) of the present invention comprises a support, at least one light-sensitive emulsion layer coated on the support, a light-insensitive layer such as color mixing inhibiting layer and protective layer, and a hydrophilic colloidal layer containing a white pigment.

In the photographic light-sensitive material (i) of the present invention, the hydrophilic colloidal layer containing a white pigment is provided interposed between the support and the light-sensitive emulsion layer.

Examples of the support to be used in the photographic light-sensitive material (i) of the present invention include a paper made of natural pulp, a synthetic pulp, etc., a baryta paper, a paper coated with a resin such as a polyolefin (e.g., polyethylene, polypropylene) and polyester, etc., a synthetic high molecular film such as polyethylene, polypropylene, polystyrene, polycarbonate, hard polyvinylchloride and polyethylene terephthalate, and a natural high molecular film such as cellulose diacetate, cellulose triacetate and nitrocellulose.

The photographic light-sensitive material (i) of the present invention may be in an embodiment in which the white pigment is incorporated only in the hydrophilic colloidal layer and is not incorporated in a resin constituting the support, e.g., a resin to be coated on a paper support, or a resin film as the support itself or in another embodiment in which the white pigment is incorporated in the hydrophilic colloidal layer as well as the resin constituting the support.

In the photographic light-sensitive material (i) of the present invention, if a reflective type support is used, the reflective type support is preferably a paper support coated with a waterproof resin layer on both sides thereof, at least one of the waterproof resin layers containing fine grains of white pigment. These white pigment grains are preferably contained in the waterproof resin layer in a density of 12% by weight or more, more preferably 14% by weight or more. As such light reflecting white pigment grains there are preferably used grains obtained by thoroughly kneading white pigment grains in the presence of a surface active agent, and optionally treating the surface of the pigment grains with a divalent, trivalent or tetravalent alcohol.

These white pigment grains are preferably dispersed uniformly in the reflective layer without aggregation. The size of its distribution can be determined by measuring the percentage (%) (Ri) of the area occupied by fine grains projected on a unit area. The fluctuation coefficient of the percent area occupation ( % ) can be determined by calculating the ratio (s/R) of the standard deviation s of Ri to the average value (R) of Ri. In the present invention, the fluctuation coefficient of the percent area occupation (%) of pigment fine grains is preferably in the range of 0.15 or less, more preferably 0.12 or less, particularly 0.08 or less.

In the support of the material (i) of the present invention, the surface roughness on the central line on the side on which a light-sensitive layer is set forth is preferably in the range of 0.14 μm or less.

In preparing the photographic light-sensitive material (i) of the present invention, there may be used a support having a surface with a diffused reflectivity of the second kind. The term "diffused reflectivity of the second kind" as used herein means a "diffused reflectivity obtained by roughening a mirror-like surface so that the surface is divided into minute surfaces facing in different directions". Regarding the roughness of the surface of a diffused reflectivity of the second kind, the three-dimensional average roughness with respect to the central surface is in the range of 0.1 to 2 μm, preferably 0.1 to 1.2 μm. The frequency of the surface roughness is preferably in the range of 0.1 to 2,000 cycle/mm, more preferably 50 to 600 cycle/mm for the roughness of 0.1 μm or more. For the details of such a support, reference can be made to JP-A-2-239244.

On the white pigment-containing hydrophilic colloidal layer may be coated a light-sensitive emulsion layer directly or via one or more light-insensitive hydrophilic colloidal layers. If light-insensitive hydrophilic colloidal layers are provided, the total thickness of these layers is preferably in the range of 5 μm or less, more preferably 2 μm or less. These light-insensitive hydrophilic colloidal layers may optionally contain various photographically useful materials. Examples of such photographically useful materials include a surface active agent as coating aid, a film hardener, a dye, and a fog inhibitor. Further, a colloidal silver, a solid dispersion of dye or a cationic polymer dyed with a dye may be incorporated in these light-insensitive hydrophilic colloidal layers to form colored layers decolorable upon development. Alternatively, a high boiling organic solvent dispersed in the form of fine oil drops may be incorporated in these light-insensitive hydrophilic colloidal layers. Such a high boiling organic solvent may contain a photographically useful material such as oil-soluble color mixing inhibitor, fluorescent brightening agent and ultraviolet absorbent dissolved therein.

The photographic light-sensitive material (i) of the present invention preferably contains a dye decolorable upon processing as described in EP 0337490A2, pp. 27–76, (particularly oxonol dye, cyanine dye) in the hydrophilic colloidal layer for the purpose of inhibiting irradiation or halation or improving fastness to safelight.

Some of these water-soluble dyes cause deterioration in the color separation or fastness to safelight when used in an increased amount. As dyes which can be used without deteriorating the color separation there may be preferably used water-soluble dyes as described in Japanese Patent Application Nos. 03-310143, 03-310189, and 03-310139.

The photographic light-sensitive material (i) of the present invention preferably comprises a colored layer decolorable upon processing instead of or in combination with such a water-soluble dye. The colored layer decolorable upon processing to be used in the present invention may be provided in direct contact with an emulsion layer or via an interlayer containing a processing color mixing inhibitor such as gelatin and hydroquinone. The colored layer is preferably disposed under an emulsion layer which is developed to the same primary color as the color of the colored layer (support side). All colored layers which correspond to the respective primary colors may be individually provided. Alternatively, only some of these colored layers may be selectively provided. Further, a single colored layer which has been colored so as to correspond to a plurality of primary colors can be provided. In respect to the optical reflection density of the colored layer, the optical density value at the wavelength in the exposure wavelength range (400 nm to 700 nm visible light range for commonly used printer exposure or wavelength of the scanning exposure light source used) at which the highest optical density is given is preferably in the range of 0.2 to 3.0, more preferably 0.5 to 2.5, particularly 0.8 to 2.0.

The formation of the colored layer can be accomplished by any conventional known methods. Examples of such known methods include a method which comprises the use of a dye as described in JP-A-2-282244, upper right column, page 3 to page 8, a method as described in JP-A-3-7931, upper right column, page 3—lower right column, page 11 which comprises incorporating a dye in a hydrophilic colloidal layer in the form of solid fine dispersion, a method which comprises mordanting a cation polymer with an anionic dye, a method which comprises allowing a dye to be adsorbed to fine grains of silver halide or the like to be fixed in a layer, and a method which comprises the use of a colloidal silver as described in JP-A-1-239544. As the method which comprises dispersing finely divided dye grains in a solid form there may be used a method as described in JP-A-2-308244, pp. 4–13, which comprises the incorporation of a finely divided dye powder that is substantially insoluble in water at pH 6 or less but is substantially soluble in water at pH 8 or more. An example of the method which comprises mordanting a cationic polymer with an anionic dye is described in JP-A-2-84637, pp. 18–26. A method for preparing colloidal silver as a light absorbent is described in U.S. Pat. Nos. 2,688,601, and 3,459,563. Preferred among these methods are the method which comprises the incorporation of finely divided dye grains and the method which comprises the use of colloidal silver.

The silver halide emulsion grains to be incorporated in the photographic light-sensitive material (i) of the present invention contain a metal complex of Fe, Ru, Re, Os or Ir.

The amount of such a metal complex to be incorporated depends much on the kind of the metal complex used but is preferably in the range of $10^{-9}$ mol to $10^{-2}$ mol, most preferably $10^{-8}$ mol to $10^{-4}$ mol per mol of silver halide.

The metal complex to be incorporated in the photographic light-sensitive material (i) of the present invention may be added to the system at any step during the preparation of silver halide grains, i.e., nucleation, growth of nuclei, physical ripening, before or after chemical sensitization. The metal complex may be batch-wise added to the system several times. Such a metal complex is preferably used in the form of solution in water or a proper solvent.

In particular, the metal complex to be incorporated in the photographic light-sensitive material (i) of the present invention is preferably an iridium complex. Examples of trivalent or tetravalent iridium complex to be used in order to incorporate iridium complexes in the silver halide emulsion grains will be given below, but the effects of the present invention should not be construed as being limited thereto.

Hexachloroiridium (III) or (IV) complex salts, hexaamine iridium (III) or (IV) complex salts The amount of such an iridium complex to be incorporated is preferably in the range of $1\times10^{-9}$ mol to $1\times10^{-4}$ mol, most preferably $1\times10^{-8}$ mol to $1\times10^{-5}$ mol per mol of silver halide, except for iridium complexes having at least two cyano ligands as exemplified below.

As the metal complex to be incorporated in the silver halide emulsion grains for use in the photographic light-sensitive material (i) of the present invention there may be preferably used at least one selected from the group consisting of metal complexes of Fe, Ru, Re., Os and Ir having at least two cyano ligands. Such a metal complex can be represented by the following general formula [C-I]:

$$[M_1(CN)_{6-a}L_a]^n \qquad \text{[C-I]}$$

wherein $M_1$ represents Fe, Ru, Re, Os or Ir; L represents a ligand other than CN; "a" represents an integer 0, 1 or 2; and n represents an integer −2, −3 or −4.

Specific examples of the metal complex having at least two cyano ligands to be used in the present invention will be given below. As paired ions to be incorporated in such a metal complex there may be preferably used ammonium ion and alkaline metal ions such as sodium ion and potassium ion.

$[Fe(CN)_6]^{-4}$, $[Fe(CN)_6]^{-3}$, $[Ru(CN)_6]^{-4}$, $[Ru(CN)_5F]^{-4}$, $[Ru(CN)_4F_2]^{-4}$, $[Ru(CN)_5Cl]^{-4}$, $[Ru(CN)_4Cl_2]^{-4}$, $[Ru(CN)_5(OCN)]^{-4}$, $[Ru(CN)_5(SCN)]^{-4}$, $[Ru(CN)_6]^{-4}$, $[Re(CN)_5Br]^{-4}$, $[Re(CN)_4Br_2]^{-4}$, $[Os(CN)_6]^{-4}$, $[Os(CN)_6I]^{-4}$, $[Os(CN)_4I_2]^{-4}$, $[Ir(CN)_6]^{-3}$, $[Ir(CN)_5(N_3)]^{-3}$, $[Ir(CN)_5(H_2O)]^{-3}$

The content of the at least one metal complex having at least two cyano ligands selected from the group consisting of metal complexes of Fe, Ru, Re, Os and Ir to be incorporated in the photographic light-sensitive material (i) is preferably in the range of $1\times10^{-6}$ mol or more, and to $1\times10^{-3}$ mol or less, more preferably $5\times10^{-6}$ mol or more and $5\times10^{4}$ mol per mol of silver halide.

The aforementioned metal complex having at least two cyano ligands to be incorporated in the photographic light-sensitive material (i) of the present invention may be added to the system at any step during the preparation of silver halide grains, i.e., nucleation, growth, physical ripening, before or after chemical sensitization. The metal complex may be batch-wise added to the system several times. In the present invention, 50% or more of all the content of the aforementioned metal complex having at least two cyano ligands incorporated in the silver halide grains are present in the surface layer of grains which accounts for 50% or less of the volume thereof. The term "surface layer of grains which accounts for 50% or less of the volume thereof" as used herein means the surface portion of a grain which accounts for 50% or less, preferably 40% or less, more preferably 20% or less of the volume of one grain. A metal complex-free layer may be further provided outside the above specified surface layer containing a metal complex.

Such a metal complex may be added in the form of solution in water or a proper solvent directly to a reaction solution during the formation of silver halide grains or to an aqueous solution of silver halide, aqueous solution of silver salt or other solutions for the formation of silver halide grains so that it is incorporated in the silver halide grains thus formed. An alternative preferable approach is to dissolve silver halide grains containing a metal complex and to precipitate these silver halide from the solution thus obtained on other silver halide grains to incorporate the metal complex into silver halide grains.

The halogen composition of the silver halide grains to be incorporated in the photographic light-sensitive material (i) of the present invention needs to have a silver chloride content of 90 mol % or more. The silver halide grains preferably comprise silver bromochloride substantially free of silver iodide, in which 95 mol % or more of total amount of silver halide is silver chloride. "Substantially free of silver iodide" as used herein indicates a silver iodide content of 1.0 mol % or less. More preferably, the silver halide grains comprises silver bromochloride substantially free of silver iodide, in which 98 mol % or more of total amount of silver halide is silver chloride, or silver chloride.

The silver halide grains to be incorporated in the photographic light-sensitive material (i) of the present invention preferably comprises a localized phase having a silver bromide content of more than at least 10 mol %. The location of a localized phase having a higher silver bromide content than the substrate needs to be in the vicinity of the surface of the grains in order to attain the effects of the present invention and from the standpoint of pressure properties and dependence on the composition of processing solutions. The term "vicinity of the surface of the grains" as used herein means the position located within 1/5, preferably 1/10 of the grain size of the silver halide grain used from the top surface thereof. The most preferable localized phase having a higher silver bromide content than the substrate is one having a silver bromide content of more than at least 10 mol % epitaxially grown on the corner of a cubic or tetradecahedral silver chloride grain.

The silver bromide content of such a localized phase is preferably more than 10 mol %. If the silver bromide content is too high, the photographic light-sensitive material may be provided with photographically undesirable properties. For example, the photographic light-sensitive material may be desensitized under pressure or may be subject to a great change in sensitivity and gradation due to the fluctuations of the composition of processing solutions. Taking into account these problems, the silver bromide content of the localized phase having a high silver bromide content is preferably in the range of 10 mol % to 70 mol %, most preferably 20 mol % to 50 mol %. The silver bromide content of the localized phase having a high silver bromide content can be analyzed by X-ray diffractometry (as described in "Shinjikken Kagaku Koza 6; Kozo Kaiseki", Nihon Kagakukai, Maruzen)

The aforementioned localized phase preferably comprises silver in an amount of 0.1 mol % to 20 mol %, 0.5 mol % to 7 mol % of the total amount of silver constituting the silver halide grains of the present invention.

The interface of such a localized phase with other phases may have a definite phase interface or may have a transition region having a gradual gradation of halogen composition.

The formation of such a localized phase can be accomplished by various methods. For example, a soluble silver salt and a soluble halogen salt can be reacted with each other by the single jet process or double jet process to form a localized phase. Alternatively, a conversion method by which silver halide grains which have been already formed are converted to silver halide grains having a lower solubility product may be used to form a localized phase. For example, a water-soluble bromide solution may be added to host cubic or tetradecahedral silver halide grains, or finely divided silver bromochloride or silver bromide grains having a smaller average grain size and a higher silver bromide content than the host grains may be mixed with the host grains, and then ripened to form a localized phase.

The formation of such a localized phase is preferably effected in the presence of an iridium compound. This means that an iridium compound is supplied into the reaction system at the same time with, shortly before or shortly after the supply of silver or halogen to be used for the formation of a localized phase. For example, if a solution of a water-soluble bromide is added to the system to form a localized phase, it is a preferable conduct that an iridium compound has been previously incorporated in the solution, or another solution containing an iridium compound and the solution of water-soluble bromide are simultaneously added to the system. If finely divided silver halide grains having a smaller average grain diameter and a higher silver bromide content than host silver halide grains are mixed with the host grains, and then ripened to form a localized phase, it is a preferable conduct that an iridium compound has been previously incorporated in the finely divided silver halide grains having a high silver bromide content. The iridium compound may be added to the system during a formation of phases other than such a formation of the localized phase. However, the localized phase is preferably formed with at least 50 mol %, more preferably at least 80 mol % of the total amount of iridium added.

In the photographic light-sensitive material (i) of the present invention, the silver halide emulsion is preferably subjected to sulfur sensitization and/or gold sensitization, optionally in combination with reduction sensitization.

The sulfur chemical sensitization to be used for the photographic light-sensitive material (i) of the present invention can be effected with a sulfur-containing compound reactive with an active gelatin or silver (e.g., thiosulfate, thioureas, mercapto compounds, rhodanines). Specific examples of such a sulfur-containing compound are described in U.S. Pat. Nos. 1,574,944, 2,278,947, 2,410,689, 2,728,668, and 3,656,955.

The silver halide grains to be incorporated in the photographic light-sensitive material (i) of the present invention may have either or both of (100) planes and (111) planes or planes of higher order. The silver halide grains to be incorporated in the photographic light-sensitive material (i) of the present invention preferably comprise cubes or tetradecahedrons mainly having (100) planes.

The size of the silver halide grains to be incorporated in the photographic light-sensitive material (i) of the present invention may be within a commonly specified range but is preferably in the range of 0.1 μm to 1.5 μm as calculated in terms of average grain diameter. The grain diameter distribution may be either polydisperse or monodisperse, preferably monodisperse. In the grain size distribution, which represents the degree of monodispersibility, the ratio (s/d) of the statistic standard deviation (s) to the average grain size (d) is preferably in the range of 0.2 or less, more preferably 0.15 or less. Further, two or more kinds of monodisperse emulsions may be preferably used in admixture.

As the mercapto heterocyclic compound to be incorporated in the photographic light-sensitive material (i) of the present invention there can be preferably used a compound represented by the following general formula (IA):

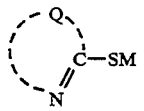

(IA)

wherein Q represents an atomic group necessary for the formation of a 5- or 6-membered heterocycle or 5- or 6-membered heterocycle condensed with benzene rings; and M represents a cation.

The compound represented by the general formula (IA) will be further described hereinafter.

Examples of the heterocycle represented by Q include imidazole ring, tetrazole ring, thiazole ring, oxazole ring, selenazole ring, benzoimidazole ring, naphthoimidazole ring, benzothiazole ring, naphthothiazole ring, benzoselenazole ring, naphthoselenazole ring, and benzoxazole ring. Examples of the cation represented by M include hydrogen ion, alkaline metal (e.g., sodium, potassium) ion, and ammonium ion. Preferred among the compounds represented by the general formula (IA) are mercapto compounds represented by the following general formulae (IA-1), (IA-2), (IA-3) and (IA-4):

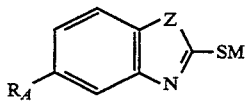

(IA-1)

wherein $R_A$ represents a hydrogen atom, alkyl group, alkoxy group, aryl group, halogen atom, carboxyl group or salt thereof, sulfo group or salt thereof, or amino group; Z represents —NH—, —O— or —S—; and M is as defined in the general formula (IA).

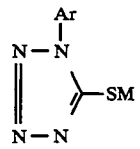

(IA-2)

wherein Ar represents

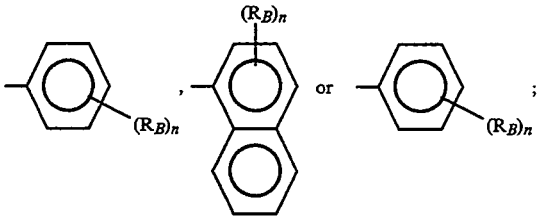

$R_B$ represents an alkyl group, alkoxy group, carboxyl group or salt thereof, sulfo group or salt thereof, hydroxyl group, amino group, acylamino group, carbamoyl group or sulfonamide group; n represents an integer 0 to 2; and M is as defined in the general formula (IA).

In the foregoing general formulae (IA-1) and (IA-2), examples of the alkyl group represented by $R_A$ or $R_B$ include methyl, ethyl, and butyl. Examples of the alkoxy group represented by $R_A$ or $R_B$ include methoxy, and ethoxy. Examples of the salts of carboxyl or sulfo group represented by $R_A$ or $R_B$ include sodium salts and ammonium salts of carboxyl and sulfo groups.

In the general formula (IA-1), examples of the aryl group represented by $R_A$ include phenyl and naphthyl. Examples of the halogen atom represented by $R_A$ include chlorine atom and bromine atom.

In the general formula (IA-2), examples of the acylamino group represented by $R_B$ include methylcarbonylamino, and benzoylamino. Examples of the carbamoyl group represented by Rs include ethyl carbamoyl, and phenyl carbamoyl. Examples of the sulfonamide group represented by $R_B$ include methyl sulfonamide, and phenyl sulfonamide.

The foregoing alkyl group, alkoxy group, aryl group, amino group, acylamino group, carbamoyl group, and sulfonamide group may further contain substituents. Examples of substituents for, e.g., amino group include alkylcarbamoyl-substituted amino group, i.e., alkyl-substituted ureido group.

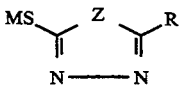

(IA-3)

wherein Z represents —N($R_{A1}$)—, oxygen atom or sulfur atom; R represents a hydrogen atom, alkyl group, aryl group, alkenyl group, cycloalkyl group, —$SR_{A1}$, —N($R_{A2}$)$R_{A3}$, —NHCO$R_{A4}$, —NHS$O_2R_{A5}$ or heterocyclic group; $R_{A1}$ represents a hydrogen atom, alkyl group, alkenyl group, cycloalkyl group, aryl group, —CO$R_{A4}$ or —S$O_2R_{A5}$; $R_{A2}$ and $R_{A3}$ each represents a hydrogen atom, alkyl group or aryl group; $R_{A4}$ and $R_{A5}$ each represents an alkyl group or aryl group; and M is as defined in the general formula (IA).

Examples of the alkyl group represented by R, $R_{A1}$, $R_{A2}$, $R_{A3}$, $R_{A4}$ or $R_{A5}$ include methyl, benzyl, ethyl, and propyl. Examples of the aryl group represented by R, $R_{A1}$, $R_{A2}$, $R_{A3}$, $R_{A4}$ or $R_{A5}$ include phenyl, and naphthyl.

Examples of the alkenyl group represented by R and $R_{A1}$ include propenyl. Examples of the cycloalkyl group represented by R and $R_{A1}$ include cyclohexyl. Examples of the heterocyclic group represented by R include furyl, and pyridinyl.

The alkyl group and aryl group represented by R, $R_{A1}$, $R_{A2}$, $R_{A3}$, $R_{A4}$ or RAS, the alkenyl group and cycloalkyl group represented by R or $R_{A1}$, and the heterocyclic group represented by R may further contain substituents.

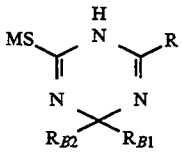

(IA-4)

wherein R and M are as defined in the general formula (IA-3); and $R_{B1}$ and $R_{B2}$ have the same meaning as $R_{A1}$ and $R_{A2}$ in the general formula (IA-3), respectively.

Specific examples of the compound represented by the general formula (IA) will be given below, but the present invention should not be construed as being limited thereto.

I-1-1

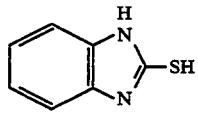

I-1-2

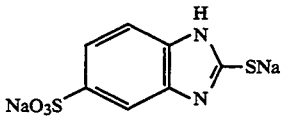

I-1-3

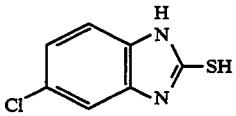

I-1-4

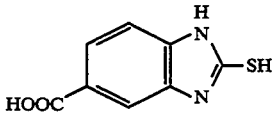

I-1-5

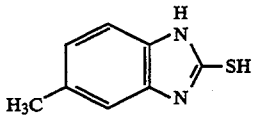

I-1-6

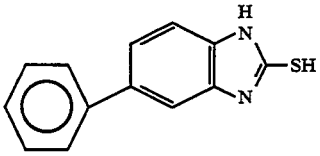

I-1-7

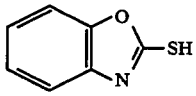

-continued
I-1-8
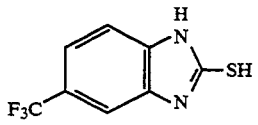
I-2-1
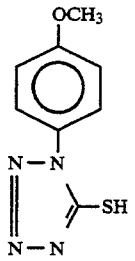
I-2-2
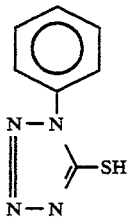
I-2-3
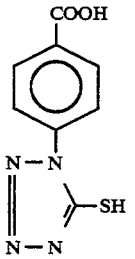
I-2-4
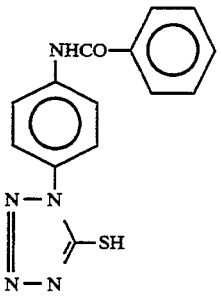
I-2-5
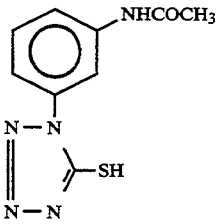
-continued
I-2-6
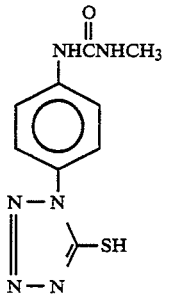
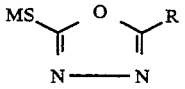
| Exemplary Compound | R | M |
|---|---|---|
| I-3-1 | $-C_2H_5$ | —H |
| I-3-2 | $-CH_2-CH=CH_2$ | —H |
| I-3-3 | $-CH=CH-CH_2-CB_3$ | —H |
| I-3-4 | $-C_7H_{15}$ | —H |
| I-3-5 | $-C_9H_{19}$ | —Na |
| I-3-6 | 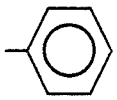 | —H |
| I-3-7 | $-C_4H_9(t)$ | —H |
| I-3-8 | 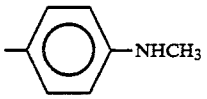 | —H |
| I-3-9 | 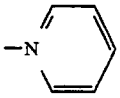 | —H |
| I-3-10 | 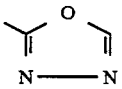 | —H |
| I-3-11 | 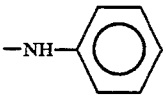 | —H |
| I-3-12 | 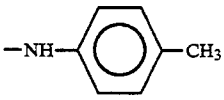 | $-NH_4$ |
| I-3-13 | $-NHCOCH_3$ | —H |
| I-3-14 | 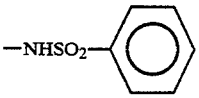 | —H |
| I-3-15 | $-N(CH_3)_3$ | —H |
| I-3-16 | 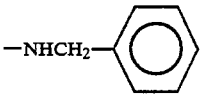 | —H |

-continued

| | | |
|---|---|---|
| I-3-17 | $-CH_2-$ 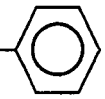 | —H |
| I-3-18 | $-S-CH_3$ | —H |
| I-3-19 | —S— 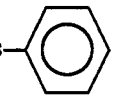 | —H |
| I-3-20 | —SH | —H |
| I-3-21 | —H | —H |
| I-3-22 | $-C_2H_5$ | —H |
| I-3-23 | $-C_4H_9(t)$ | —H |
| I-3-24 | $-C_6H_{13}$ | —H |
| I-3-25 | 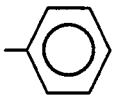 | —H |
| I-3-26 | 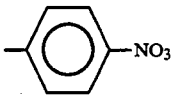 $-NO_3$ | —H |
| I-3-27 | 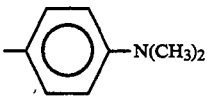 $-N(CH_3)_2$ | —H |
| I-3-28 | 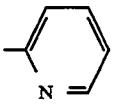 | —H |
| I-3-29 | —NH— 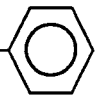 | —H |
| I-3-30 | $-NH_2$ | —H |
| I-3-31 | $-CH_2CH{=}CH_2$ | —H |
| I-3-32 | —SH | —H |
| I-3-33 | $-NHCOC_2H_5$ | —H |

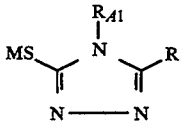

| Exemplary Compound | R | $R_{A1}$ | M |
|---|---|---|---|
| I-3-34 | $-C_2H_5$ | —H | —H |
| I-3-35 | $-CH_3$ | $-CH_3$ | —H |
| I-3-36 | $-CH_3$ | 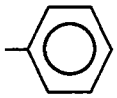 | —H |
| I-3-37 | $-NHCOCH_3$ | $-CH_3$ | —H |
| I-3-38 | —NHCO— 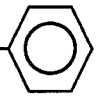 | —CO— 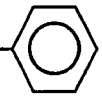 | —H |
| I-3-39 | $-NHCOCH_3$ | $-COCH_3$ | —H |

-continued

| | | | |
|---|---|---|---|
| I-3-40 | $-NHCOCH_3$ | $-CH_2-$ 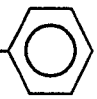 | —H |

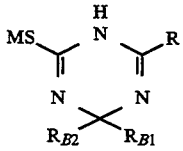

| Exemplary Compound | R | $R_{B1}$ | $R_{B2}$ | M |
|---|---|---|---|---|
| I-4-1 | $-C_2H_5$ | $-CH_3$ | $-CH_3$ | —H |
| I-4-2 | 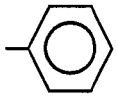 | $-CH_3$ | $-CH_3$ | —H |
| I-4-3 | $-NH_2$ | —H | 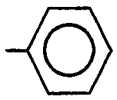 | —H |
| I-4-4 | —NH— 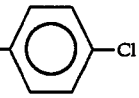 —Cl | $-CH_3$ | $-C_4H_9$ | —H |
| I-4-5 | $-NHCOCH_3$ | $-CH_3$ | $-CH_3$ | —H |
| I-4-6 | —NHCO— 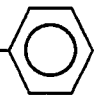 | $-CH_3$ | $-CH_3$ | —H |
| I-4-7 | 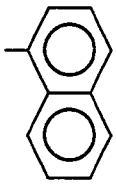 | $-CH_3$ | $-C_3H_7(i)$ | —H |

I-4-8

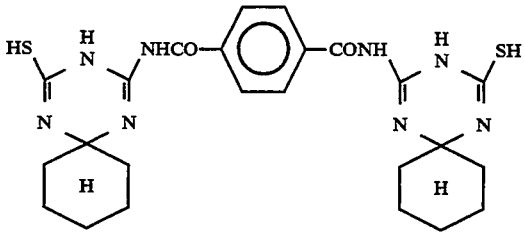

The amount of the compound represented by the general formula (IA) to be incorporated in the system is preferably in the range of $1\times10^{-5}$ to $5\times10^{-2}$ mol, more preferably $1\times10^{-4}$ to $1\times10^{-2}$ mol per mol of silver halide. The method for the addition of the compound represented by the general formula (IA) is not specifically limited. The compound of the general formula (IA) may be added to the system during the formation, physical ripening or chemical ripening of silver halide grains or during the preparation of the coating solution.

As the binder or protective colloid to be used for the photographic light-sensitive material (i) of the present invention there may be advantageously used a gelatin. Other hydrophilic colloids may be used singly or in combination with such a gelatin. An example of such a gelatin which can be preferably used is a low calcium gelatin having a calcium content of 800 ppm or less, more preferably 200 ppm or less. In order to prevent various mold and bacteria from proliferating in the hydrophilic colloidal layer to deteriorate the image, it is preferred that an antifungal substance as described in JP-A-63-271247 be incorporated in the system.

The photographic light-sensitive material (i) of the present invention may be exposed to visible light or infrared rays. The exposure can be carried out under low intensity or high intensity. A preferred example of the high intensity exposure method is a laser scanning exposure process with an exposure time of less than $1\times10^{-4}$ seconds, more preferably less than $1\times10^{-6}$ seconds per pixel.

A bandstop filter as described in U.S. Pat. No. 4,880,726 is preferably used upon exposure. This eliminates light color mixing, providing a remarkable improvement in the color reproducibility.

A photographic light-Sensitive material which has been exposed is then subjected to a commonly used color development process. The photographic light-sensitive material of the present invention which has been exposed is preferably subjected to color development followed by blix for the purpose of rapid processing. In particular, if the aforementioned high silver chloride content emulsion is used, the pH value of the blix solution is preferably in the range of about 6.5 or less, more preferably about 6 or less for the purpose of accelerating desilvering.

As the silver halide emulsion, other materials (e.g., additives) and photographic constituent layers (layer configuration) which can be used in the photographic light-sensitive material (i) of the present invention, and processing methods and processing additives to be used in the processing of the photographic light-sensitive material (i) of the present invention there may be preferably used those described in the following patents, particularly EP0,355,660A2 (corresponding to JP-A-2-139544).

| Photographic constituent | JP-A-62-215272 | JP-A-2-33144 | EPO,355,660A2 |
|---|---|---|---|
| Silver halide emulsion | Line 6, upper right column, p. 10-line 5, lower left column, p. 12/last line 4, lower right column, p. 12-line 17, upper left column, p. 13 | Line 16, upper right column, p. 28-line 11, lower right column, p. 29/lines 2–5, p. 30 | Line 53, p. 45-line 3, p 47/lines 20–22, p. 47 |
| Silver halide solvent | Lines 6–14, lower left column, p. 12/last line 3, upper right column-last line, lower left column, p. 18 | — | — |
| Chemical sensitizer | Last line 3, lower right column-last line 5, lower right column, p. 12/line 1, lower right column, p. 18-last line 9, upper right column, p. 22 | Line 12-last line, lower right column, p. 29 | Lines 4–9, p. 47 |
| Spectral sensitizer (spectral sensitizing method) | Last line 8, upper right column, p. 22-last line, p. 38 | Lines 1–13, upper left column, p. 30 | Lines 10–15, p. 47 |
| Emulsion stabilizer | Line 1, upper left column, p. 39-last line, upper right column, p. 72 | Line 14, upper left column-line 1, upper right, p. 30 | Lines 16–19, p. 47 |
| Development accelerator | Line 1, lower left column, p. 72-line 3, upper right column, p. 91 | — | — |
| Color coupler (cyan, magenta, yellow coupler) | Line 4, upper right column, p. 91-line 6, upper left column, p. 121 | Line 14, upper right column, p. 3-last line, upper left column, p. 35 | Lines 15–27, p. 4/line 30, p. 5-last line, p. 28/lines 29—31, p. 45/line 23, p. 47-line 50, p. 63 |
| Color intensifier | Line 7, upper left column, p. 121-line 1, upper right column, p. 125 | — | — |
| Ultraviolet absorbent | Line 2, upper right column, p. 125-last line, lower left column, p. 127 | Line 14, upper right column, p. 37-line 11, upper left column, p. 38 | Lines 22–31, p. 65 |
| Discoloration inhibitor (image stabilizer) | Line 1, lower right column, p. 127-line 8, lower left column, p. 137 | Line 12, upper right column, p. 36-line 19, upper lower column, p. 37 | Line 30, p. 4-line 23, p. 5/line 1, p. 29-line 25, p. 45/lines 33–40, P. 45/lines 2–21, p. 65 |
| High boiling and/or low boiling organic solvent | Line 9, lower left column, p. 137-last line, upper right column, p. 144 | Line 14, lower right column, p. 35-last line 4, upper left column, p. 36 | Lines 1–51, p. 64 |

-continued

| Photographic constituent | JP-A-62-215272 | JP-A-2-33144 | EPO,355,660A2 |
|---|---|---|---|
| Process for dispersion of photographic additives | Line 1, lower left column, p. 144-line 7, upper right column, p. 146 | Line 10, lower right column, p. 27-last line, upper left column, p. 28/line 12, lower right column-line 7, upper right column, p. 36 | Line 51, p. 63-line 56, p. 64 |
| Film hardener | Line 8, upper right column, p. 146-line 4, lower left column, p. 155 | — | — |
| Developing agent precursor | Line 5, lower left column, p. 155-line 2, lower right column, p. 155 | | |
| Development inhibitor-releasing compound | Lines 3–9, lower right column, p. 155 | — | — |
| Support | Line 19, lower right column, p. 155-line 14, upper left column, p. 156 | Line 18, upper right column, p. 38-line 3, upper left column, p. 39 | Line 29, p. 66-line 13, p. 67 |
| Constitution of light-sensitive layer | Line 15, upper left column, p. 156-line 14, lower right column, p. 156 | Lines 1–15, upper right column, p. 28 | Lines 41–52, p. 45 |
| Dye | Line 15, lower right column, p. 156-last line, lower right column, p. 184 | Line 12, upper left column,-line 7, upper right column, p. 38 | Lines 18–22, p. 66 |
| Discoloration inhibitor | Line 1, upper left column, p. 185-line 3, lower right column, p. 188 | Lines 8–11, upper right column, p. 36 | Line 57, p. 64-line 1, p. 65 |
| Gradation adjustor | Lines 4–8, lower right column, p. 188 | — | — |
| Stain inhibitor | Line 9, lower right column, p. 188-line 10, lower right column, p. 193 | Last line, upper left column-line 13, lower right column, p. 37 | Line 32, p. 65-line 17, p. 66 |
| Surface active agent | Line 1, lower left column, p. 201-last line, upper right column, p. 210 | Line 1, upper right column, p. 18-last line, lower right column, p. 24/last line 10, lower left column-line 9, lower right column, p. 27 | — |
| Fluorine-containing compound (antistatic agent, coating aid, lubricant, adhesion inhibitor) | Line 1, lower left column, p. 210-line 5, lower left column, p. 222 | Line 1, upper left column, p. 25-line 9, lower right column, p. 27 | — |
| Binder (hydrophilic colloid) | Line 6, lower left column, p. 222-last line, upper left column, p. 225 | Lines 8–18, upper right column, p. 38 | Lines 23–28, p. 66 |
| Thickening agent | Line 1, upper right column, p. 225-line 2, upper right column, p. 227 | — | — |
| Antistatic agent | Line 3, upper right column, p. 227-line 1, upper left column, p. 230 | — | — |
| Polymer latex | Line 2, upper left column, p. 240-last line, p. 239 | — | — |
| Matting agent | Line 1, upper left column, p. 240-last line, upper right column, p. 240 | — | — |
| Photographic processing method (processing step, additives, etc.) | Line 7, upper right column, p. 3-line 5, upper right column, p. 10 | Line 4, upper left column, p. 39-last line, upper left column, p. 42 | Line 14, p. 67-line 28, p. 69 |

Note
The contents cited in JP-A-62-215272 include the contents described in the written amendment of procedure dated March 16, 1987 attached thereto.
Among the above mentioned color couplers, as yellow couplers there may also be preferably used so-called short wave type yellow couplers as disclosed in JP-A-63-231451, JP-A-63-123047, JP-A-63-241547, JP-A-1-173499, JP-A-1-213648, and JP-A-1-250944.

The cyan, magenta or yellow coupler is preferably emulsion-dispersed in an aqueous solution of a hydrophilic colloid in the form of an impregnation in a loadable latex polymer (as described in U.S. Pat. No. 4,203,716) in the presence (or absence) of a high boiling organic solvent as tabulated above or in the form of a solution with a water-insoluble and organic solvent-soluble polymer.

Examples of the water-insoluble and organic solvent-soluble polymer which can be preferably used include single polymers or copolymers as described in U.S. Pat. No. 4,857,449, 7th column to 15th column, and WO88/00723, pp. 12–30. More preferably, methacrylate or acrylamide polymers, particularly acrylamide polymers may be used in the light of dye image stability.

The photographic light-sensitive material (i) of the present invention preferably comprises a dye image preservability-improving compound as described in EO0,277,589A2 in combination with these couplers, particularly pyrazoloazole coupler or pyrrolotriazole coupler.

In particular, a compound as described in the above cited patents which undergoes chemical bonding to an aromatic amine developing agent remaining after color development to produce a chemically inert and substantially colorless compound and/or another compound as described in the above cited patents which undergoes chemical bonding to an oxidation product of an aromatic amine color developing agent remaining after color development to produce a chemically inert and substantially colorless compound may be preferably used singly or in combination to inhibit the occurrence of stain or other side effects caused by the formation of developed dyes by the reaction of a color developing agent or its oxidation product remaining in the film with a coupler in the storage after processing.

As cyan couplers there may be preferably used 3-hydroxypyridine cyan couplers as disclosed in European Patent (EP) 0,333,185A2 (particularly those which have been rendered two-equivalent by incorporating a chlorine-separatable group in four-equivalent Coupler (42) exemplified as a specific example, Coupler (6), Coupler (9)), cyclic active methylene cyan couplers as disclosed in JP-A-64-32260 (particularly Coupler Examples 3, 8, 34 exemplified as specific examples), pyrrolopyrazole cyan couplers as disclosed in EO0,456,2-26A1, pyrroloimidazole cyan couplers as disclosed in EP0,484,909, or pyrrolotriazole cyan couplers as disclosed in EP0,488,248, and EP0,491,197A1 besides diphenylimidazole cyan couplers as disclosed in JP-A-2-33144. Particularly preferred among these cyan couplers are pyrrolotriazole cyan couplers.

As yellow couplers there may be preferably used besides the compounds as tabulated above acylacetamide yellow couplers having a 3- to 5-membered cyclic structure in the acyl group as disclosed in EP0,447,9-69A1, malondianilide yellow couplers as disclosed in EP0,482,552A1, or acylacetamide yellow couplers having a dioxane structure as disclosed in U.S. Pat. No. 5,118,599. Particularly preferred among these yellow couplers are acylacetamide yellow couplers having 1-alkylcyclopropane-1-carbonyl group as acyl group, and malondianilide yellow couplers in which one of the anilide group forms an indoline ring. These couplers may be used singly or in combination.

As the magenta coupler to be incorporated in the photographic light-sensitive material (i) of the present invention there can be used a 5-pyrazolone magenta coupler or pyrazoloazole magenta coupler as disclosed in known articles as tabulated above. Particularly preferred among these magenta couplers are pyrazolotriazole couplers having a secondary or tertiary alkyl group directly connected to the 2, 3 or 6-position of the pyrazolotriazole ring as disclosed in JP-A-61-65245, pyrazoloazole couplers Containing a sulfonamide group in the molecule as disclosed in JP-A-61-65246, pyrazoloazole couplers containing an alkoxyphenylsulfonamide ballast group as disclosed in JP-A-61-147254, and pyrazoloazole couplers containing an alkoxy group or aryloxy group in the 6-position as disclosed in EP226,849A and 294,785A in the light of color hue, image stability, color developability, etc.

As the processing method for the color photographic light-sensitive material of the present invention and processing material for use in the processing method there may be preferably used those disclosed in JP-A-2-207250, line 1, lower right column, page 26—line 9, upper right column, page 34, and JP-A-4-97355, line 17, upper left column, page 5—line 20, lower right column, page 18, other than those tabulated above.

The hydrophilic colloidal layer containing a white pigment in the photographic light-sensitive material (ii) of the present invention will be described hereinafter.

When the hydrophilic colloidal layer containing a white pigment is coated on the support, the density of the white pigment in the hydrophilic colloidal layer needs to be in the range of 20% by weight or more, preferably 40% by weight or more, most preferably 70% by weight or more. The upper limit of the density of the white pigment is not specifically defined but is preferably in the range of 99% by weight or less.

The coated amount of the white pigment can be arbitrarily predetermined such that it satisfies the aforementioned conditions but is preferably in the range of 1 $g/m^2$ or more, more preferably 2 $g/m^2$ or more, most preferably 6 $g/m^2$ or more in order to enhance the sharpness. The limit of the coated amount of the white pigment is not specifically defined but is preferably in the range of 40 $g/m^2$ or less.

The thickness of the white pigment-containing hydrophilic colloidal layer can be predetermined by the above specified content and coated amount but is preferably in the range of 0.5 $\mu m$ to 10 $\mu m$.

As the white pigment to be incorporated in the photographic light-sensitive material (ii) of the present invention there can be used one similar to that used in the photographic light-sensitive material (i) of the present invention.

The grain diameter of the white pigment grains to be incorporated in the hydrophilic colloidal layer may be in the range of 0.1 $\mu m$ to 1.0 $\mu m$, preferably 0.2 $\mu m$ to 0.3 $\mu m$ as calculated in terms of average grain size.

In the present invention, as the hydrophilic colloid (binder) constituting the hydrophilic colloidal layer containing a white pigment, the silver halide emulsion layer, the light-insensitive interlayer, etc. there may be preferably used a gelatin. If necessary, other hydrophilic colloids may be used in an arbitrary proportion instead of gelatin.

Examples of such hydrophilic colloids which can be used include the same hydrophilic colloids as described with reference to the photographic light-sensitive material (i).

In the photographic light-sensitive material (ii) of the present invention, the white pigment-containing hydrophilic colloidal layer may comprise various materials to be commonly incorporated in photographic light-sensitive materials as described with reference to the photographic light-sensitive material (i) besides the white pigment and binder.

The photographic light-sensitive material (ii) of the present invention comprises a support, at least one light-sensitive emulsion layer coated on the support, a light-insensitive layer such as color mixing inhibiting layer and protective layer, and a hydrophilic colloidal layer containing a white pigment.

In the photographic light-sensitive material (ii) of the present invention, the hydrophilic colloidal layer containing a white pigment is provided interposed between the support and the light-sensitive emulsion layer.

As the support carrying the hydrophilic colloidal layer containing a white pigment there can be used one similar to that used in the photographic light-sensitive material (i). From the standpoint of the expedition of the development of photographic light-sensitive material, the support is preferably waterproof. In other words, a waterproof resin-coated paper or a high molecular film is preferably used. Alternatively, a support having a surface with a diffused reflectivity of the second kind may be used as in the case of the photographic light-sensitive material (i).

The photographic light-sensitive material (ii) of the present invention may be in an embodiment in which the white pigment is incorporated only in the hydrophilic colloidal layer and is not incorporated in the resin constituting the support, e.g., resin to be coated on paper support, or resin film as the support itself or in another embodiment in which the white pigment is incorporated in the hydrophilic colloidal layer as well as the resin constituting the support.

On the white pigment-containing hydrophilic colloidal layer may be coated a light-sensitive emulsion layer directly or via one or more light-insensitive hydrophilic colloidal layers. If light-insensitive hydrophilic colloidal layers are provided, the total thickness of these layers is preferably in the range of 5 μm or less, more preferably 2 μm or less. These light-insensitive hydrophilic colloidal layers may optionally comprise various photographically useful materials as used in the photographic light-sensitive material (i). Further, a colloidal silver, a solid dispersion of dye or a cationic polymer dyed with a dye may be incorporated in these light-insensitive hydrophilic colloidal layers to form colored layers decolorable upon development as described with reference to the photographic light-sensitive material (i). Alternatively, a high boiling organic solvent dispersed in the form of fine oil drops. Such a high boiling organic solvent may comprise a photographically useful material such as oil-soluble color mixing inhibitor, fluorescent brightening agent and ultraviolet absorbent dissolved therein.

In addition to the use of such a white pigment, the disposition of a colored layer decolorable upon development in any position in the hydrophilic colloidal layer group coated on the light-sensitive layer side of the support provides an improvement in the sharpness of the photographic light-sensitive material (ii).

For the disposition of the colored layer decolorable upon processing in the photographic light-sensitive material (ii) of the present invention, reference can be made to the photographic light-sensitive material (i).

In respect to the optical reflection density of the colored layer, the optical density value at the wavelength in the visible light wavelength range of 400 nm to 700 nm at which the highest optical density is given is preferably in the range of 0.2 or more and 3.0 or less, more preferably 0.5 or more and 2.5 or less, particularly 0.8 or more and 2.0 or less. The formation of the colored layer can be accomplished by any conventional known methods. Examples of such known methods include a method which comprises dispersing a dye in the solid form, a method which comprises mordanting a cation polymer with an anionic dye, a method which comprises allowing a dye to be adsorbed on finely divided grains of silver halide or the like, and then fixing the dye in a layer, and a method which comprises the use of a colloidal silver. As the method which comprises dispersing finely divided dye grains in the solid form there may be used a method as described in JP-A-2-308244, pp. 4–13, which comprises the incorporation of a finely divided dye powder that is substantially insoluble in water at pH 6 or less but is substantially soluble in water at pH 8 or more. An example of the method which comprises mordanting a cationic polymer with an anionic dye is described in JP-A-2-84637, pp. 18–26. A method for preparing colloidal silver as a light absorbent is described in U.S. Pat. Nos. 2,688,601, and 3,459,563. Preferred among these methods are the method which comprises the incorporation of finely divided dye grains and the method which comprises the use of colloidal silver.

Another aspect of the photographic light-sensitive material (ii) of the present invention is that the photographic light-sensitive material is subjected to chemical sensitization with a gold compound as previously mentioned.

Preferred examples of such a gold sensitizer include compounds as disclosed in U.S. Pat. Nos. 2,399,083, 2,540,085, 2,540,086, and 2,597,856. Specific examples of such compounds include tetrachloroauric acid and salts thereof, potassium aurocyanate, potassium aurothiocyanate, and gold sulfide. Gold sensitization may be effected with the combined use of a thiocyanate to intensify its effect. As described in JP-B-59-11892, the combined use of a tetra-substituted thiourea compound is also useful.

The amount of such a gold sensitizer to be used can be selected from $1\times10^{-8}$ mol to $1\times10^{-5}$ mol per mol of silver such that enhance the sensitivity/fog ratio. With the combined use of a chemical sensitization inhibitor, only a small amount of a gold sensitizer can provide a high sensitivity with little fog. A relatively small amount of a gold sensitizer is preferably used depending on the desired sensitivity.

The conditions under which sensitization is effected with a gold compound (pH, pAg, temperature, time) is not specifically limited. For example, the pH value is preferably in the range of 3.0 to 8.5, particularly 5.0 to 7.5. The pAg value is preferably in the range of 4.5 or more, more preferably 6.5 or more, further preferably 7.0 or more. The temperature is preferably in the range of 40° C. to 85° C., particularly 45° C. to 75° C. The time is preferably in the range of 10 minutes to 200 minutes, particularly 30 minutes to 120 minutes.

Examples of sulfur sensitizers to be used in the photographic light-sensitive material of the present invention as defined in the clause (ii) include thiosulfates, sulfinates, thioureas, thiazoles, rhodanines, and other compounds as disclosed in U.S. Pat. Nos. 1,574,944, 2,410,689, 2,728,668, and 3,656,955. Further, sulfur-containing compounds as disclosed in U.S. Pat. Nos. 3,857,711, 2,466,018, and 4,054,457 may be used.

The optimum amount of the sulfur sensitizer to be used in combination the gold sensitizer can be selected depending on the conditions such as grain size, chemical sensitization temperature, pAg and pH. Specifically, it is in the range of $1\times10^{-7}$ mol to $1\times10^{-4}$ mol, preferably $5\times10^{-7}$ to $1\times10^{-4}$ mol, more preferably $5\times10^{-7}$ mol to $1\times10^{-5}$ mol per mol of silver.

The chemical sensitization of the photographic light-sensitive material (ii) of the present invention may be effected by the aforementioned chemical sensitization method in combination with a chemical sensitization with a chalcogen sensitizer other than sulfur sensitizer (e.g., selenium sensitization with a selenium compound, tellurium sensitization with a tellurium compound), a noble sensitization other than gold sensitization, a reduction sensitization or the like. As compounds to be used in the chemical sensitization method there may be preferably used those described in JP-A-62-215272, lower right column, page 18—upper right column, page 22.

In the chemical sensitization of the photographic light-sensitive material (ii) of the present invention, an emulsion comprising high silver chloride content grains having a localized phase whose silver bromide content is higher than the other portion is preferably subjected to gold sensitization, particularly sulfur sensitization and gold sensitization in combination, in the presence of a compound for controlling chemical sensitization.

The compounds represented by the general formulae (I) to (IX) will be further described hereinafter.

In these general formulae, the alkyl group, alkylene group, aryl group, arylene group, alkoxy group, aryloxy group, sulfamoyl group, thiazolyl group and other nitrogen-containing heterocyclic residues represented by $R^2$ to $R^9$, and $R^{11}$ to $R^{19}$ may be further substituted.

Specific examples of these groups and halogen atoms will be given below, but the present invention should not be construed as being limited thereto. Halogen atom (e.g., fluorine, chlorine, bromine ), alkyl group (e.g., methyl, ethyl, n-propyl, isopropyl, n-butyl, t-butyl, n-octyl, dodecyl, cyclopentyl, cyclohexyl, benzyl, phenethyl), aryl group (e.g., phenyl, naphthyl, 4-methylphenyl), nitrogen-containing heterocyclic residue (e.g., pyridyl, imidazolyl, piperidyl, morpholino), alkoxy group (e.g., methoxy, ethoxy, butoxy), aryloxy group (e.g., phenoxy, 2-naphthyloxy), sulfamoyl group (e.g., unsubstituted sulfamoyl, N,N-dimethylsulfamoyl, N-phenylsulfamoyl), alkylene group (e.g., methylene, ethylene, —$(CH_2)_6$—, —$(CH_2)_8$—), arylene group (e.g., phenylene)

The number of the repeating unit represented by the general formula (IV) is preferably 4 to 100 and more preferably 10 to 30.

Preferred among the compounds represented by the general formulae (I) to (IX) are those represented by the general formulae (II), (VII), (VIII) and (IX). Further preferred among these compounds are those represented by the general formulae (VII), (VIII), and (IX).

Specific examples of the compounds represented by the general formulae (I) to (IX) to be used in the present invention will be given below, but the present invention should not be construed as being limited thereto.

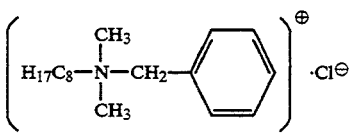
(A-1)

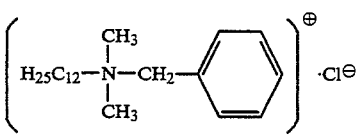
(A-2)

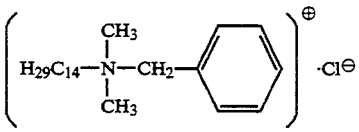
(A-3)

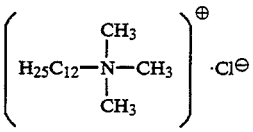
(A-4)

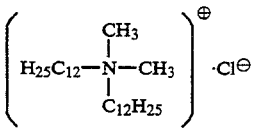
(A-5)

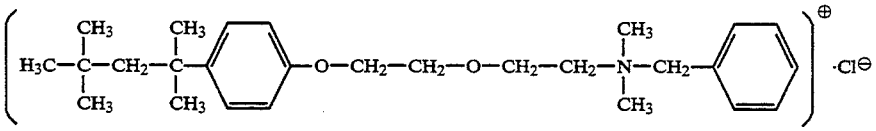
(A-6)

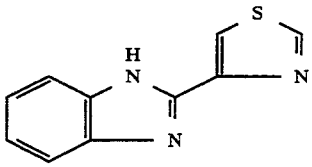
(A-7)

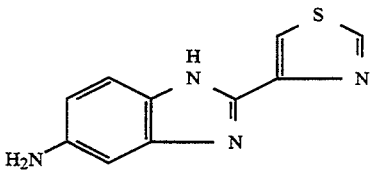
(A-8)

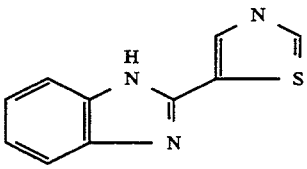
(A-9)

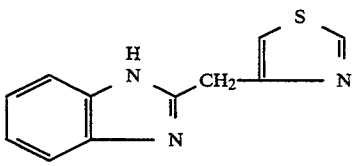
(A-10)

-continued
(A-11)
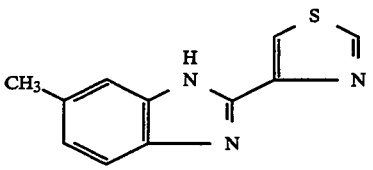
(A-12)
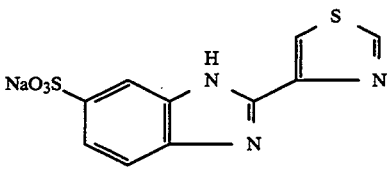
(A-13)
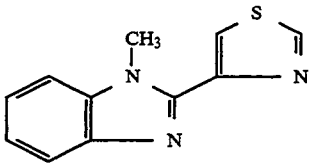
(A-14)
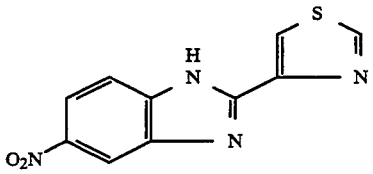
(A-15)
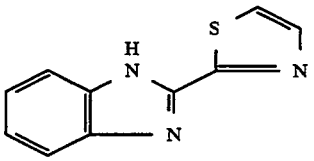
(A-16)
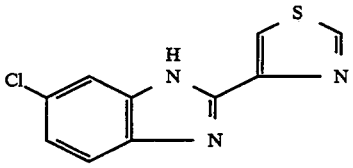
(A-17)
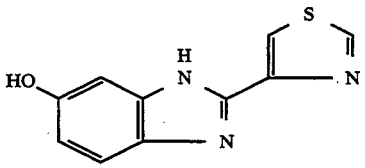
(A-18)
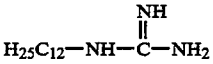
(A-19)
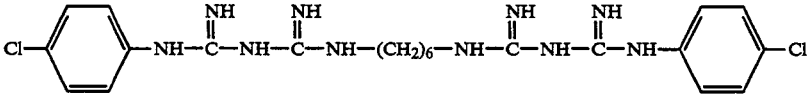
(A-20)
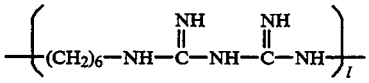
(l = 12)
(A-21)
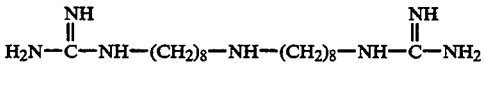
(A-22)
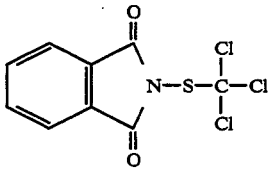
(A-23)
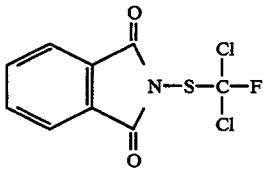
(A-24)
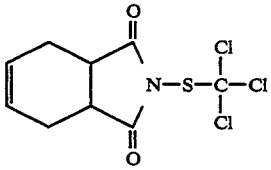
(A-25)
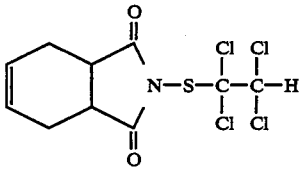
(A-26)
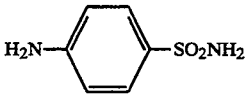
(A-27)
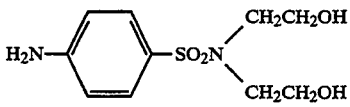
(A-28)
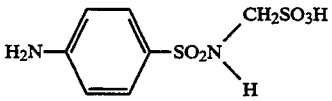
(A-29)
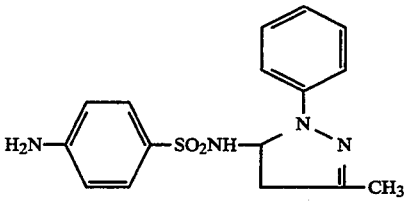

-continued

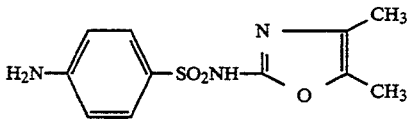
(A-30)

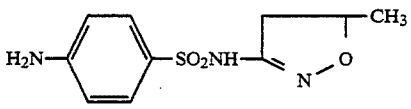
(A-31)

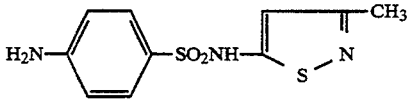
(A-32)

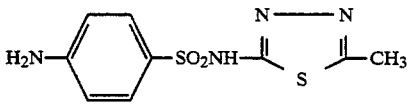
(A-33)

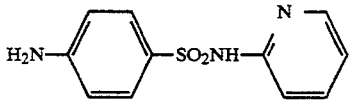
(A-34)

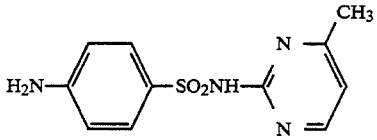
(A-35)

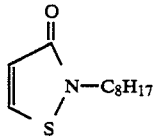
(A-36)

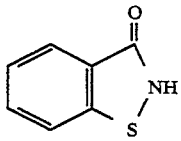
(A-37)

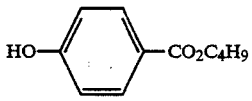
(A-38)

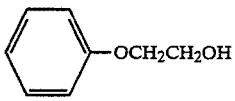
(A-39)

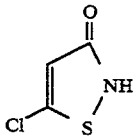
(A-40)

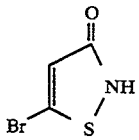
(A-41)

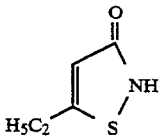
(A-42)

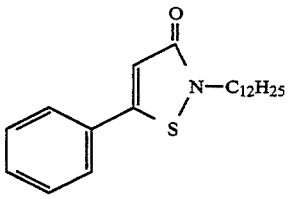
(A-43)

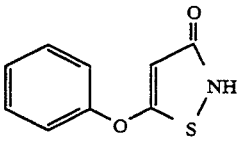
(A-44)

In the present invention, the compounds represented by the general formulae (I) to (IX) may be incorporated in any layer such as silver halide emulsion layer and gelatin interlayer.

The amount of the compound represented by the general formulae (I) to (IX) to be incorporated is preferably in the range of $5\times10^{-7}$ to $2\times10^{-3}$ mol/m$^2$, more preferably $5\times10^{-6}$ to $5\times10^{-4}$ mol/m$^2$. These compounds are preferably incorporated in the photographic light-sensitive material (ii) of the present invention in the form of solution in an organic solvent such as methanol, ethanol, ethylene glycol, diethylene glycol, triethylene glycol, benzyl alcohol, ethanolamine, diethanolamine and triethanolamine or in the form of emulsion (emulsified product).

Particularly preferred among the aforementioned aminoglycocides to be used in the present invention are gentamicines. Specific examples of typical gentamicines will be given below.

Compound No.

1 (Gentamicine $A_2$)
2 (Gentamicine A)
3 (Gentamicine $A_1$)
4 (Gentamicine B)
5 (Gentamicine $X_2$)
6 (Antibiotic JI-20A)
7 (Gentamicine $B_1$)
8 (Antibiotic G418)
9 (Antibiotic JI-20B)
10 (Gentamicine $C_1$)
11 (Gentamicine $C_{1a}$)
12 (Gentamicine $C_2$)
13 (Gentamicine $C_{2a}$)
14 (Gentamicine $C_{2b}$)

As the aminoglycocides to be used in the present invention there may be used ones commercially available. For the properties of these aminoglycocides, reference can be made to "THE MERCK INDEX AN ENCYCLOPEDIA OF CHEMICALS, DRUGS, AND BIOLOGICALS", 11th ed., 1989, MERCK & CO. INC.

For the preparation method for these aminoglycocides, reference can be made to U.S. Pat. Nos. 3,091,572, and 3,136,704 with respect to gentamicins, U.S. Pat. No. 3,781,268 with respect to amikacins, U.S. Pat. No. 4,107,424, and German Patent 2,350,169 with respect to arbekacins, German Patent 2,135,191 with respect to dibekacins, U.S. Pat. No. 4,002,742 with respect to icepamicins, U.S. Pat. No. 4,045,298, and German Patent 2,326,781 with respect to micronomicins, U.S. Pat. Nos. 4,002,742, and 4,029,882, and German Patent 2,437,160 with respect to netilmicins, and U.S. Pat. No. 3,832,286 with respect to sisomicins.

The aminoglycocides to be incorporated in the photographic light-sensitive material (ii) of the present invention may be incorporated in at least one of, preferably all of silver halide emulsion layers to be coated on the support and previously exemplified auxiliary layers.

These aminoglycocides may be preferably added to a coating solution containing a hydrophilic colloid in the form of aqueous solution, The amount of these aminoglycocides to be used is preferably in the range of about 0.01 to 20 mg/m$^2$, more preferably 0.1 to 5 mg/m$^2$.

The color photographic light-sensitive material (ii) of the present invention can comprise a light-sensitive emulsion layer having at least one yellow-developable silver halide emulsion layer, at least one magenta-developable silver halide emulsion layer and at least one cyan-developable silver halide emulsion layer coated on a support. In the configuration of general color photographic papers, a color coupler which forms a dye having a color complementary to that of the light to which the silver halide emulsion is sensitive can be incorporated in the system to provide subtractive color reproduction. In the configuration of general color photographic papers, the silver halide emulsion grains are spectrally sensitized with blue-sensitive, green-sensitive and red-sensitive spectral sensitizing dyes in the order according to that of the aforementioned color-developable layers, and then coated on a support in this order. However, the order of arrangement may be different from the aforementioned order. In particular, from the standpoint of rapid processing, a light-sensitive layer containing silver halide grains having the greatest average grain size may be preferably provided as an uppermost layer. Alternatively, the lowermost layer may be preferably an infrared-sensitive silver halide emulsion layer from the standpoint of preservability under irradiation.

In a further alternative embodiment, the light-sensitive layers and the color hue of developed dyes may have correlations other than above specified. Further, at least one infrared-sensitive silver halide emulsion layer may be incorporated in the photographic light-sensitive material (ii) of the present invention.

The silver halide grains to be incorporated in at least one of (preferably all of) the silver halide emulsion layers in the photographic light-sensitive material (ii) of the present invention may comprise silver bromochloride having a silver chloride content of 90 mol % or more or silver chloride. The silver chloride content of the silver halide grains is preferably in the range of 95 mol % or more, more preferably 98 mol % or more.

In order to expedite the development processing time, the photographic light-sensitive material (ii) of the present invention is preferably free of silver iodide. The term "substantially free of silver iodide" as used herein indicates a silver iodide content of 1 mol % or less, preferably 0.2 mol % or less. On the other hand, for the purpose of enhancing the high intensity sensitivity, the spectrally sensitized sensitivity or the storage stability of the photographic light-sensitive material, high silver chloride content grains containing 0.01 to 3 mol % of silver iodide on the surface thereof as disclosed in JP-A-3-84545 may be preferably used.

The halogen composition of emulsion may be the same or different from grain to grain. The use of an emulsion having the same halogen composition among grains advantageously provides easy uniformalization of the properties of grains.

The halogen composition distribution in the silver halide emulsion grain can be properly selected from the group consisting of so-called uniform type structure in which the halogen composition is the same anywhere, so-called laminated structure in which the halogen composition differs from the core to the shell (monolayer or multi-layers), and structure in which nonlayer portions having different halogen compositions are localized inside or on the surface of grains (portions having different halogen compositions are connected to the edge, corner or surface of the grains).

In order to obtain a high sensitivity, the latter two structures are preferred to the uniform structure from the standpoint of pressure resistance. If the silver halide grains have such a structure, the border of the portions having different compositions may be a definite one or an indefinite one where a mixed crystal is formed by the difference in the halogen composition or a positively continuous structural change.

The high silver chloride content emulsion to be incorporated in the photographic light-sensitive material (ii) of the present invention preferably comprises silver bromide phase localized inside and/or on silver halide grains in a layer or non-layer form as mentioned above. The halogen composition of the aforementioned localized phase preferably has a silver bromide content of at least 10 mol %, more preferably 20 mol % to 100 mol %.

The silver bromide content of the silver bromide localized phase can be analyzed by X-ray diffractometry (as described in "Shinjikken Kagaku Koza 6; Kozo Kaiseki", Nihon Kagakukai, Maruzen).

These localized phases may be preferably present inside the grains, on the edge or corner of the surface of the grains, or on the surface of the grains. A preferred example is a localized phase epitaxially grown on the corner of grains.

It is also effective to further enhance the silver chloride content of the silver halide emulsion for the purpose of reducing the replenishment rate of the developer. In this case, a substantially pure silver chloride emulsion having a silver chloride content of 98 mol % to 100 mol % may be preferably used.

The average grain size (number-average value of grain sizes as calculated in terms of diameter of circle having the same area as that of projected area of grains) of silver halide grains contained in the silver halide emulsion to be used in the present invention is preferably in the range of 0.1 μm to 2 μm.

The grain size distribution is preferably so-called monodisperse, as represented by a fluctuation coefficient (obtained by dividing the standard deviation of grain size distribution by the average grain size) as small as 20% or less, preferably 15% or less and more preferably 10% or less. For the purpose of obtaining a great latitude, several kinds of the aforementioned monodisperse emulsions may be preferably blended for one layer or may be preferably coated in multiple layers.

The silver halide grains to be contained in the photographic emulsion may have a regular crystal form such as cube, octahedron and tetradecahedron, an irregular crystal form such as sphere and tablet or composite thereof. The silver halide grains also may comprise a mixture of grains having various crystal forms. In the present invention, grains having the aforementioned regular crystal forms are contained in a weight proportion of 50% or more, preferably 70% or more, more preferably 90% or more.

Besides these emulsions, an emulsion comprising tabular grains having an average aspect ratio (diameter in terms of circle/thickness) of 5 or more, preferably 8 or more, in a proportion of 50% by weight or more of the total grains as calculated in terms of projected area may be preferably used.

The preparation of emulsion to be used in the present invention can be accomplished by any suitable method as disclosed in P. Glafkides, "Chimie et Physique Photographique", Paul Montel, 1967, G. F. Duffin, "Photographic Emulsion Chemistry", The Focal Press, 1966, and V. L. Zelikman et al., "Making and Coating Photographic Emulsion", The Focal Press, 1964. In some detail, the emulsion can be prepared by any of the acid process, the neutral process, the ammonia process, etc. The reaction between a soluble silver salt and a soluble halogen salt can be carried out by any of a single jet process, a double jet process, a combination thereof, and the like. A method in which grains are formed in the presence of excess silver ions (so-called reverse mixing method) may be used. Further, a so-called controlled double jet process, in which a pAg value of a liquid phase in which silver halide grains are formed is maintained constant, may also be used. According to the controlled double jet process, a silver halide emulsion having a regular crystal form and an almost uniform grain size can be obtained.

The localized phase or substrate of the silver halide grains to be incorporated in the photographic light-sensitive material (ii) of the present invention may preferably comprise diverse metal ions or complex ions thereof. Preferred metal ions can be selected from the group consisting of ions of metals belonging to the groups VIII and IIb in the periodic table or complexes thereof, lead ions and thallium ions. The localized phase can mainly comprise metal ions selected from the group consisting of iridium, rhodium and ferric or ferrous ions or complex ions thereof. The substrate can mainly comprise metal ions selected from the group consisting of osmium, iridium, rhodium, platinum, ruthenium, palladium, cobalt, nickel and ferric or ferrous ions or complex ions in combination. The kind and concentration of metal ions in the localized phase may be different from those of the substrate. A plurality of kinds of metals can be used. In particular, iron and iridium compounds are preferably incorporated in the silver bromide localized phase.

These metal ion-supplying compounds may be incorporated in the localized phase and/or other portion (substrate) of the silver halide grains of the present invention by adding these metal ion-supplying compounds in the form of dispersion in aqueous solution of gelatin, aqueous solution of halide, aqueous solution of silver salt or other aqueous solutions to the system, or by adding these metal ion-supplying compounds to the system in the form of solution of finely divided silver halide grains containing metal ions, during the formation of silver halide grains.

The incorporation of metal ions to be used in the photographic light-sensitive material (ii) of the present invention in the emulsion grains can be effected at any time before, during or shortly after the formation of grains depending ion the position of metal ions in the grain in which these metal ions are to be incorporated.

The silver halide emulsion to be incorporated in the photographic light-sensitive material (ii) of the present invention may comprise various compounds or precursors thereof for the purpose of inhibiting fog during the preparation, storage or photographic processing of the photographic light-sensitive material. Specific examples of such compounds which can be preferably used in the present invention include those described in the above cited JP-A-62-215272, pp. 39–72. Further, 5-arylamino-1,2,3,4-thiatriazole compounds (the aryl residue contains at least one electron-withdrawing group) as disclosed in EP0447647 may be preferably used.

Spectral sensitization is effected for the purpose of providing the emulsion in the various layers in the photographic light-sensitive material (ii) of the present invention with the spectral sensitivity to the respective desired wavelength range.

As spectral sensitizing dyes to be used in the spectral sensitization to blue, green and red light ranges in the photographic light-sensitive material (ii) of the present invention there may be used those described in F. M. Harmer, "Heterocyclic compounds—Cyanine dyes and related compounds", John Wiley & Sons, New York, London, 1964. Specific preferred examples of such a compound and spectral sensitization method which can be preferably used include those described in the above cited JP-A-62-215272, upper right column, page 22 to page 38. As the red-sensitive spectral sensitizing dye for silver halide emulsion grains having a high silver chloride content, spectral sensitizing dyes as disclosed in JP-A-3-123340 are particularly preferred from the standpoint of stability, adsorption, dependence on temperature upon exposure, etc.

If the photographic light-sensitive material of the present invention as defined in the clause (ii) is spectrally sensitized in the infrared range at a high efficiency, a sensitizing dye as disclosed in JP-A-3-15049, upper left column, page 12—lower left column, page 21, and JP-A-3-20730, lower left column, page 4—lower left column, page 15, EP0,420,011, line 21, page 4— line 54, page 6, EP0,420,012, line 12, page 4—line 33, page 10, EP0,443,466, and U.S. Pat. No. 4,975,362 can be preferably used.

When such a spectral sensitizing dye is incorporated in the silver halide emulsion, it may be directly dispersed in the emulsion or may be added to the emulsion in the form of solution in water, methanol, ethanol, propanol, methyl cellosolve, 2,2,3,3-tetrafluoropropanol or the like, singly or in admixture. Alternatively, such a spectral sensitizing dye may be added to the emulsion in the form of aqueous solution with an acid or base present therein as disclosed in JP-B-44-23389, JP-B-44-27555, and JP-B-57-22089 or in the form of aqueous solution or colloidal dispersion with a surface active agent present therein as disclosed in U.S. Pat. Nos. 3,822,135, and 4,006,025. Further, such a spectral sensitizing dye may be dissolved in a solvent substantially non-miscible with water such as phenoxyethanol, dispersed in water or a hydrophilic colloid, and then added to the emulsion. As described in JP-A-53-102733, and JP-A-58-105141, such a spectral sensitizing dye may be added to the emulsion in the form of dispersion in a hydrophilic colloid.

The time at which such a spectral sensitizing dye is added to the emulsion may be any stage which has heretofore been known effective. In particular, it may be added to the emulsion before or during the formation of silver halide emulsion grains, between shortly after the formation of grains and before the rinse, before or during the chemical sensitization, between shortly after the chemical sensitization and solidification by cooling of the emulsion, or during the preparation of coating solution.

In general, it may be conducted between the completion of the chemical sensitization and before the coating. As described in U.S. Pat. Nos. 3,628,969, and 4,225,666, such a spectral sensitizing dye may be added to the emulsion at the same time with a chemical sensitizer so that spectral sensitization and chemical sensitization are simultaneously effected. As described in JP-A-58-113928, it may be conducted prior to the chemical sensitization. Further, such a spectral sensitizing dye may be added to the emulsion before the completion of precipitation of silver halide grains to initiate spectral sensitization. Moreover, as taught in U.S. Pat. No. 4,225,666, such a spectral sensitizing dye may be batch-wise added to the system. In other words, a part of the spectral sensitizing dye may be added to the system prior to chemical sensitization, and the residual part of the spectral sensitizing dye may be added to the system after chemical sensitization. In accordance with a further method taught in U.S. Pat. No. 4,183,756, such a spectral sensitizing dye may be added to the system at any stage during the formation of silver halide grains.

Particularly preferred among these stages in which the spectral sensitizing dye can be added to the system is before rinse or chemical sensitization.

The amount of such a spectral sensitizing dye to be added depends much on the circumstances. It is preferably in the range of $0.5\times10^{-6}$ mol to $1.0\times10^{-2}$ mol, more preferably $1.0\times10^{-6}$ mol to $5.0\times10^{-3}$ mol per mol of silver halide.

In the photographic light-sensitive material (ii) of the present invention, when a sensitizing dye having a spectrally sensitized sensitivity, particularly in the range of from red region to infrared region is used, it is preferred that a compound as described in JP-A-2-157749, lower right column, page 13—lower right column, page 22 is used together. The use of such a compound provides a specific enhancement of the preservability and processing stability of the photographic light-sensitive material and the effect of supersensitizing the photographic light-sensitive material. In particular, Compounds (IV), (V) and (VI) described in the above cited patent are preferably used together therewith. The amount of such a compound to be incorporated is in the range of $0.5\times10^{-5}$ mol to $5.0\times10^{-2}$ mol, preferably $5.0\times10^{-5}$ mol to $5.0\times10^{-3}$ mol per mol of silver halide. Its advantageous range is in the range of 0.1 to 10,000 times, preferably 0.5 to 5,000 times the molar quantity of sensitizing dye.

The photographic light-sensitive material (ii) of the present invention may be exposed to visible light or infrared light. Exposure may be carried out by a low intensity exposure process or a high intensity exposure process. In a preferred embodiment of the latter case, laser scanning exposure process with an exposure time of $10^{-4}$ seconds or less, preferably $10^{-6}$ or less per pixel may be preferably used.

A band stop filter as disclosed in U.S. Pat. No. 4,880,726 may be preferably used for exposure. This removes light stain, providing a remarkable enhancement of color reproducibility.

The photographic light-sensitive material (ii) which has been exposed to light may be subjected to a commonly used color development, preferably followed by blix for the purpose of expediting the processing. In particular, if the aforementioned emulsion having a high silver chloride content is used, the pH value of the blix solution is preferably in the range of about 6.5 or less, more preferably about 6 or less for the purpose of accelerating the desilvering procedure.

As silver halide emulsions and other materials (additives) to be incorporated in the light-sensitive material (ii) of the present invention, photographic constituent layers of the light-sensitive material (ii) of the present invention (layer configuration), and processing methods and processing additives to be used in the processing of the light-sensitive material (ii) of the present invention there can be preferably used those described in JP-A-62-215272, and JP-A-2-33144, and EP0,355,660A2 corresponding to JP-A-2-139544 as in the photographic light-sensitive material (i).

The dispersion method of cyan, magenta and yellow couplers is the same as used in the case of the photographic light-sensitive material (i).

Water-insoluble and organic solvent-soluble polymers, dye stability-improving compounds to be used in combination with couplers, compounds which undergo chemical bonding to an aromatic amine developing agent remaining after color development to produce a chemically inert and substantially colorless compound and/or another compounds which undergo chemical bonding to an oxidation product of an aromatic amine color developing agent remaining after color development to produce a chemically inert and substantially colorless compound are also used in the photographic light-sensitive material (ii) of the present invention, in the same way as in the case of the photographic light-sensitive material (i) of the present invention.

As the cyan, yellow and magenta couplers to be incorporated in the photographic light-sensitive material (ii) of the present invention there can be used the same couplers as used in the photographic light-sensitive material (i) of the present invention.

As the processing method for the color photographic light-sensitive material (ii) of the present invention there preferably be used besides those tabulated above processing materials and processing methods as described in JP-A-2-207250, line 1, lower right column, page 26—line 9, upper right column, page 34, and JP-A-4-97355, line 17, upper left column, page 5—line 20, lower right column, page 18.

In the photographic light-sensitive material (iii) of the present invention, a hydrophilic colloidal layer containing a white pigment is provided on a support, the appropriate coated amount of the white pigment being in the range of 0.5 $g/m^2$ or more, preferably 2 $g/m^2$ or more, more preferably 4 $g/m^2$ or more, and most preferably 8 $g/m^2$ or more. The upper limit of the coated amount of the white pigment is not specifically defined but is preferably 40 $g/m^2$ or less.

The "coated amount of white pigment" as specified herein indicates the value including an amount of various surface treatments or dispersion stabilizers which are optionally incorporated in the white pigment for the purpose of improving its dispersibility or like purposes.

The density of the white pigment in the hydrophilic colloidal layer is preferably in the range of 40% by weight or more, most preferably 70% by weight or more. The upper limit of the density of the white pigment is not specifically defined but is preferably in the range of 99% by weight or less.

The thickness of the white pigment-containing hydrophilic colloidal layer can be predetermined by the above specified content and coated amount but is preferably in the range of 0.5 μm to 10 μm, more preferably 2 μm to 5 μm.

For the kind and grain diameter of white pigments to be incorporated in the photographic light-sensitive material (iii) of the present invention, reference can be made to the case of the photographic light-sensitive material (i).

In the photographic light-sensitive material (iii) of the present invention, as the binder (hydrophilic colloid) constituting the hydrophilic colloidal layer containing a white pigment, there may preferably be used a gelatin. If necessary, other hydrophilic colloids may be used in an arbitrary proportion instead of gelatin.

Examples of such a hydrophilic colloid include those described with reference to the photographic light-sensitive material (i).

In the photographic light-sensitive material (iii) of the present invention, the white pigment-containing hydrophilic colloidal layer may contain various materials to be commonly incorporated in photographic light-sensitive materials as described with reference to the photographic light-sensitive material (i) besides the white pigment and binder.

The photographic light-sensitive material (iii) of the present invention comprises a support, at least one light-sensitive emulsion layer coated on the support, a light-insensitive layer such as color mixing inhibiting layer and protective layer, and a hydrophilic colloidal layer containing a white pigment.

In the photographic light-sensitive material (iii) of the present invention, the hydrophilic colloidal layer containing a white pigment is provided interposed between the support and the light-sensitive emulsion layer.

As the support carrying the hydrophilic colloidal layer containing a white pigment there can be used one being the same as that used in the photographic light-sensitive material (i). From the standpoint of the expedition of the development of photographic light-sensitive material, the support is preferably waterproof. In other words, a waterproof resin-coated paper or a high molecular film is preferably used. Alternatively, a support having a surface with a diffused reflectivity of the second kind may be used as in the case of the photographic light-sensitive material (i).

The photographic light-sensitive material (iii) of the present invention may be in an embodiment in which the white pigment is incorporated only in the hydrophilic colloidal layer and is not incorporated in the resin constituting the support, e.g., resin to be coated on paper support, or resin film as the support itself or in another embodiment in which the white pigment is incorporated in the hydrophilic colloidal layer as well as the resin constituting the support.

On the white pigment-containing hydrophilic colloidal layer may be coated a light-sensitive emulsion layer directly or via one or more light-insensitive hydrophilic colloidal layers. If light-insensitive hydrophilic colloidal layers are provided, the total thickness of these layers is preferably in the range of 5 μm or less, more preferably 2 μm or less. These light-insensitive hydrophilic colloidal layers may optionally contain various photographically useful materials as used in the photographic light-sensitive material (i) of the present invention. For instance, a surfactant as a coating aid, hardening agent, dye, fogging inhibitor, etc. may be contained. Further, a colloidal silver, a solid dispersion of dye or a cationic polymer dyed with a dye may be incorporated in these light-insensitive hydrophilic colloidal layers to form colored layers decolorable upon development as described with reference to the photographic light-sensitive material (i) of the present invention. Alternatively, a high boiling organic solvent dispersed in the form of fine oil drops. Such a high boiling organic solvent may contain a photographically useful material such as oil-soluble color mixing inhibitor, fluorescent brightening agent and ultraviolet absorbent dissolved therein.

For the disposition of the colored layer decolorable upon processing of the photographic light-sensitive material (iii) of the present invention, reference can be made to the photographic light-sensitive material (i) of the present invention.

For the optical reflective density of the colored layer and the method for the formation of the colored layer, reference can be made to those for the photographic light-sensitive material (i) of the present invention as is disclosed above. As the method which comprises dispersing finely divided dye grains in the solid form there may be used a method as described in JP-A-2-308244, pp. 4–13, which comprises the incorporation of a finely divided dye powder that is substantially insoluble in water at pH 6 or less but is substantially soluble in water at pH 8 or more. An example of the method which comprises mordanting a cationic polymer with an anionic dye is described in JP-A-2-84637, pp. 18–26. A method for preparing colloidal silver as a light absorbent is described in U.S. Pat. Nos. 2,688,601, and 3,459,563. Preferred among these methods are the method which comprises the incorporation of finely divided dye grains and the method which comprises the use of colloidal silver.

The film pH value of the silver halide color photographic light-sensitive material (iii) of the present invention is the pH value of all photographic constituent layers obtained by coating the coating solution on a support and therefore doesn't necessarily coincide with the pH value of the coating solution.

The film pH value of the photographic light-sensitive material of the present invention can be determined by the method as described in JP-A-61-245153. Specifically, the measurement process comprises the following procedures: (1) 0.05 cc of pure water is added dropwise to the surface of the photographic light-sensitive material on the silver halide emulsion side; and (2) After 3 minutes, the film pH value of the material is measured by means of a film pH measuring electrode (GS-165F available from Toa Denpa K.K.). In the present invention, the film pH value of the material as determined by this method is in the range of 5.0 to 6.5.

The film pH value of the material can be optionally adjusted with an acid (e.g., sulfuric acid, citric acid) or an alkali (e.g., sodium hydroxide, potassium hydroxide).

If the film pH value of the material falls below 5.0, it causes a disadvantage that the film hardening is prohibited or the sensitivity is lowered. On the contrary, if the film pH value of the material exceeds 6.5, it disadvantageously leads to desensitization upon exposure under high humidity conditions or sensitivity fluctuation with the change of the time interval between the completion of exposure and the beginning of processing.

The film pAg value of the silver halide color photographic light-sensitive material of the present invention is the pAg value of all photographic constituent layers obtained by coating the coating solution on a support and therefore doesn't necessarily coincide with the pAg value of the coating solution.

The film pAg value of the photographic light-sensitive material of the present invention can be determined by the following method. Specifically, the measurement process comprises the following procedures: (1) 20 ul of pure water is added dropwise to the surface of the photographic light-sensitive material on the silver halide emulsion side; and (2) After 1 minute, the film pAg value of the material is measured by means of a film pAg measuring electrode (GS-165F available from Toa Denpa K.K.).

In order to convert the potential thus obtained to pAg, a calibration curve obtained from the measured potential of the following solution can be used:

| Solution No. | pAg | Preparation method |
|---|---|---|
| 1 | 2 | 0.17 g of $AgNO_3$ is dissolved in water to make 100 ml; |
| 2 | 3 | Water is added to 5 ml of Solution 1 to make 50 ml; |
| 3 | 4 | Water is added to 5 ml of Solution 2 to make 50 ml; |
| 4 | 5 | Water is added to 5 ml of Solution 3 to make 50 ml; |
| 5 | — | 2.38 g of KBr is dissolved in water to make 100 ml; |
| 6 | — | Water is added to 5 ml of Solution 5 to make 50 ml; |
| 7 | — | Water is added to 5 ml of Solution 6 to make 50 ml; |
| 8 | 11.67 | 5 ml of Solution 4 and 5 ml of Solution 5 are mixed; |
| 9 | 10.67 | 5 ml of Solution 4 and 5 ml of Solution 6 are mixed; |
| 10 | 9.67 | 5 ml of Solution 4 and 5 ml of Solution 7 are mixed |

In the present invention, the film pAg value thus determined is in the range of 6.0 to 10.0, preferably 7.0 to 9.0, more preferably 7.2 to 8.7.

The film pAg value of the material can be optionally adjusted with a water-soluble halide (e.g., sodium chloride, potassium bromide) or a water-soluble silver salt (e.g., silver nitrate).

If the film pAg value of the material exceeds 10.0, it causes a disadvantage that the sensitivity is reduced. On the contrary, if the film pAg value of the material falls below 6.0, it disadvantageously leads to desensitization upon exposure under high humidity conditions or sensitivity fluctuation with the change of the time interval the completion of exposure and the beginning of processing.

The silver halide emulsion grains to be incorporated in the photographic light-sensitive material (iii) of the present invention comprise silver bromochloride or silver chloride having a silver chloride content of 95 mol % or more substantially free of silver iodide. Further, the silver bromochloride emulsion grains may be preferably formed by adding a bromide ion-releasing compound and/or bromine-releasing compound to the system in the total amount of 0.0005 mol to 0.05 mol per mol of the finally formed silver halide at any time of the grain formation when any portion of the grain corresponding to 20% by volume or less of the whole grain is formed and/or at any time between the completion of the formation of grains and the coating on the support to reduce the humidity dependence upon exposure and further enhance the latent image stability.

When a water-soluble bromide is added to silver chloride or silver bromochloride grains, silver bromide having a small solubility product is deposited on the grains to cause a so-called halogen conversion reaction. Accordingly, the silver bromide content of the grains is determined by the total amount of the water-soluble bromide thus added and the original silver bromide contained in the grains.

In the photographic light-sensitive material (iii) of the present invention, the eventually formed emulsion grains need to have a silver chloride content of 95 mol % or more, and the added amount of the water-soluble bromide is preferably in the range of 0.0005 mol to 0.05 mol per mol of silver halide. The halogen composition of the emulsion grains to which the water-soluble bromide has not yet been added may be either pure silver chloride or silver bromochloride. The halogen composition may be predetermined such that the total silver bromide content is not more than 5 mol % even after water-soluble bromide is added.

If the silver bromide content of the silver halide grains exceeds 5 mol %, it prevents the photographic light-sensitive material from being rapidly processed.

The process for the preparation of the silver halide emulsion to be used in the photographic light-sensitive material (iii) of the present invention comprises the steps of forming silver halide grains by the reaction of a water-soluble silver salt with a water-soluble halide, physically ripening the silver halide grains, removing the resulting water-soluble salts (desilvering and rinsing), and then chemically sensitizing the emulsion. If the emulsion of the present invention is subjected to spectral sensitization, a spectral sensitizing dye may be added to the system at any steps in the aforementioned procedures.

The silver halide emulsion thus obtained is then mixed with coupler dispersions as dye-forming elements, stabilizers, coating aids such as surface active agent and viscosity modifier, gelatin, etc. to prepare a coating solution.

If a bromide ion-releasing compound and/or bromine-releasing compound is added to the system during the formation of grains, it may be preferably conducted for a period during which any 20% by volume or less of the grains is formed. The period during which these compounds are added to the system may be momentary. The bromide ion-releasing compound and/or bromine-releasing compound may be continuously or discontinuosly added to the system. If these compounds are discontinuously added to the system, the sum of the periods during which they are added to the system should be not more than the period during which any 20% by volume or less of the grains is formed. If these compounds are added to the system for more than the period during which any 20% by volume or less of the grains is formed, the aforementioned effects can hardly be attained. These compounds are preferably added to the system for the period during which any portion of 10% by volume or less, more preferably 5% by volume or lessor the grains is formed. The time at which these compounds are added to the system is preferably after the formation of 50% by volume or more, more preferably 80% by volume or more of the whole silver halide grains has completed.

In the photographic light-sensitive material (iii) of the present invention, the time at which the bromide ion-releasing compound and/or bromine-releasing compound are added to the system is preferably between the completion of the formation of grains and the beginning of preparation of the coating solution, more preferably between the beginning of the chemical sensitization and the beginning of preparation of the coating solution.

The addition of such a bromide ion-releasing compound and/or bromine-releasing compound provides an effective inhibition of desensitization caused upon exposure under high humidity conditions with a hydrophilic colloidal layer containing a white pigment as disclosed herein. If the added amount of these compounds is too great, it disadvantageously causes desensitization under pressure.

The amount of the bromide ion-releasing compound and/or bromine-releasing compound to be incorporated in the photographic light-sensitive material (iii) of the present invention is preferably in the range of 0.0005 mol to 0.05 mol, more preferably 0,001 mol to 0.02 mol per mol of silver halide. If the addition of these compounds is batch-wise conducted, the sum of the added amounts of these compounds only needs to be within the above specified range.

As the bromide ion-releasing compound and/or bromine-releasing compound there may be preferably used a water-soluble bromide in the form of alkaline metal salt (e.g., Na, K, Li salts) or ammonium salt thereof. Further, finely divided silver bromide grains having a smaller grain diameter than host grains or finely divided silver bromochloride grains having a high silver bromide content may be preferably used. Moreover, compounds as described in JP-A-1-285942 may be preferably used. The grain diameter of the finely divided silver bromide grains or finely divided silver bromochloride grains is required to be smaller than that of host grains and may be preferably in the range of about 0.05 μm or less.

The color photographic light-sensitive material of the present invention as defined in the clause (iii) can comprise a light-sensitive emulsion layer having at least one yellow-developable silver halide emulsion layer, at least one magenta-developable silver halide emulsion layer and at least one cyan-developable silver halide emulsion layer coated on a support. In the configuration of general color photographic papers, a color coupler which forms a dye having a color complementary to that of the light to which the silver halide emulsion is sensitive can be incorporated in the system to provide subtractive color reproduction. In the configuration of general color photographic papers, the silver halide emulsion grains are spectrally sensitized with blue-sensitive, green-sensitive and red-sensitive spectral sensitizing dyes in the order according to that of the aforementioned color-developable layers, and then coated on a support in this order. However, the order of arrangement may be different from the aforementioned order. In particular, from the standpoint of rapid processing, a light-sensitive layer containing silver halide grains having the greatest average grain size may be preferably provided as an uppermost layer. Alternatively, the lowermost layer may be preferably a magenta-developable silver halide emulsion layer from the standpoint of preservability under irradiation.

In a further alternative embodiment, the light-sensitive layers and the color hue of developed dyes may have correlations other than that above specified.

The silver halide grains to be incorporated in the photographic light-sensitive material of the present invention as defined in the clause (iii) may comprise silver bromochloride or silver chloride having a silver chloride content of 95 mol % or more and being substantially free of silver iodide. The silver chloride content of the silver halide grains is preferably in the range of 98 mol % or more.

The term "substantially free of silver iodide" as used herein indicates a silver iodide content of 1 mol % or less, preferably 0.2 mol % or less. On the other hand, for the purpose of enhancing the high intensity sensitivity, the spectrally sensitized sensitivity or the storage stability of the photographic light-sensitive material, high silver chloride content grains containing 0.01 to 3 mol % of silver iodide on the surface thereof as disclosed in JP-A-3-84545 may be preferably used in some cases.

The halogen composition of emulsion may be the same or different from grain to grain. The use of an emulsion having the same halogen composition among grains advantageously provides easy uniformalization of the properties of grains.

For the halogen composition distribution in the silver halide emulsion grains to be incorporated in the photographic light-sensitive material (iii) of the present invention, reference can be made to the case of the photographic light-sensitive material (ii).

The high silver chloride content emulsion to be incorporated in the photographic light-sensitive material of the present invention as defined in the material (iii) preferably comprises silver bromide phase localized inside and/or on silver halide grains in a layer or non-layer form as mentioned above. The halogen composition of the aforementioned localized phase preferably has a silver bromide content of at least 10 mol %, more preferably 20 mol % to 100 mol %.

For the analysis of the silver bromide content of the silver bromide localized phase and the preferred location of the localized phase, reference can be made to the case of the photographic light-sensitive material (ii).

It is also effective to further enhance the silver chloride content of the silver halide emulsion for the purpose of reducing the replenishment rate of the developer. In this case, a substantially pure silver chloride emulsion having a silver chloride content of 98 mol % to 100 mol % may also be preferably used.

For the preferred average grain size and grain size distribution of silver halide grains to be incorporated in the silver halide emulsion used in the photographic light-sensitive material (iii) of the present invention, reference can be made to the case of the photographic light-sensitive material (ii). For the purpose of obtaining a wide latitude, several kinds of the aforementioned monodisperse emulsions may be preferably blended for one layer or may be preferably coated in multiple layers.

For the crystal form of the silver halide grains to be incorporated in the photographic emulsion, reference can be made to the case of the photographic light-sensitive material (ii). In the material (iii) of the present invention, grains having the aforementioned regular crystal forms are contained in a weight proportion of 50% or more, preferably 70% or more, more preferably 90% or more.

Besides these emulsions, an emulsion comprising tabular grains having an average aspect ratio (diameter, in terms of circle/thickness) of 5 or more, preferably 8 or more, in a proportion of 50% by weight or more of the total grains as calculated in terms of projected area may be preferably used.

For the method for the preparation of the silver bromochloride emulsion or silver chloride emulsion to be used in the photographic light-sensitive material (iii) of the present invention, reference can be made to the case of the photographic light-sensitive material (ii).

The localized phase or substrate of the silver halide grains to be incorporated in the photographic light-sensitive material (iii) of the present invention may preferably comprise diverse metal ions or complex ions thereof. Preferred metal ions can be selected from the group consisting of ions of metals belonging to the groups VIII and IIb in the periodic table or complexes thereof, lead ions and thallium ions. The localized phase can mainly comprise metal ions selected from the group consisting of iridium, rhodium and ferric or ferrous ions or complex ions thereof. The substrate can mainly comprise metal ions selected from the group consisting of osmium, iridium, rhodium, platinum, ruthenium, palladium, cobalt, nickel and ferric or ferrous ions or complex ions in combination. The kind and concentration of metal ions used in the localized phase may be different from those of the substrate. A plurality of kinds of metals can be used. In particular, iron and iridium compounds are preferably incorporated in the silver bromide localized phase.

These metal ion-supplying compounds may be incorporated in the localized phase and/or other portion (substrate) of the silver halide grains of the present invention by adding these metal ion-supplying compounds in the form of dispersion in aqueous solution of gelatin, aqueous solution of halide, aqueous solution of silver salt or other aqueous solutions to the system, or by adding these metal ion-supplying compounds to the system in the form of solution of finely divided silver halide grains containing metal ions, during the formation of silver halide grains.

The incorporation of metal ions to be used in the photographic light-sensitive material (iii) of the present invention to the emulsion grains can be effected at any time before, during or shortly after the formation of grains depending on the position of metal ions in the grain in which these metal ions are to be incorporated.

The silver halide emulsion to be used in the present invention is normally subjected to chemical sensitization and spectral sensitization.

The chemical sensitization of the photographic light-sensitive material (iii) of the present invention may be effected by a chemical sensitization with a chalcogen sensitizer e.g., sulfur sensitization in which unstable sulfur compound is representatively used, selenium sensitization with a selenium compound, tellurium sensitization with a tellurium compound), a noble sensitization represented by gold sensitization, a reduction sensitization or the like. As compounds to be used in the chemical sensitization method there may be preferably used those described in JP-A-62-215272, lower right column, page 18—upper right column, page 22.

The emulsion to be used in the photographic material (iii) of the present invention is preferably of a so-called surface latent image type in which latent images are formed mainly on the surface of grains.

The silver halide emulsion to be incorporated in the photographic light-sensitive material (iii) of the present invention may comprise various compounds or precursors thereof for the purpose of inhibiting fog as in the case of the photographic light-sensitive material (ii). Specific examples of these compounds include those described with reference to the photographic light-sensitive material (ii).

Spectral sensitization is effected for the purpose of providing the emulsion in the various layers in the photographic light-sensitive material (iii) of the present invention with the spectral sensitivity to the respective desired wavelength range.

As spectral sensitizing dyes to be used in the spectral sensitization to blue, green and red light ranges in the photographic light-sensitive material (iii) of the present invention there may be used those described with reference to the photographic light-sensitive material (ii). Specific preferred examples of such a compound and spectral sensitization method which can be preferably used include those described in the above cited JP-A-62-215272, upper right column, page 22 to page 38. As the red-sensitive spectral sensitizing dye for silver halide emulsion grains having a high silver chloride content, spectral sensitizing dyes as disclosed in JP-A-3-123340 are particularly preferred from the standpoint of stability, adsorption, dependence on temperature upon exposure, etc.

If the photographic light-sensitive material of the present invention as defined in the clause (iii) is spectrally sensitized in the infrared range at a high efficiency, a sensitizing dye as disclosed in JP-A-3-15049, upper left column, page 12—lower left column, page 21, and 3-20730, lower left column, page 4—lower left column, page 15, EP0,420,011, line 21, page 4—line 54, page 6, EP0,420,012, line 12, page 4—line 33, page 10, EP0,443,466, and U.S. Pat. No. 4,975,362 can be preferably used.

When such a spectral sensitizing dye is incorporated in the silver halide emulsion, it may be directly dispersed in the emulsion or may be added to the emulsion in the form of solution in water, methanol, ethanol, propanol, methyl cellosolve, 2,2,3,3-tetrafluoropropanol or the like, Singly or in admixture. Alternatively, such a spectral sensitizing dye may be added to the emulsion in the form of aqueous solution under the presence of an acid or base as disclosed in JP-B-44-23389, JP-B-44-27555, and JP-B-57-22089 or in the form of aqueous solution for colloidal dispersion with a surface active agent present therein as disclosed in U.S. Pat. Nos. 3,822,135, and 4,006,025. Further, such a spectral sensitizing dye may be dissolved in a solvent substantially non-miscible with water such as phenoxyethanol, dispersed in water or a hydrophilic colloid, and then added to the emulsion. As described in JP-A-53-102733, and JP-A-58-105141, such a spectral sensitizing dye may be added to the emulsion in the form of dispersion in a hydrophilic colloid.

The time at which such a spectral sensitizing dye is added to the emulsion may be any stage which has heretofore been known effective. In particular, it may be added to the emulsion before or during the formation of silver halide emulsion grains, between shortly after the formation of grains and before the rinse, before or during the chemical sensitization, between shortly after the chemical sensitization and solidification of by cooling the emulsion or during the preparation of coating solution.

In general, it may be conducted between the completion of the chemical sensitization and before the coating. As described in U.S. Pat. Nos. 3,628,969, and 4,225,666, such a spectral sensitizing dye may be added to the emulsion at the same time with a chemical sensitizer so that spectral sensitization and chemical sensitization are simultaneously effected. As described in JP-A-58-113928, it may be conducted prior to the chemical sensitization. Further, such a spectral sensitizing dye may be added to the emulsion before the completion of precipitation of silver halide grains to initiate spectral sensitization. Moreover, as taught in U.S. Pat. No. 4,225,666, such a spectral sensitizing dye may be batch-wise added to the system. In other words, a part of the spectral sensitizing dye may be added to the system prior to chemical sensitization, and the residual part of the spectral sensitizing dye may be added to the system after chemical sensitization. In accordance with a further method taught in U.S. Pat. No. 4,183,756, such a spectral sensitizing dye may be added to the system at any stage during the formation of silver halide grains.

Particularly preferred among these stages in which the spectral sensitizing dye can be added to the system is before rinse or chemical sensitization.

The amount of such a spectral sensitizing dye to be added depends much on the circumstances. It is preferably in the range of $0.5\times10^{-6}$ mol to $1.0\times10^{-2}$ mol, more preferably $1.0\times10^{-6}$ mol to $5.0\times10^{-3}$ mol per mol of silver halide.

In the photographic light-sensitive material (iii) of the present invention, when a sensitizing dye having a spectrally sensitized sensitivity particularly in the range of from red region to infrared region is used, it is preferred that a compound as described in JP-A-2-157749, lower right column, page 13—lower right column, page 22 is used together. The use of such a compound provides a specific enhancement of the preservability and processing stability of the photographic light-sensitive material and the effect of supersensitizing the photographic light-sensitive material. In particular, Compounds (IV), (V) and (VI) described in the above cited patent are preferably used together therewith. The amount of such a compound to be incorporated is in the range of $0.5\times10^{-5}$ mol to $5.0\times10^{-2}$ mol, preferably $5.0\times10^{-5}$ mol to $5.0\times10^{-3}$ mol per mol of silver halide. Its advantageous range is in the range of 0.1 to 10,000 times, preferably 0.5 to 5,000 times the molar quantity of sensitizing dye.

The photographic light-sensitive material of the present invention as defined in the clause (iii) may be exposed to visible light or infrared light. Exposure may be carried out by a low intensity exposure process or a high intensity exposure process. In a preferred embodiment of the latter case, laser scanning exposure process with an exposure time of $10^{-4}$ seconds or less, preferably $10^{-6}$ or less per pixel may be preferably used.

A band stop filter as disclosed in U.S. Pat. No. 4,880,726 may be preferably used for exposure. This removes light stain, providing a remarkable enhancement of color reproducibility.

The photographic light-sensitive material (iii) which has been exposed to light may be subjected to a commonly used color development, preferably followed by blix for the purpose of expediting the processing. In particular, if the aforementioned emulsion having a high silver chloride content emulsion is used, the pH value of the blix solution is preferably in the range of about 6.5 or less, more preferably about 6 or less for the purpose of accelerating the desilvering procedure.

As silver halide emulsions and other materials (additives) to be incorporated in the photographic light-sensitive material (iii) of the present invention, photographic constituent layers of the light-sensitive material (iii) of the present invention (layer configuration), and processing methods and processing additives to be used in the processing of the photographic light-sensitive material (iii) of the present invention there can be preferably used those described in JP-A-62-215272, and JP-A-2-33144, and EP0,355,660A2 as in the photographic light-sensitive material (i).

The cyan, magenta or yellow coupler is preferably emulsion-dispersed in an aqueous solution of a hydrophilic colloid in the form of an impregnation in a loadable latex polymer (as described in U.S. Pat. No. 4,203,716) in the presence (or absence) of a high boiling organic solvent as tabulated above or in the form of a solution together with a water-insoluble and organic solvent-soluble polymer.

Examples of the water-insoluble and organic solvent-soluble polymer which can be preferably used include single polymers or copolymers as described in U.S. Pat. No. 4,857,449, 7th column—15th column, and WO88/00723, pp. 12–30. More preferably, methacrylate or acrylamide polymers, particularly acrylamide polymers may be used in the light of dye image stability.

The photographic light-sensitive material (iii) of the present invention preferably comprises a dye preservability-improving compound as described in EO0,277,5-89A2 in combination with these couplers, particularly in combination with pyrazoloazole coupler or pyrrolotriazole coupler.

In particular, a compound as described in the above cited patents which undergoes chemical bonding to an aromatic amine developing agent remaining after color development to produce a chemically inert and substantially colorless compound and/or another compound as described in the above cited patents which undergoes chemical bonding to an oxidation product of an aromatic amine color developing agent remaining after color development to produce a chemically inert and substantially colorless compound may be preferably used singly or in combination to inhibit the occurrence of stain or other side effects caused by the formation of developed dyes by the reaction of a color developing agent or its oxidation product remaining in the film with a coupler in the storage after processing.

As the cyan, yellow and magenta couplers to be incorporated in the photographic light-sensitive material (iii) of the present invention there can be used the same couplers as used in the photographic light-sensitive material (i) of the present invention.

As the processing method for the color photographic light-sensitive material (iii) of the present invention there preferably be used besides those tabulated above processing materials and processing methods as described in JP-A-2-207250, line 1, lower right column, page 26—line 9, upper right column, page 34, and JP-A-4-97355, line 17, upper left column, page 5—line 20, lower right column, page 18.

The present invention will be further described in the following examples, but the present invention should not be construed as being limited thereto.

EXAMPLE 1

32 g of a lime-treated gelatin was added to and dissolved in 800 cc of distilled water at a temperature of 40° C. 5.76 g of sodium chloride was added to the solution. The solution was then heated to a temperature of 75° C. A solution of 100 g of silver nitrate in 400 cc of distilled water and a solution of 34.4 g of sodium chloride in 400 cc of distilled water were added to the solution over 73 minutes with the temperature of the system being kept at 75° C. A solution of 59.2 g of silver nitrate in 200 cc of distilled water and a solution of 17.1 g of sodium chloride in 200 cc of distilled water were added to the solution over 28 minutes with the temperature of the system being kept at 75° C. The system was then allowed to cool to 4° C. Blue-sensitive sensitizing dyes A and B as described below were each added to the system in an amount of $2\times10^{-4}$ mol per mol of silver halide. A solution of 0.8 g of silver nitrate in 100 cc of distilled water and a solution of 0.56 g of potassium bromide in 100 cc of distilled water were added to the solution over 10 minutes with the temperature of the system being kept at 40° C. The material was then desalted and rinsed. The material was then subjected to optimum sulfur sensitization with 90 g of a lime-treated gelatin. The silver bromochloride emulsion thus obtained (silver bromide content: 0.5 mol %) was designated as Emulsion A.

A silver bromochloride emulsion (silver bromide content: 0.5 mol %) was prepared as Emulsion B in the same manner as Emulsion A except that $K_2IrCl_6$ was added to the potassium bromide Solution in an amount corresponding to of $1.0\times10^{-6}$ mol per mol of finished silver bromochloride.

A silver bromochlorideemulsion (silver bromide content: 0.5 mol %) was prepared as Emulsion C in the same manner as Emulsion A except that $K_4Fe(CN)_6$ was added to the sodium chloride solution to be added at the second time in an amount corresponding to $8.0\times10^{-6}$ mol per mol of finished silver bromochloride.

Silver bromochloride emulsions were prepared as Emulsions D, E, F and G in the same manner as Emulsion A except that the kind and amount of metal complexes to be added to the sodium chloride solution to be added at the second time were altered as set forth in Table A, respectively.

TABLE A

| Emulsion | Kind of metal complex | Amount of metal complex[1] |
|---|---|---|
| A | None | None |
| B | $K_2IrCl_6$ | $1.0\times10^{-6}$ |
| C | $K_4Fe(CN)_6$ | $8.0\times10^{-6}$ |

TABLE A-continued

| Emulsion | Kind of metal complex | Amount of metal complex[1] |
|---|---|---|
| D | $K_4Ru(CN)_6$ | $8.0\times10^{-6}$ |
| E | $K_4Os(CN)_6$ | $8.0\times10^{-6}$ |
| F | $K_3Ir(CN)_6$ | $1.5\times10^{-5}$ |
| G | $K_3RuCl_6$ | $1.0\times10^{-7}$ |

[1]Added molar amount per mol of finished silver halide

Emulsions A to G thus obtained were measured for grain shape, grain size and grain size distribution with their electron microscope photographs. The grain size was represented by the average value of the diameter of circles having the same area as the projected area of grains. The grain size distribution was obtained by dividing the standard deviation of grain diameters by the average grain size. Emulsions A to G all comprised cubic grains having a grain size of 0.70 μm and a grain size distribution of 0.09. When examined by a diffraction X-ray method, emulsions A to G exhibited a weak diffraction in the portion corresponding to a silver bromide content of 10 mol % to 40 mol %.

The surface of a paper support laminated with polyethylene on both sides thereof for gelatin was subjected to corona discharge. On the paper support was provided an undercoating layer for gelatin containing sodium dodecylbenzenesulfonate. On the undercoating layer were coated various photographic constituent layers to prepare a multilayer color photographic paper having the following layer construction (Specimen 1). The coating solutions were prepared as follows:

Preparation of 1st Layer Coating Solution 153.0 g of a yellow coupler (ExY), 15.0 g of a dye image stabilizer (Cpd-1), 7.5 g of a dye image stabilizer (Cpd-2), and 16.0 g of a dye image stabilizer (Cpd-3) were dissolved in 180 cc of ethyl acetate, 25 g of a solvent (Solv-1) and 25 g of a solvent (Solv-2) to make a solution. The solution thus obtained was then emulsion-dispersed in 1,000 g of a 10% aqueous solution of gelatin containing 60 cc of sodium dodecylbenzenesulfonate and 10 g of citric acid to prepare Emulsified Dispersion A which was then mixed with Emulsion A to obtain a 1st layer coating solution.

The coating solutions four the 2nd layer to the 7th layer were prepared in the same manner as the coating solution for the 1st layer. As gelatin hardener for each layer there was used sodium salt of 1-oxy-3,5-dichloro-s-triazine.

Dye image stabilizers Cpd-14 and Cpd-15 each were added to each layer in an amount to be 25.0 mg/m$^2$and 50.0 mg/m$^2$ in total, respectively.

As spectral sensitizing dyes to be incorporated in the various layers there were used the following compounds:

Blue-sensitive emulsion layer

Sensitizing dye A

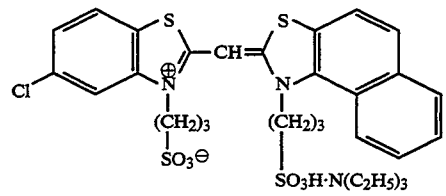

and

-continued

Sensitizing dye B

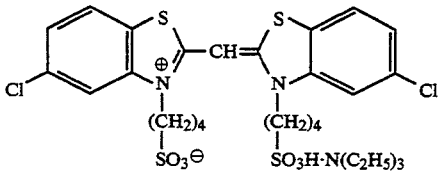

($2.0 \times 10^{-4}$ mol for each per mol of silver halide)

Green-sensitive emulsion layer

Sensitizing dye G

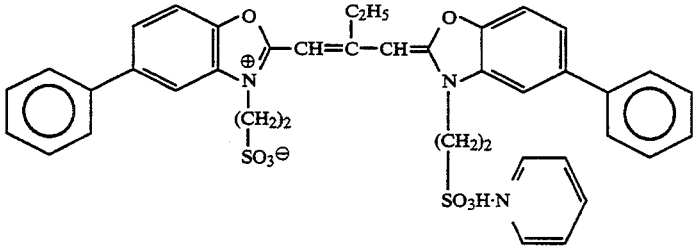

($4.0 \times 10^{-4}$ mol each for large size emulsion and $5.6 \times 10^{-4}$ mol each for small size emulsion per mol of silver halide)

Sensitizing dye D

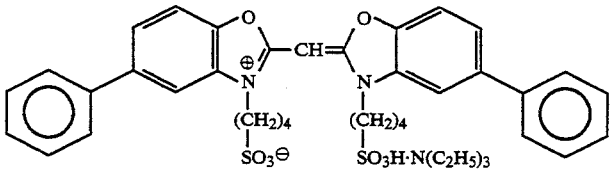

($7.0 \times 10^{-5}$ mol each for large size emulsion and $1.0 \times 10^{-4}$ mol each for small size emulsion per mol of silver halide)

Red-sensitive emulsion layer

Sensitizing dye E

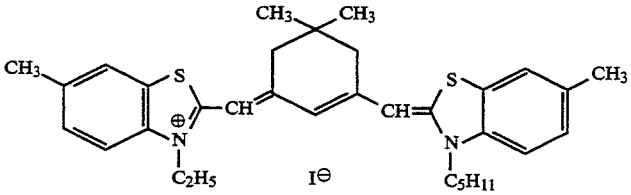

($0.9 \times 10^{-4}$ mol each for large size emulsion and $1.1 \times 10^{-4}$ mol each for small size emulsion per mol of silver halide)

Further, the following compound was incorporated in the system in an amount of $2.6 \times 10^{-3}$ mol per mol of silver halide.

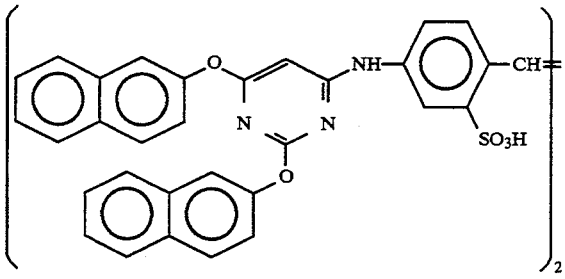

In the green-sensitive emulsion layer was incorporated 1-(5-methylureidophenyl)-5-mercaptotetrazole in an amount of $7.7 \times 10^{-4}$ mol per mol of silver halide.

In the blue-sensitive emulsion layer and the green-sensitive emulsion layer was incorporated 4-hydroxy-6-methyl-1,3,3a,7-tetrazaindene in an amount of $1.0 \times 10^{-4}$ mol and $2.0 \times 10^{-4}$ mol per mol of silver halide, respectively.

For the purpose of inhibiting irradiation, to the emulsion layers were each added the following dyes (figures in the parenthesis indicate the coated amount):

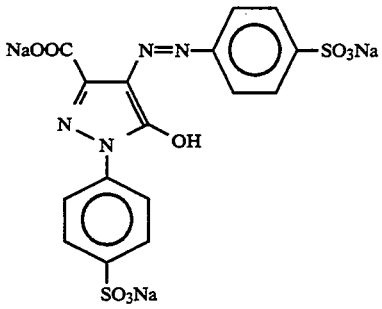

(10 mg/m²)

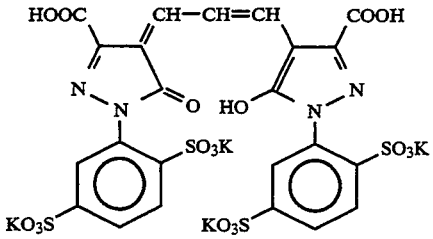

(10 mg/m²)

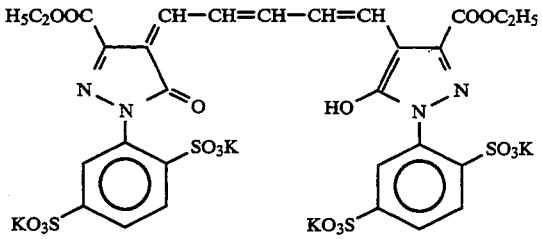

(40 mg/m²)

and

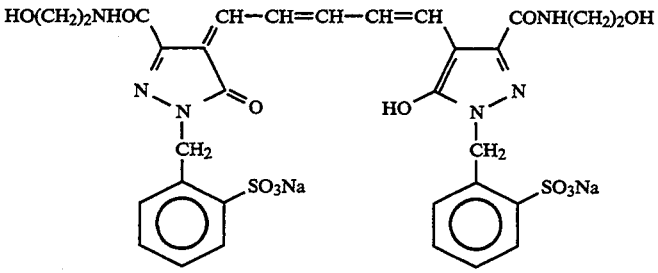

(20 mg/m²)

The formulations of the various layers are set forth below. The figures indicate the coated amount (g/m2). The coated amount of silver halide emulsion is represented as calculated in terms of silver.

Support

Polyethylene-laminated paper [containing a white pigment ($TiO_2$) and a bluish dye (ultramarine) in polyethylene on the 1st layer side]

| | |
|---|---|
| 1st layer (blue-sensitive emulsion layer) | |
| Silver bromochloride emulsion A as set forth above | 0.27 |
| Gelatin | 1.36 |
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |
| 2nd layer (color stain inhibiting layer) | |
| Gelatin | 1.00 |
| Color mixing inhibitor (Cpd-4) | 0.06 |
| Solvent (Solv-7) | 0.03 |
| Solvent (Solv-2) | 0.25 |
| Solvent (Solv-3) | 0.25 |
| 3rd layer (green-sensitive emulsion layer) | |
| Silver bromochloride emulsion (1:3 (Ag molar ratio) mixture of a large | 0.13 |

-continued

| | |
|---|---|
| size emulsion of cubic grains having an average size of 0.55 μm with a grain size distribution fluctuation coefficient of 0.10 and a small size emulsion of cubic grains having an average size of 0.39 μm with a grain size distribution fluctuation coefficient of 0.08, 0.8 mol % of silver bromide being localized partially on the surface of each emulsion and a balance comprising silver chloride) | |
| Gelatin | 1.45 |
| Magenta coupler (ExM) | 0.16 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| 4th layer (color stain inhibiting layer) | |
| Gelatin | 0.70 |
| Color mixing inhibitor (Cpd-4) | 0.04 |
| Solvent (Solv-7) | 0.02 |
| Solvent (Solv-2) | 0.18 |
| Solvent (Solv-3) | 0.18 |
| 5th layer (red-sensitive emulsion layer) | |
| Silver bromochloride emulsion (1:4 (Ag molar ratio) mixture of a large size emulsion of cubic grains having an average size of 0.50 μm with a grain size distribution fluctuation coefficient of 0.09 and a small size emulsion of cubic grains having an average size of 0.41 μm with a grain size distribution fluctuation coefficient of 0.11, 0.8 mol % of silver bromide being localized partially on the surface of each emulsion and a balance comprising silver chloride) | 0.20 |
| Gelatin | 0.85 |
| Cyan coupler (ExC) | 0.33 |
| Ultraviolet absorbent (UV-2) | 0.18 |
| Dye image stabilizer (Cpd-9) | 0.02 |
| Dye image stabilizer (Cpd-10) | 0.02 |
| Dye image stabilizer (Cpd-11) | 0.01 |
| Solvent (Solv-6) | 0.22 |
| Dye image stabilizer (Cpd-8) | 0.01 |
| Dye image stabilizer (Cpd-6) | 0.01 |
| Solvent (Solv-1) | 0.01 |
| Dye image stabilizer (Cpd-1) | 0.33 |
| 6th layer (ultraviolet absorbing layer) | |
| Gelatin | 0.55 |
| Ultraviolet absorbent (UV-1) | 0.38 |
| Dye image stabilizer (Cpd-12) | 0.15 |
| Dye image stabilizer (Cpd-5) | 0.02 |
| 7th layer (protective layer) | |
| Gelatin | 1.13 |
| Acryl-modified copolymer of polyvinyl alcohol (modification degree: 17%) | 0.05 |
| Liquid paraffin | 0.02 |
| Dye image stabilizer (Cpd-13) | 0.01 |

Yellow coupler (ExY)
1:1 (molar ratio) mixture of

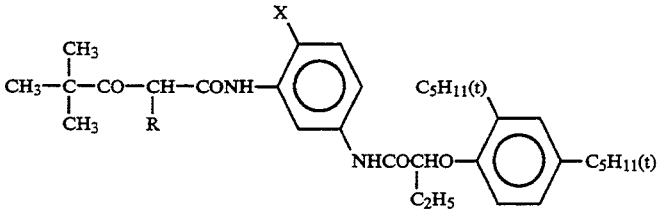

R =

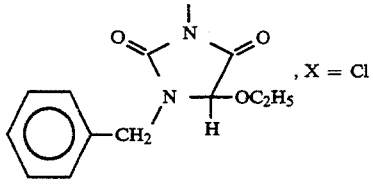

, X = Cl and

-continued
R = 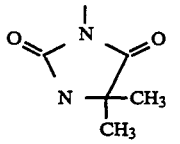 , X = $OCH_3$
Magenta coupler (ExM)
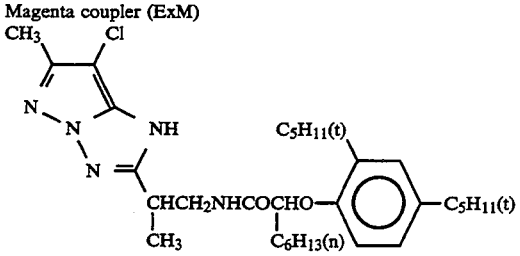
Cyan coupler (ExC)
3:7 (molar ratio) of:
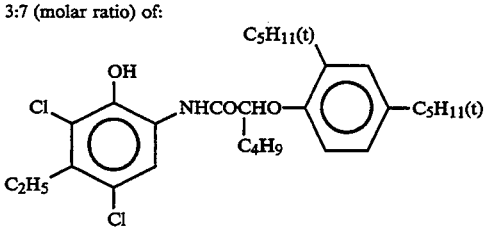
and
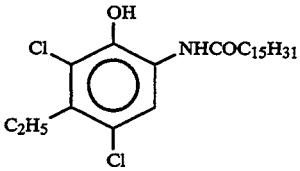
Dye image stabilizer (Cpd-1)
$-(CH_2-CH)_n-$ (Average molecular weight: 60,000)
$CONHC_4H_9(t)$
Dye image stabilizer (Cpd-2)
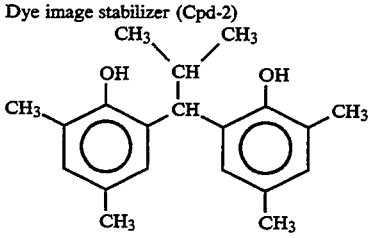
Dye image stabilizer (Cpd-3)
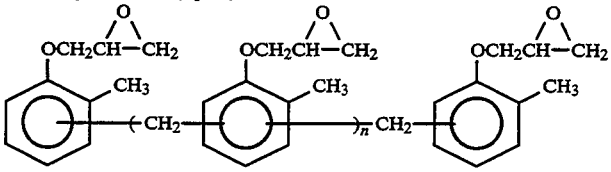
n = 7 to 8 (on average)
Color mixing inhibitor (Cpd-4)
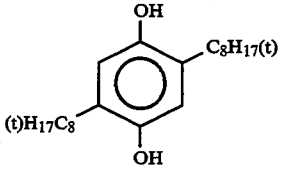

-continued
Dye image stabilizer (Cpd-5)
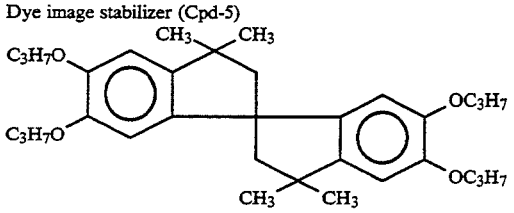
Dye image stabilizer (Cpd-6)
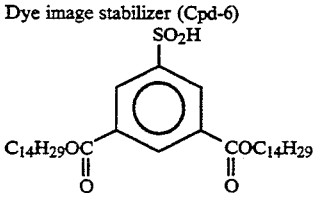
Dye image stabilizer (Cpd-7)
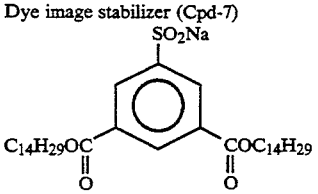
Dye image stabilizer (Cpd-8)
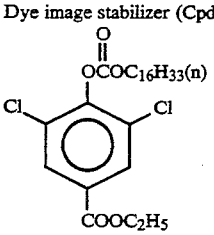
Dye image stabilizer (Cpd-9)
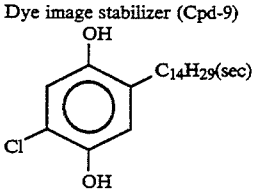
Dye image stabilizer (Cpd-10)
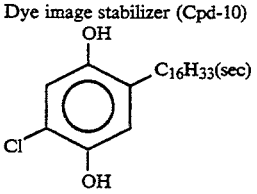
Dye image stabilizer (Cpd-11)
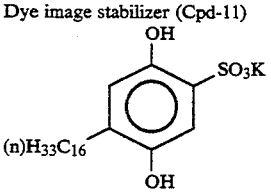
Dye image stabilizer (Cpd-12)
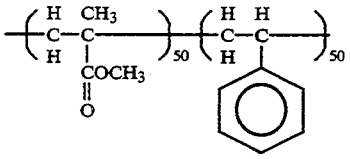

-continued
Average molecular amount: approx. 60,000
Dye image stabilizer (Cpd-13)
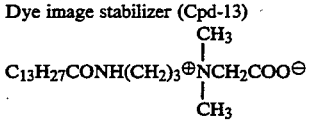
Preservative (Cpd-14)
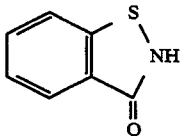
Preservative (Cpd-15)
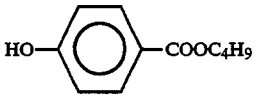
Ultraviolet absorbent (UV-1)
1:5:10:5 (weight ratio) mixture of:
(1)
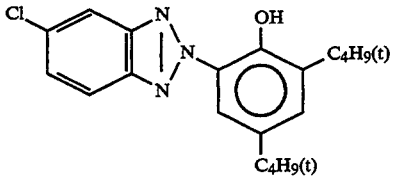
(2)
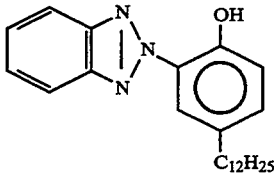
(3)
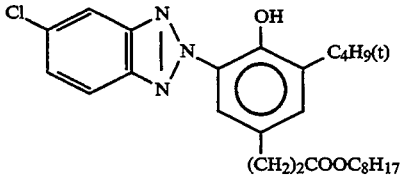
(4)
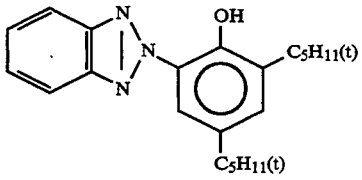
Ultraviolet absorbent (UV-2)
1:2:2 (weight ratio) mixture of:
(1)
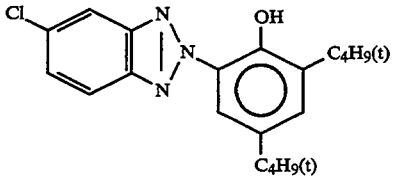
(2)
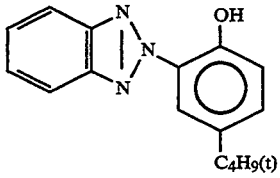

-continued (3)

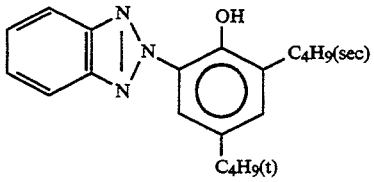

Solvent (Solv-1)

$C_8H_{17}CH(O)CH(CH_2)_7COOC_8H_{17}$

Solvent (Solv-2)

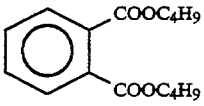

Solvent (Solv-3)

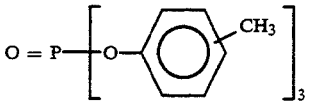

Solvent (Solv-4)

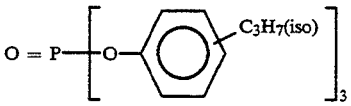

Solvent (Solv-5)

$O = P\text{-}(OCH_2CH(C_2H_5)C_4H_9(n))_3$

Solvent (Solv-6)

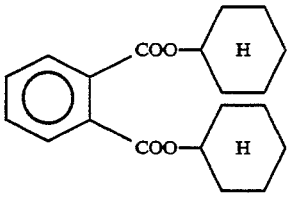

Solvent (Solv-7)

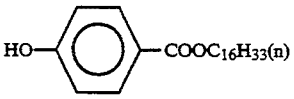

Specimens 2 to 18 were prepared in the same manner as Specimen 1 except that the presence of an undercoating hydrophilic colloidal layer as mentioned below between the support (polyethylene-laminated paper) and the 1st layer, the coated amount of titanium oxide (white pigment) in the hydrophilic colloidal layer, the kind of the silver halide emulsion to be incorporated in the 1st layer (blue-sensitive emulsion layer), and the kind of the compounds to be incorporated in the 1st layer were altered as set forth in Table B.

Preparation of Coating Solution for Undercoating Hydrophilic Colloidal Layer

To 1.0 kg of a 10% aqueous solution of gelatin were added 400 g of a rutile type titanium white pigment having an average grain size of 0.23 μm (Titan White R780 available from Ishihara Sangyo K.K.) and 4 l of water. To the material was then added 8 cc of a 5% aqueous solution of sodium dodecylbenzenesulfonate as a dispersant. The material was then subjected to dispersion under irradiation with ultrasonic wave.

TABLE B

| Specimen | Undercoating hydrophilic colloidal layer: Presence | Undercoating hydrophilic colloidal layer: Coated amount of white pigment ($g/m^2$) | Blue-sensitive layer emulsion | Mercapto[1] heterocyclic compound | Spatial frequency (line/mm) | ΔD |
|---|---|---|---|---|---|---|
| 1 | No | — | A | I-2-6 | 14.0 | 0.000 |
| 2 | Yes | 1.5 | A | I-2-6 | 15.0 | 0.000 |
| 3 | Yes | 3 | A | I-2-6 | 19.5 | 0.020 |
| 4 | Yes | 5 | A | I-2-6 | 25.5 | 0.025 |
| 5 | Yes | 5 | A | None | 23.5 | 0.030 |
| 6 | No | — | B | I-2-6 | 14.0 | 0.000 |
| 7 | Yes | 5 | B | None | 23.5 | 0.030 |
| 8 | Yes | 5 | B | I-2-6 | 23.5 | 0.000 |
| 9 | Yes | 5 | C | I-2-6 | 23.5 | 0.000 |
| 10 | Yes | 1.5 | D | None | 15.0 | 0.005 |
| 11 | Yes | 1.5 | D | I-2-6 | 15.0 | 0.000 |
| 12 | Yes | 3 | D | I-2-6 | 19.5 | 0.000 |
| 13 | Yes | 5 | D | None | 23.5 | 0.030 |
| 14 | Yes | 5 | D | I-2-6 | 23.5 | 0.000 |
| 15 | Yes | 10 | D | I-2-6 | 25.5 | 0.010 |
| 16 | Yes | 5 | E | I-2-6 | 23.5 | 0.000 |
| 17 | Yes | 5 | F | I-2-6 | 23.5 | 0.000 |
| 18 | Yes | 5 | G | I-2-6 | 23.5 | 0.015 |

[1]Added in an amount of $8 \times 10^{-4}$ mol per mol of silver halide in the blue-sensitive layer upon the preparation of the coating solution Specimens 1 to 7, 10, 11, and 13 were comparative while the others were according to the present invention.

In order to examine the photographic light-sensitive materials thus prepared for magenta sharpness, the photographic light-sensitive materials were exposed to light through a sharpness measuring optical wedge and a green color filter, and then processed in accordance with the processing procedures as mentioned below. The sharpness was represented by the spatial frequency (line/mm) giving CTF 0.5. The more the spatial frequency value is, the higher is the sharpness. The reason why the sharpness of magenta is evaluated is that the human eye is more sensitive to magenta than to yellow and cyan. The results are set forth in Table B.

In order to evaluate yellow fog density developed after a prolonged storage, these photographic light-sensitive materials were stored at a temperature of 35° C. and a relative humidity of 55% for 2 weeks and another batch of these specimens were stored in a freezer (10° C.) for 2 weeks. These specimens were then processed in accordance with the processing procedures as mentioned below. On the supposition that the color developer would have been actually contaminated with some blix solution, the processing was effected with the developer being intentionally contaminated with 0.3 cc/l of the blix solution. The rise in the yellow fog density was represented by the difference (AD) in fog density between the specimen stored in a freezer and another batch of the specimen stored at 35° C./55% RH. The greater this difference value is, the greater is the rise in the yellow fog density developed after a prolonged storage. The reason why the yellow fog density is evaluated is that the silver halide emulsion in the blue-sensitive layer itself is subject to fog due to the emulsion design in color photographic papers. In addition, since the blue-sensitive layer is nearest to the white pigment layer and thus is further liable to be fogged, the yellow coupler in the blue-sensitive layer causes a remarkable yellow fog.

| Processing step | Temperature | Time |
|---|---|---|
| Color development | 35° C. | 45 sec. |
| Blix | 30–35° C. | 45 sec. |
| Rinse 1 | 30–35° C. | 20 sec. |

-continued

| Processing step | Temperature | Time |
|---|---|---|
| Rinse 2 | 30–35° C. | 20 sec. |
| Rinse 3 | 30–35° C. | 20 sec. |
| Drying | 70–80° C. | 60 sec. |

The formulations of the various processing solutions were as follows:

| | |
|---|---|
| Color developer | |
| Water | 800 ml |
| Ethylenediamine-N,N,N,N-tetramethylene-phosphonate | 1.5 g |
| Potassium bromide | 0.015 g |
| Triethanolamine | 8.0 g |
| Sodium chloride | 1.4 g |
| Potassium carbonate | 25 g |
| N-ethyl-N-(β-methanesulfoamideethyl)-3-methyl-4-aminoanilinesulfate | 5.0 g |
| N,N-bis(carboxymethyl)hydrazine | 4.0 g |
| N,N-di(sulfoethyl)hydroxylamine.1Na | 4.0 g |
| Fluorescent brightening agent (Whitex 4B produced by Sumitomo Chemical Co., Ltd.) | 1.0 g |
| Water to make | 1,000 ml |
| pH (25° C.) | 10.05 |
| Blix solution | |
| Water | 400 ml |
| 70% Ammonium thiosulfate | 100 ml |
| Sodium sulfite | 17 g |
| Ferric (III) ammonium ethylenediamine-tetraacetate | 55 g |
| Ferric disodium ethylenediamine-tetraacetate | 5 g |
| Ammonium bromide | 40 g |
| Water to make | 1,000 ml |
| pH (25° C.) | 6.0 |

Washing Solution

Ion-exchanged water (calcium and magnesium concentration: 3 ppm or less each)

Table B shows that the rise in the undercoated amount of a white pigment provides a high sharpness but also provides an increase in the fog density after a prolonged storage (Specimens 1 to 4). It can be seen in the table that the rise in the fog density can be minimized only by mixing an emulsion containing a specific metal complex with a mercaptoheterocyclic compound (Specimens 8, 9, 12, 14 to 18).

EXAMPLE 2

32 g of a lime-treated gelatin was added to and dissolved in 800 cc of distilled water at a temperature of 40° C. 3.3 g of sodium chloride was added to the solution. The solution was then heated to a temperature of 74° C. A solution of 32.0 g of silver nitrate in 200 cc of distilled water and a solution of 11.0 g of sodium chloride in 200 cc of distilled water were added to the solution over 18 minutes with the temperature of the system being kept at 74° C. A solution of 128.0 g of silver nitrate in 560 cc of distilled water and a solution of 44.0 g of sodium chloride over 560 cc of distilled water were added to the solution in 50 minutes with the temperature of the system being kept at 74° C. $K_4Fe(CN)_6$ had been previously added to the sodium chloride solution to be added at the second time in an amount of $5.0\times10^{-6}$ mol per mol of finished silver bromochloride. The material was then desalted and rinsed. 90.0 g of a lime-treated gelatin was then-added to the material. Blue-sensitive sensitizing dyes A and B as used in Example 1 were each added to the system in an amount of $2.0\times10^{-4}$ mol per mol of silver halide. An emulsion of ultrafine silver bromide grains (grain size: 0.05 μm; $K2IrCl_6$ content: $1.0\times10^{-6}$ mol per mol of finished silver bromochloride emulsion) was added to the material in an amount of 0.4 mol % based on the molar amount of silver chloride as calculated in terms of silver bromide. The emulsion was then subjected to optimum gold-sulfur sensitization. The silver bromochloride emulsion thus obtained (silver bromide content: 0.4 mol %) was used as Emulsion H.

32 g of a lime-treated gelatin was added to and dissolved in 800 cc of distilled water at a temperature of 40° C. 3.3 g of sodium chloride was added to the solution. The solution was then heated to a temperature of 74° C. A solution of 32.0 g of silver nitrate in 200 cc of distilled water and a solution of 9.35 g of sodium chloride and 3.36 g of potassium bromide in 200 cc of distilled water were added to the solution over 28 minutes with the temperature of the system being kept at 74° C. A solution of 128.0 g of silver nitrate in 560 cc of distilled water and a solution of 37.4 g of sodium chloride and 13.4 g of potassium bromide in 560 cc of distilled water were added to the solution over 50 minutes with the temperature of the system being kept at 74° C. $K_4Fe(CN)_6$ and $K_2IrCl_6$ had been previously added to the sodium chloride solution to be added at the second time in an amount of $5.0\times10^{-6}$ mol and $1.0\times10^{-6}$ mol per mol of finished silver bromochloride, respectively. The material was then desalted and rinsed. 90.0 g of a lime-treated gelatin was then added to the material. Blue-sensitive sensitizing dyes A and B as used in Example 1 were each added to the system in an amount of $2.0\times10^{-4}$ mol per mol of silver halide. The emulsion was then subjected to optimum gold-sulfur sensitization. The silver bromochloride emulsion thus obtained (silver bromide content: 15 mol %) was used as Emulsion I.

Emulsions H and I thus obtained were measured for grain shape, grain size and grain size distribution from their electron microscope photographs. The grain size was represented by the average value of the diameter of circles having the same area as the projected area of grains. The grain size distribution was obtained by dividing the standard deviation of grain diameters by the average grain size. Both Emulsions H and I comprised cubic grains having a grain size of 0.71 μm and a grain size distribution of 0.08.

A photographic light-sensitive material was prepared as Specimen 19 in the same manner as Specimen 1 except that the formulations of the various layers (additives and coated amount)were altered as follows, The figure indicates the coated amount (g/m²), The coated amount of silver halide emulsion is represented as calculated in terms of silver,

| | |
|---|---|
| Support | |
| Polyethylene-laminated paper [containing a white pigment ($TiO_2$) and a bluish dye (ultramarine) in polyethylene on the 1st layer side] | |
| 1st layer (blue-sensitive emulsion layer) | |
| Silver bromochloride emulsion H as set forth above | 0.30 |
| Gelatin | 1.22 |
| Yellow coupler (ExY) | 0.82 |
| Dye image stabilizer (Cpd-16) | 0.19 |
| Solvent.(Solv-9) | 0.18 |
| Solvent (Solv-1) | 0.18 |
| Dye image stabilizer (Cpd-18) | 0.06 |
| 2nd layer (color stain inhibiting layer) | |
| Gelatin | 0.64 |
| Color mixing inhibitor (Cpd-4) | 0.10 |
| Solvent (Solv-2) | 0.16 |
| Solvent (Solv-3) | 0.08 |
| 3rd layer (green-sensitive emulsion layer) | |
| Silver bromochloride emulsion (1:3 (Ag molar ratio) mixture of a large size emulsion of cubic grains having an average size of 0.55 μm with a grain size distribution fluctuation coefficient of 0.10 and a small size emulsion of cubic grains having an average size of 0.39 gm with a grain size distribution fluctuation coefficient of 0.08, 0.8 mol % of silver bromide being localized partially on the surface of each emulsion and a balance comprising silver chloride) | 0.12 |
| Gelatin | 1.28 |
| Magenta coupler (ExM) | 0.23 |
| Dye image stabilizer (Cpd-8) | 0.03 |
| Dye image stabilizer (Cpd-5) | 0.16 |
| Dye image stabilizer (Cpd-7) | 0.02 |
| Dye image stabilizer (Cpd-2) | 0.02 |

-continued

| | |
|---|---|
| Solvent (Solv-8) | 0.40 |
| 4th layer (ultraviolet-absorbing layer) | |
| Gelatin | 1.41 |
| Ultraviolet absorbent (UV-3) | 0.47 |
| Color mixing inhibitor (Cpd-4) | 0.05 |
| Solvent (Solv-10) | 0.24 |
| 5th layer (red-sensitive emulsion layer) | |
| Silver bromochloride emulsion H | 0.23 |
| Gelatin | 1.04 |
| Cyan coupler (ExC-2) | 0.32 |
| Dye image stabilizer (Cpd-8) | 0.03 |
| Dye image stabilizer (Cpd-17) | 0.03 |
| Ultraviolet absorbent (UV-2) | 0.18 |
| Dye image stabilizer (Cpd-18) | 0.40 |
| Dye image stabilizer (Cpd-19) | 0.05 |
| Solvent (Solv-11) | 0.14 |
| 6th layer (ultraviolet absorbing layer) | |
| Gelatin | 0.48 |
| Ultraviolet absorbent (UV-3) | 0.16 |
| Color stain inhibitor (Cpd-4) | 0.02 |
| Solvent (Solv-10) | 0.08 |
| 7th layer (protective layer) | |
| Gelatin | 1.10 |
| Acryl-modified copolymer of polyvinyl alcohol (modification degree: 17%) | 0.17 |
| Liquid paraffin | 0.03 |

Cyan coupler (ExC-2)
1:1 (molar ratio) mixture of:

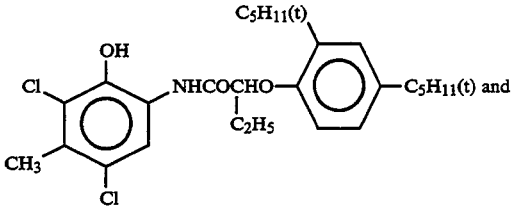

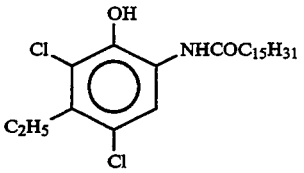

Dye image stabilizer (Cpd-16)

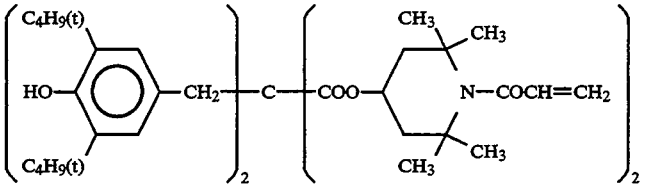

Dye image stabilizer (Cpd-17)

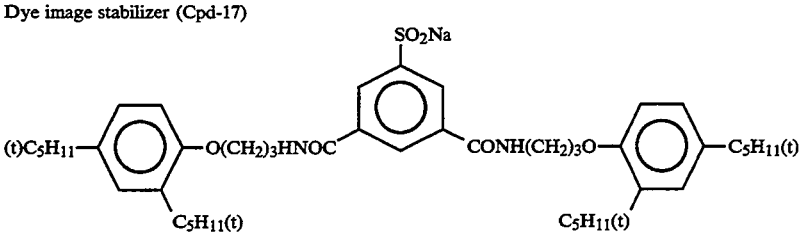

Dye image stabilizer (Cpd-18)

$\left(CH_2-\underset{\underset{CONHC_4H_9(t)}{|}}{CH}\right)_n$ (Average molecular weight: 60,000)

Dye image stabilizer (Cpd-19)
1:1 (weight ratio) mixture of:

-continued
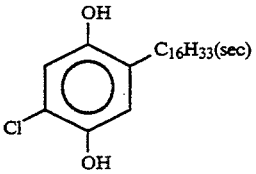
and
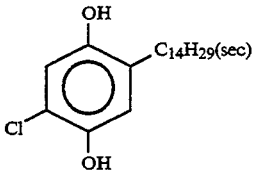
Ultraviolet absorbent (UV-2)
4:2:4 (weight ratio) mixture of:
(i)
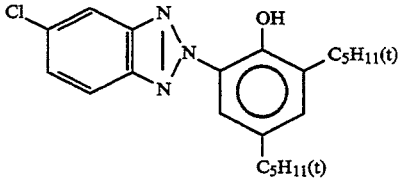
(ii)
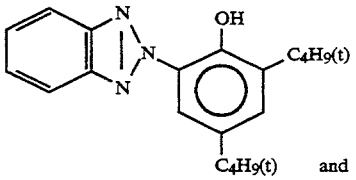
and
(iii)
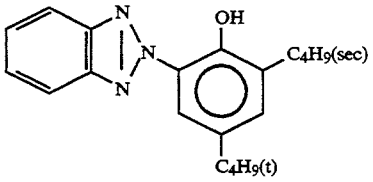
Solvent (Solv-8)
1:1 (volume ratio) mixture of:
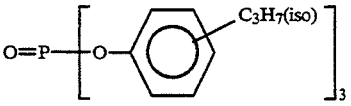
and
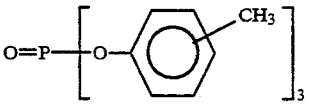
Solvent (Solv-9)
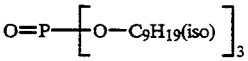
Solvent (Solv-10)
$$\begin{array}{l} COOC_8H_{17} \\ | \\ (CH_2)_8 \\ | \\ COOC_8H_{17} \end{array}$$
Solvent (Solv-6)
80:20 (volume ratio) mixture of:
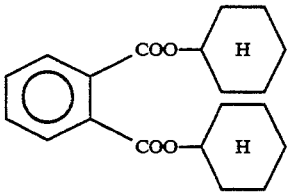
and -continued

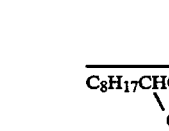

Specimens 20 to 27 were prepared in the same manner as Specimen 19 except that the presence of three undercoating layers (1st undercoating layer, 2nd undercoating layer, and 3rd undercoating layer coated on the support in this order) as mentioned below between the support (polyethylene-laminated paper) and the 1st layer, the kind of the silver halide emulsion to be incorporated in the 1st layer (blue-sensitive emulsion layer), and the kind of the compounds to be incorporated in the 1st layer were altered as set forth in Table C.

1st Undercoating Layer

To 1.0 kg of a 10% aqueous solution of gelatin were added 400 g of a rutile type titanium white pigment having an average grain size of 0.23 μm (Titan White R780 available from Ishihara Sangyo K.K.) and 4 l of water. To the material was then added 8 cc of a 5% aqueous solution of sodium dodecylbenzenesulfonate as a dispersant. The material was then subjected to dispersion under irradiation with ultrasonic wave. The coated amount of the white pigment was adjusted to 5.5 g/m$^2$.

2nd Undercoating Layer

A colloidal silver emulsion as described in Example 1 of JP-A-239544 was coated in an amount of 0.18 g/m$^2$ as calculated in terms of silver. The coated amount of gelatin was 0.80 g/m$^2$.

3rd Undercoating Layer

To 1.0 kg of a 10% aqueous solution of gelatin were added 2 l of water and 8 cc of a 5% aqueous solution of sodium dodecylbenzenesulfonate as a dispersant. The emulsion was coated in such an amount that the coated amount of gelatin reached 0.7 g/m$^2$.

TABLE C

| Specimen | Presence of three under-coating layer | Blue-sensitive layer emulsion | Mercapto[1] heterocyclic compound | Spatial frequency (line/mm) | ΔD |
|---|---|---|---|---|---|
| 19 | No | H | None | 14.5 | 0.000 |
| 20 | No | H | I-2-5 | 14.5 | 0.000 |
| 21 | Yes | H | None | 27.0 | 0.060 |
| 22 | Yes | H | I-2-5 | 27.0 | 0.010 |
| 23 | Yes | H | I-1-5 | 27.0 | 0.020 |
| 24 | Yes | H | I-3-33 | 27.0 | 0.020 |
| 25 | Yes | H | I-4-6 | 27.0 | 0.020 |
| 26 | No | I | I-2-5 | 14.5 | 0.050 |
| 27 | Yes | I | I-2-5 | 27.0 | 0.050 |

[1]Added in an amount of 7 × 10$^{-4}$ mol per mol of silver halide in the blue-sensitive layer in the same manner as in Example 1.
Specimens 22 to 25 are according to the present invention and the others are comparisons.

The photographic light-sensitive material specimens thus prepared were then evaluated for magenta sharpness and yellow fog density rise after a prolonged storage in the same manner as in Example 1. The results are set forth in Table C.

Table C shows that the undercoating of a white pigment-containing layer and a colloidal silver-containing layer provides a high sharpness but also provides an increase in the fog density after a prolonged storage (comparison of Specimen 20 with Specimen 21 and comparison of Specimen 26 with Specimen 27). It can be seen in the table that the rise in the fog density can be minimized only by mixing an emulsion containing a specific metal complex with a mercaptoheterocyclic compound (Specimens 22 to 25). On the other hand, this effect cannot be attained with a silver halide emulsion having a silver chloride content of 90 mol % or less (comparison of Specimen 26 with Specimen 27).

EXAMPLE 3

Emulsions J to N were prepared in the same manner as Emulsion C used in Example 1 except that the kind and addition amount of metal complex were changed as is shown below.

| Emulsion | Kind of metal comples | Amount of metal complex[1] |
|---|---|---|
| J | $K_2RuCl_5(NO)$ | 2.0 × 10$^{-8}$ |
| K | $K_2OsCl_6$ | 1.0 × 10$^{-7}$ |
| L | $K_2RuCl_6$ | 2.0 × 10$^{-7}$ |
| M | $K_3IrCl_6$ | 4.0 × 10$^{-8}$ |
| N | $K_2IrBr_6$ | 2.0 × 10$^{-8}$ |

[1]Added molar amount per mol of finished silver halide

Speciments 28 to 32 were prepared in the same manner as Specimen 18 of Example 1 except that the blue-sensitive emulsion G is replaced by Emulsions J, K, L, M and N. The specimens thus obtained were processed and evaluated in the same manner as in Example 1 to evaluate sharpness (spatial frequency) and an increase of yellow fog density after a prolonged storage of the photographic material, i.e., ΔD.

The results thus obtained are shown in below.

| Specimen | Emulsion | Spatial Frequency | ΔD | Remarks |
|---|---|---|---|---|
| 28 | J | 23.5 | 0.015 | Invention |
| 29 | K | 23.5 | 0.020 | Invention |
| 30 | L | 23.5 | 0.015 | Invention |
| 31 | M | 23.5 | 0.000 | Invention |
| 32 | N | 23.5 | 0.005 | Invention |

As is apparent from the results, the storage atability of the photographic material is remarkably improved when iridium complex is used among metal complexes.

The results of Examples 1 to 3 show that the photographic light-sensitive material (i) of the present invention provides a silver halide color photographic material excellent in image sharpness and storage stability.

EXAMPLE 4

25 g of a lime-treated gelatin was added to and dissolved in 800 cc of distilled water at a temperature of 40° C. 2.25 g of sodium chloride was added to the solution. The solution was then heated to a temperature of 70° C. A solution of 5.0 g of silver nitrate in 140 cc of distilled water and a solution of 1.7 g of sodium chloride in 140 cc of distilled water were added to the solution over 40 minutes with the temperature of the system being kept at 70° C. A solution of 57.5 g of silver nitrate in 160 cc of distilled water and a solution of 19.8 g of sodium chloride in 160 cc of distilled water were added to the solution over 40 minutes with the temperature of the system being kept at 70° C.

Further, a solution of 62.5 g of silver nitrate in 160 cc of distilled water and a solution of 21.5 g of sodium chloride in 160 cc of distilled water were added to the solution over 40 minutes with the temperature of the system being kept at 70° C. The emulsion was then desalted and rinsed at a temperature of 40° C. 76.0 g of a lime-treated gelatin was added to the emulsion. The pH and pAg values of the emulsion were properly adjusted.

The emulsion was then heated to a temperature of 50° C. A blue-sensitive sensitizing dye as set forth below was then added to the emulsion in an amount of $3\times10^{-4}$ mol per mol of silver halide. The emulsion was then subjected to optimum sulfur sensitization with triethylthiourea. The silver chloride emulsion was used as Emulsion B101.

Preparation of Emulsion B102

Emulsion B102 was prepared in the same manner as Emulsion B101 except that the optimum chemical sensitization was effected with tetrachloroauric acid and triethylthiourea in combination.

Preparation of Emulsion B103

Emulsion B103 was prepared in the same manner as Emulsion B101 except that an emulsion of finely divided silver bromide grains having a grain size of 0.05 μm was added in an amount as calculated in terms of $5\times10^{-3}$ mol before the chemical sensitization with triethylthiourea and followed by an optimal chemical sensitization with the combination of tetrachloroauric acid and triethylthiourea. Potassium hexachloroiridiumate (IV) had been previously added to the emulsion of finely divided silver bromide grains in an amount of 10 mg per mol of silver bromide.

Preparation of Emulsion B104

Emulsion B104 was prepared in the same manner as Emulsion B101 except that the optimum chemical sensitization was effected with tetrachloroauric acid.

Preparation of Emulsion B105

Emulsion B105 was prepared in the same manner as Emulsion B104 except that an emulsion of finely divided silver bromide grains having a grain size of 0.05 μm was added in an amount as calculated in terms of $5\times10^{-3}$ mol of silver bromide before the optimum chemical sensitization was effected with tetrachloroauric acid, and followed by optimal chemical sensitization with tetrachloroauric acid. Potassium hexachloroiridiumate (IV) had been previously added to the emulsion of finely divided silver bromide grains in an amount of 10 mg per mol of silver bromide.

Emulsions B101 to B105 thus obtained were measured for grain shape, grain size and grain size distribution from their electron microscope photographs.

The grain size was represented by the average value of the diameter of circles having the same area as the projected area of grains. The grain size distribution was obtained by dividing the standard deviation of grain diameters by the average grain size. Emulsions B101 to B105 comprised sharply edged cubic grains having a grain size of 0.92 μm and a grain size distribution of 0.11.

The surface of a paper support laminated with polyethylene on both sides thereof was subjected to corona discharge. On the paper support was provided a gelatin undercoating layer containing sodium dodecylbenzenesulfonate. On the undercoating layer were coated various photographic constituent layers to prepare a multilayer color photographic paper having the following layer construction (Specimen 104). The coating solutions were prepared as follows:

Preparation of 1st Layer Coating Solution

To 1.0 kg of a 10% aqueous solution of gelatin were added 400 g of a rutile type titanium white pigment having an average grain size of 0.23 μm (Titan White R780 available from Ishihara Sangyo K.K. ) and 4 l of water. To the material was then added 8 cc of a 5% aqueous solution of sodium dodecylbenzenesulfonate as a dispersant. The material was then subjected to dispersion under irradiation with ultrasonic wave.

Preparation of 2nd Layer Coating Solution 153.0 g of a yellow coupler (ExY), 15.0 g of a dye image stabilizer (Cpd-1), 7.5 g of a dye image stabilizer (Cpd-2), and 16.0 g of a dye image stabilizer (Cpd-3) were dissolved in 180 cc of ethyl acetate, 25 g of a solvent (Solv-1) and 25 g of a solvent (Solv-2) to make a solution. The solution thus obtained was then emulsion-dispersed in 1,000 g of a 10% aqueous solution of gelatin containing 60 cc of sodium dodecylbenzenesulfonate and 10 g of citric acid to prepare Emulsion Dispersion A.

Emulsion A was then mixed with Emulsion B101 to obtain a 2nd layer coating solution having the composition as set forth below.

The coating solutions for the 3rd layer to the 8th layer were prepared in the same manner as the coating solution for the 2nd layer. As gelatin hardener for each layer there was used sodium salt of 1-oxy-3,5-dichloro-s-triazine.

The silver bromochloride emulsions to be incorporated in the various photographic light-sensitive emulsion layers comprised the same spectral sensitizing dyes as used in Example 1, respectively.

In the blue-sensitive emulsion layer, the green-sensitive emulsion layer and the red-sensitive emulsion layer was incorporated 1-(5-methylureidephenyl)-5-mercaptotetrazole in an amount of $3.4\times10^{-4}$ mol, $9.7\times10^{-4}$ mol and $5.5\times10^{-4}$ mol per mol of silver halide, respectively.

In the blue-sensitive emulsion layer and the green-sensitive emulsion layer was incorporated 4-hydroxy-6-methyl-1,3,3a,7-tetrazaindene in an amount of $1.0\times10^{-4}$ mol and $2.0\times10^{-4}$ mol per mol of silver halide, respectively. For the purpose of inhibiting irradiation, to the emulsion layers were each added the following dyes (figures in the parenthesis indicate the coated amount):

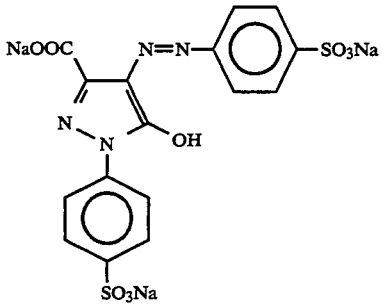

(5 mg/m²)

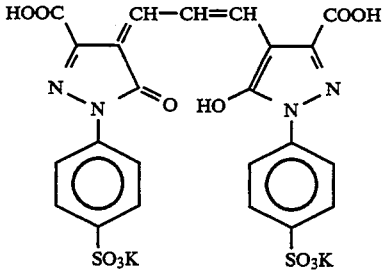

(5 mg/m²)

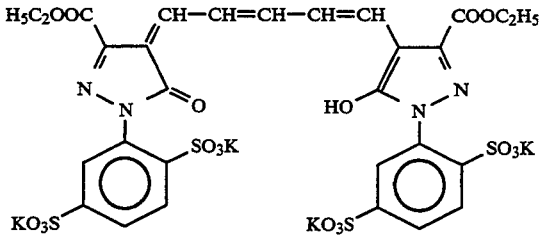

(10 mg/m²)

and

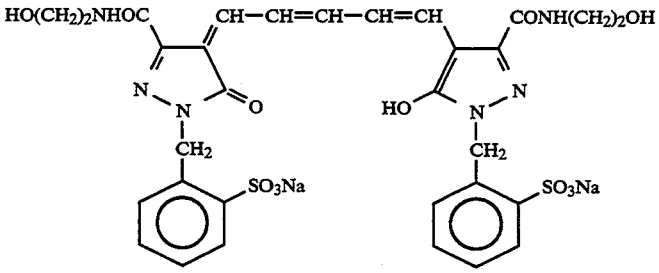

(5 mg/m²)

Layer construction

The formulations of the various layers are set forth below. The figures indicate the coated amount (g/m²). The coated amount of silver halide emulsion is represented as calculated in terms of silver.

Support

Polyethylene-laminated paper [containing a white pigment ($TiO_2$) in polyethylene on the 1st layer side in an amount of 4 g/m²]

| | |
|---|---|
| 1st layer (white pigment-containing hydrophilic colloidal layer) | |
| $TiO_2$ | 2.50 |
| Gelatin | 0.63 |
| 2nd layer (blue-sensitive emulsion layer) | |
| Silver bromochloride emulsion B101 as set forth above | 0.27 |
| Gelatin | 1.36 |

-continued

| | |
|---|---|
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |
| 3rd layer (color stain inhibiting layer) | |
| Gelatin | 0.99 |
| Color mixing inhibitor (Cpd-4) | 0.08 |
| Solvent (Solv-2) | 0.25 |
| Solvent (Solv-3) | 0.25 |
| 4th layer (green-sensitive emulsion layer) | |
| Silver bromochloride emulsion (6:4 (Ag molar ratio) mixture of a large size emulsion of cubic grains having an average size of 0.55 μm with a grain size distribution fluctuation coefficient of 0.10 and a small size emulsion of cubic grains having an average size of 0.39 μm with a grain size distribution fluctuation coefficient of 0.08, 0.8 mol % of silver | 0.13 |

-continued

| | |
|---|---|
| bromide being localized partially on the surface of each emulsion and a balance comprising silver chloride) | |
| Gelatin | 1.45 |
| Magenta coupler (ExM) | 0.16 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| 5th layer (color mixing inhibiting layer) | |
| Gelatin | 0.70 |
| Color stain inhibitor (Cpd-4) | 0.04 |
| Dye image stabilizer (Cpd-5') | 0.02 |
| Solvent (Solv-2) | 0.18 |
| Solvent (Solv-3) | 0.18 |
| 6th layer (red-sensitive emulsion layer) | |
| Silver bromochloride emulsion (Emulsion R 101 comprising cubic grains having an average grain size of 0.55 μm and a grain size fluctuation coefficient of 0.10, 0.8 mol % of silver bromide being localized partially on the surface of each emulsion and a balance comprising silver chloride) | 0.20 |
| Gelatin | 0.85 |
| Cyan coupler (ExC') | 0.33 |
| Ultraviolet absorbent (UV-2) | 0.18 |
| Dye image stabilizer (Cpd-1) | 0.33 |
| Dye image stabilizer (Cpd-9) | 0.15 |
| Dye image stabilizer (Cpd-10) | 0.15 |
| Dye image stabilizer (Cpd-11) | 0.01 |
| Dye image stabilizer (Cpd-8) | 0.01 |
| Dye image stabilizer (Cpd-7) | 0.01 |
| Solvent (Solv-6) | 0.22 |
| Solvent (Solv-1) | 0.01 |
| 7th layer (ultraviolet absorbing layer) | |
| Gelatin | 0.55 |
| Ultraviolet absorbent (UV-1) | 0.40 |
| Dye image stabilizer (Cpd-12) | 0.15 |
| Dye image stabilizer (Cpd-5) | 0.02 |
| 8th layer (protective layer) | |
| Gelatin | 1.13 |
| Acryl-modified copolymer of polyvinyl alcohol (modification degree: 17%) | 0.15 |
| Liquid paraffin | 0.03 |
| Dye image stabilizer (Cpd-14) | 0.01 |

The chemical structure of the compounds of ExC' and Cpd-5' will be given below. Other chemical structures of the compounds used in Example 4 are the same as those used in Example 1.

Cyan coupler (EcC')

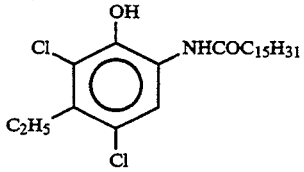

Dye image stabilizer (Cpd-5')

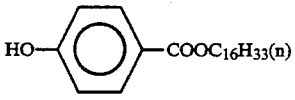

Further, Specimens 101 to 103 and 105 to 123 were prepared in the same manner as Specimen 104 except that they had configurations as set forth in Table D. The coated amount of the white pigment in the 1st layer was adjusted by adjusting the amount of the white pigment to be incorporated in the coating solution. The coated amount of gelatin was adjusted constant among the specimens. The addition of the compounds represented by the general formulae (I) to (IX) was adjusted such that the total amount of the various compounds as set forth in Table D in each layer was $3\times10^{-4}$ mol.

In order to evaluate the sensitivity drop due to the bending of the photographic light-sensitive material, the specimen was placed parallel to the direction of gradient of light by the optical wedge and folded downward for 1 second so that an angle made by the face of the specimen opposite the silver halide emulsion layer is 45°, in which the silver halide emulsion layer faces upward.

In order to observe the sensitivity drop during the storage in the form of photographic light-sensitive material, the specimen was stored at a temperature of 35° C. for 1 month after coating and another batch of the specimen was stored at a temperature of −10° C. for 1 month.

These specimens were then subjected to gradient exposure through an optical wedge and a blue filter by means of a sensitometer (Type FWH available from Fuji Photo Film Co., Ltd.; color temperature of light source: 3,200° K.). These specimens were then subjected to color development in accordance with the following processing procedures.

In order to evaluate the latent image stability after storage, the specimens which had been stored at a temperature of 35° C. for 1 month after coating were subjected to color development in accordance with the following processing procedures 1 minute and 1 hour after exposure.

In order to evaluate the sharpness, a wedge was prepared having a striped pattern made by the repetition of a transparent portion (density: 0.05) and a black portion (corresponding to background; density: 1.0) with an equal interval, varying a number of the black line from 10 to 100 with a decade within a 5 mm width. The specimens were subjected to contact exposure through the wedge in such a manner that the density of the background was a neutral gray represented by a reflective density of 0.4. These specimens were then subjected to color development in accordance with the following processing procedures:

| Processing step | Temperature | Time | Replenisher* | Tank capacity |
|---|---|---|---|---|
| Color development | 35° C. | 45 sec. | 125 ml | 2 l |
| Blix | 30–35° C. | 45 sec. | 215 ml | 2 l |
| Rinse | 30° C. | 90 sec. | 350 | 1 l |
| Drying | 70–80° C. | 60 sec. | | |

*per $m^2$ of light-sensitive material

The formulations of the various processing solutions were as follows:

| | Running Solution | Replenisher |
|---|---|---|
| Color developer | | |
| Water | 800 ml | 800 ml |
| Ethylenediamine-N,N,N',N'-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |

-continued

| | Running Solution | Replenisher |
|---|---|---|
| N-ethyl-N-(β-methanesulfon-amidoethyl)-3-methyl-4-amino-aniline sulfate | 5.0 g | 7.0 g |
| N,N-bis(carboxymethyl)-hydrazine | 4.0 g | 5.0 g |
| N,N-di(sulfoethyl)hydroxyl-amine.1Na | 4.0 g | 5.0 g |
| Fluorescent brightening agent (Whitex 4B produced by Sumitomo Chemical Co., Ltd.) | 1.0 g | 2.0 g |
| Water to make | 1,000 ml | 1,000 ml |
| pH (25° C.) | 10.05 | 10.45 |
| Blix solution (running solution was used as replenisher) | | |
| Water | | 400 ml |
| Ammonium thiosulfate (700 g/l) | | 100 ml |
| Sodium sulfite | | 17 g |
| Ferric ammonium ethylenediamine-tetraacetate | | 55 g |
| Disodium ethylenediaminetetraacetate | | 5 g |
| Ammonium bromide | | 40 g |
| Water to make | | 1,000 ml |
| pH (25° C.) | | 6.0 |

Washing Solution (Running Solution was Used Also as Replenisher)

Ion-exchanged water (calcium and magnesium concentrations: 3 ppm each)

The processed specimens were measured for yellow reflective density on the unbent portion and the bent portion. A so-called characteristic curve was then obtained from the measurements. The sensitivity was represented by the logarithm of the exposure giving a higher density by 0.5 than the fog density. For the evaluation of sensitivity drop, the sensitivity of the unfolded portion was subtracted from that of the folded portion. The sensitivity drop value was increased by 100 times. The results are set forth in Table D.

In order to evaluate the latent image stability after storage in the form of photographic light-sensitive material, the sensitivity of the specimen which had been processed 1 minute after exposure was subtracted from that of another batch of the specimen which had been processed 1 hour after exposure. The sensitivity drop value was increased by 100 times. The results are set forth in Table D.

In order to evaluate the sensitivity drop after storage in the form of photographic light-sensitive material, the specimens which had been stored at a temperature of 35° C. for 1 month after coating and another batch of the specimens which had been stored at a temperature of −10° C. for 1 month after coating were measured for sensitivity. The sensitivity of the specimens which had been stored at a temperature of −10° C. was subtracted from that of the specimens which had been stored at a temperature of 35° C. The sensitivity drop value was then increased by 100 times. The results are set forth in Table D.

In order to evaluate the sharpness, the specimens which had been processed for the evaluation of sharpness were examined by 20 examiners for the maximum visually recognizable number of striped patterns. These examined values were then averaged to obtain a representative value of sharpness. The results are set forth in Table D.

TABLE D

| Specimen | 1st Layer white pigment content | Added compound | Blue-sensitive silver halide emulsion | Chemical sensitization | Silver bromide localized phase | Sharpness | Sensitivity drop due to bending | Sensitivity drop after storage | Latent image stability after storage | Remarks |
|---|---|---|---|---|---|---|---|---|---|---|
| 101 | 15% | — | B101 | sulfur | none | 71.5 | −6 | −4 | ±0 | Comparative |
| 102 | 20% | — | B101 | sulfur | none | 78.5 | −8 | −6 | ±0 | Comparative |
| 103 | 40% | — | B101 | sulfur | none | 80.5 | −10 | −7 | −1 | Comparative |
| 104 | 80% | — | B101 | sulfur | none | 83.0 | −31 | −8 | −1 | Comparative |
| 105 | 90% | — | B101 | sulfur | none | 84.5 | −52 | −9 | −2 | Comparative |
| 106 | — | — | B102 | gold.sulfur | none | 68.0 | −1 | −2 | −2 | Comparative |
| 107 | 20% | — | B102 | gold.sulfur | none | 78.5 | −2 | −8 | −3 | Comparative |
| 108 | 40% | — | B102 | gold.sulfur | none | 80.5 | −3 | −10 | −3 | Comparative |
| 109 | 80% | — | B102 | gold.sulfur | none | 83.0 | −5 | −13 | −4 | Comparative |
| 110 | 90% | — | B102 | gold.sulfur | none | 84.5 | −6 | −15 | −4 | Comparative |
| 111 | 80% | A-37/A-39* | B102 | gold.sulfur | none | 83.0 | −5 | −2 | −1 | Present Invention |
| 112 | 80% | A-37/A-39 | B103 | gold.sulfur | present | 83.0 | −5 | −2 | −1 | Present Invention |
| 113 | 80% | A-37/A-39 | B104 | gold | none | 83.0 | −5 | −1 | −1 | Present Invention |
| 114 | 80% | A-37/A-39 | B105 | gold | present | 83.0 | −5 | −1 | −1 | Present Invention |
| 115 | 80% | A-5 | B102 | gold.sulfur | none | 83.0 | −5 | −4 | −2 | Present Invention |
| 116 | 80% | A-7 | B102 | gold.sulfur | none | 83.0 | −5 | −3 | −2 | Present Invention |
| 117 | 80% | A-18 | B102 | gold.sulfur | none | 83.0 | −5 | −4 | −2 | Present Invention |
| 118 | 80% | A-24 | B102 | gold.sulfur | none | 83.0 | −5 | −4 | −2 | Present Invention |
| 119 | 80% | A-27 | B102 | gold.sulfur | none | 83.0 | −5 | −3 | −2 | Present Invention |
| 120 | 80% | A-37 | B102 | gold.sulfur | none | 83.0 | −5 | −4 | −1 | Present Invention |
| 121 | 80% | A-38 | B102 | gold.sulfur | none | 83.0 | −5 | −4 | −1 | Present Invention |
| 122 | 80% | A-40 | B102 | gold.sulfur | none | 83.0 | −5 | −2 | −1 | Present Invention |

TABLE D-continued

| Specimen | 1st Layer white pigment content | Added compound | Blue-sensitive silver halide emulsion | | | Sharpness | Sensitivity drop due to bending | Sensitivity drop after storage | Latent image stability after storage | Remarks |
|---|---|---|---|---|---|---|---|---|---|---|
| | | | | Chemical sensitization | Silver bromide localized phase | | | | | |
| 123 | 20% | A-40 | B102 | gold.sulfur | none | 78.5 | −2 | −1 | −1 | Present Invention |

*1:1 (molar ratio) mixture

Table D shows that if the 1st layer is free of white pigment or comprises a white pigment in an amount of less than 20%, it causes a small sensitivity drop due to folding but provides a disadvantageously low sharpness (Specimens 101, 106). The specimens comprising an emulsion which has not been subjected to chemical sensitization with a gold compound show a great sensitivity drop due to folding when the white pigment content is increased (Specimens 103, 104, 105). Further, the specimens which have been subjected to chemical sensitization with a gold compound but are free of the compound of the present invention show a remarkable sensitivity drop after storage (Specimens 107 to 110). In other words, a silver halide photographic material which exhibits a small sensitivity drop due to folding before exposure, a high sharpness and a small sensitivity drop after storage in the form of photographic light-sensitive material can be formed only when a silver halide emulsion sensitized with a gold compound is coated in such an amount that the white pigment content in the 1st layer is 20% or more, with the compound of the present invention being incorporated therein (Specimens 111 to 123).

EXAMPLE 5

A specimen was prepared in the same manner as in Example 4 except that the layers as set forth in Table E were provided between the 1st layer and the 2nd layer. The specimen was evaluated in the same manner as in Example 4. The results thus obtained were similar to that of Example 4. The maximum value of sharpness was about 5% greater than that of Example 4.

TABLE E

| | |
|---|---|
| Support side | |
| Colored layer | |
| Black colloidal silver | 0.10 |
| Gelatin | 0.99 |
| Color mixing inhibitor (Cpd-5) | 0.08 |
| Solvent (Solv-l) | 0.16 |
| Solvent (Solv-4) | 0.08 |
| Color mixing-inhibiting layer | |
| Gelatin | 0.99 |
| Color mixing inhibitor (Cpd-5) | 0.08 |
| Solvent (Solv-1) | 0.16 |
| Solvent (Solv-4) | 0.08 |
| Emulsion layer side | |

EXAMPLE 6

A specimen was prepared in the same manner as Specimen 111 of Example 4 except that a gentamicine (1:1:1 (weight ratio) mixture of Gentamicine C1, Gentamicine $C_{1a}$ and Gentamicine $C_2$) was incorporated in the system in an amount of 0.5 mg/m$^2$ instead of A-37/A-39 mixture. The specimen thus obtained was then evaluated for sensitivity drop due to bending and sensitivity drop after storage in the same manner as in Example 4. The results thus obtained were as good as Specimen 111. In particular, it was confirmed that the sensitivity drop after storage can be further minimized.

Accordingly, the present invention provides a photographic light-sensitive material which can be rapidly processed and exhibits a high sharpness, a small sensitivity drop on the portion which has been under force before exposure and a small sensitivity drop after storage in the form of photographic light-sensitive material.

EXAMPLE 7

Preparation of Large Size Silver Halide Emulsion B1 for Blue-sensitive Silver Halide Emulsion Layer To a 3% aqueous solution of a lime-treated gelatin were added 3.3 g of sodium chloride and 3.2 ml of a 1% aqueous solution of N,N'-dimethylimidazolidine-2-thione. To the aqueous solution were added an aqueous solution containing 0.5 mol of silver nitrate and an aqueous solution containing 0.5 mol of sodium chloride at a temperature of 66° C. with vigorous stirring. To the material were then added an aqueous solution containing 0.45 mol of silver nitrate and an aqueous solution containing 0.45 mol of sodium chloride and an aqueous solution containing 0.45 mol of sodium chloride at a temperature of 72° C. with vigorous stirring. To the material was then added a copolymer of isobutene-maleic acid-1-sodium salt at a temperature of 40° C. to make sedimentation. The material was then washed with water and desalted. 90.0 g of lime-treated gelatin was then added to the material. To the emulsion was then added a fine emulsion of silver bromide grains having a size of 0.05 μm in an amount of 0.0053 mol as calculated in terms of silver to form a silver bromide-rich phase on the surface of grains. A blue-sensitive sensitizing dye was then added to the emulsion in an amount of $2\times10^{-4}$mol/mol Ag. The emulsion was then subjected to optimum chemical sensitization with a sulfur sensitizer (triethylthiourea). Further, 1-(5-methylureidophenyl)-5mercaptotetrazole was added to the emulsion in an amount of $5\times10^{-4}$ mol/mol Ag.

Emulsion $B_1$ thus obtained was then determined for the grain shape, grain size and grain size distribution from its electron microphotograph. The emulsion grains were cubic. The grain size was 0.88 μm. The grain size fluctuation coefficient was 0.10. The grain size is represented by the average of diameter of circles having the same area as the projected area of grains. The grain size fluctuation coefficient is obtained by dividing the standard deviation of grain sizes by the average grain size.

Emulsions having different grain sizes were prepared by altering the temperature at which silver halide grains are formed, the time at which the aqueous solution of silver nitrate and the aqueous solution of sodium chloride were added, and the amount of the finely divided silver bromide grains to be added. A blue-sensitive sensitizing dye, a red-sensitive sensitizing dye or a green-sensitive sensitizing dye was then added to these emulsions to obtain a blue-sensitive small size emulsion, a red-sensitive emulsion, and a green-sensitive emulsion which were used later.

In the silver bromochloride emulsion to be incorporated in the various light-sensitive emulsion layers were the following spectral sensitizing dyes, respectively.

Blue-sensitive emulsion layer

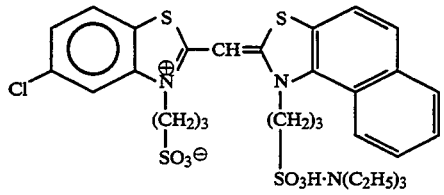

and

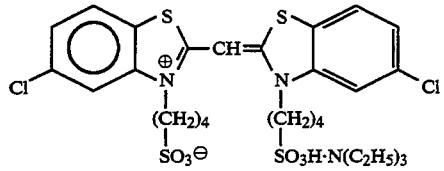

($2.0 \times 10^{-4}$ mol per mol of silver halide each for the large size emulsion and $2.5 \times 10^{-4}$ mol per mol of silver halide each for the small size emulsion)

Green-sensitive emulsion layer

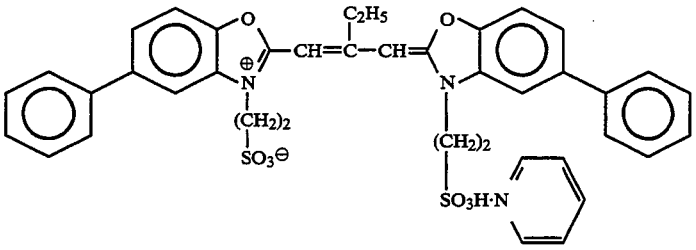

($4.0 \times 10^{-4}$ mol per mol of silver halide for the large size emulsion and $5.6 \times 10^{-4}$ mol per mol of silver halide for the small size emulsion)

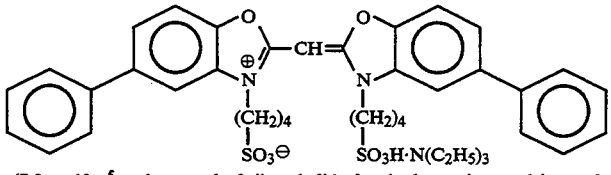

($7.0 \times 10^{-5}$ mol per mol of silver halide for the large size emulsion and $1.0 \times 10^{-4}$ mol per mol of silver halide for the small size emulsion)

Red-sensitive emulsion layer

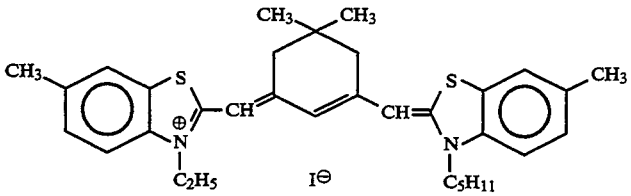

($1.0 \times 10^{-4}$ mol per mol of silver halide for the large size emulsion and $1.2 \times 10^{-4}$ mol per mol of silver halide for the small size emulsion)

Further, the following compound was incorporated in an amount of $2.6 \times 10^{-3}$ mol per mol of silver halide.

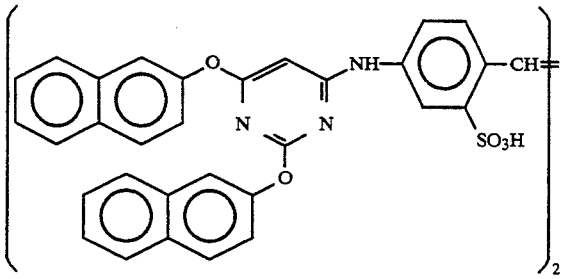

A paper support laminated with polyethylene on both sides thereof was subjected to corona discharge on its surface. A gelatin undercoating layer containing sodium dodecylbenzenesulfonate was coated on the surface of the support. Various photographic constituent layers were further coated on the undercoating layer to prepare a multi-layer color photographic paper having the following layer configuration (Specimen 1). The coating solution used had been prepared as follows:

Preparation of 1st Layer (White Pigment-containing Layer) Coating Solution

To 1.0 kg of a 10% aqueous solution of gelatin were added 400 g of a rutile type titanium white pigment having an average grain size of 0.23 μm (Titan White R780 available from Ishihara Sangyo K.K.) and 4 l of water. To the material was then added 8 cc of a 5% aqueous solution of sodium dodecylbenzenesulfonate as a dispersant. The material was then subjected to dispersion under irradiation with ultrasonic wave.

Preparation of 2nd Layer Coating Solution 153.0 g of a yellow coupler (ExY), 15.0 g of a dye image stabilizer (Cpd-1), 7.5 g of a dye image stabilizer (Cpd-2), and 16.0 g of a dye image stabilizer (Cpd-3) were dissolved in 180 cc of ethyl acetate, 25 g of a solvent (Solv-1) and 25 g of a solvent (Solv-2) to make a solution. The solution thus obtained was then emulsion-dispersed in 1,000 g of a 10% aqueous solution of gelatin containing 60 cc of sodium dodecylbenzenesulfonate and 10 g of citric acid to prepare Emulsified Dispersion A.

On the other hand, a silver bromochloride emulsion was prepared in the same manner as mentioned above (6:4 (silver molar ratio) mixture of large size cubic grain emulsion B1 having an average grain size of 0.88 μm and a grain size fluctuation coefficient of 0.10 and small size cubic grain emulsion having an average grain size of 0.70 μm and a grain size fluctuation coefficient of 0.08, each emulsion comprising 0.53 mol % silver bromide localized on the grain surface).

Emulsion A was then mixed with the silver bromochloride emulsion thus obtained to obtain a 2nd layer coating solution having the composition as set forth below.

The coating solutions for the other layers were prepared in the same manner as the coating solution for the 2nd layer.

As gelatin hardener for each layer there was used sodium salt of 1-oxy-3,5-dichloro-s-triazine.

In the various layers were each incorporated Cpd-15 and Cpd-16 in an amount of 25.0 mg/m$^2$ and 50.0 mg/m$^2$, respectively.

In the blue-sensitive emulsion and the red-sensitive emulsion was incorporated 1-(5-methylureidophenyl)-5-mercaptotetrazole in an amount of $9.7\times10^{-4}$ mol and $5.5\times10^{-4}$ mol per mol of silver halide, respectively.

In the blue-sensitive emulsion layer and the green-sensitive emulsion layer was incorporated 4-hydroxy-6-methyl-1,3,3a,7-tetrazaindene in an amount of $1.0\times10^{-4}$ mol and $2.0\times10^{-4}$ mol per mol of silver halide, respectively.

For the purpose of inhibiting irradiation, to the emulsion layers were each added the following dyes (figures in the parenthesis indicate the coated amount):

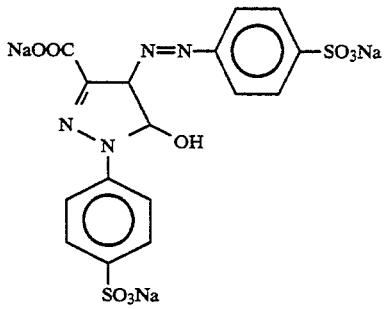

(10 mg/m$^2$)

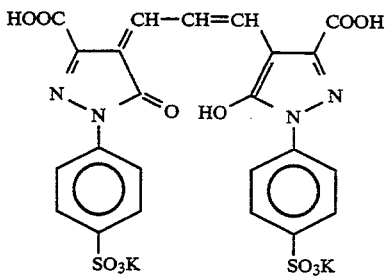

(10 mg/m$^2$)

-continued

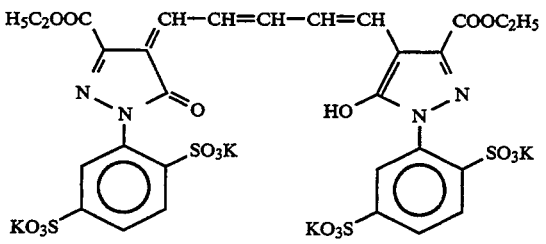

(40 mg/m²)

and

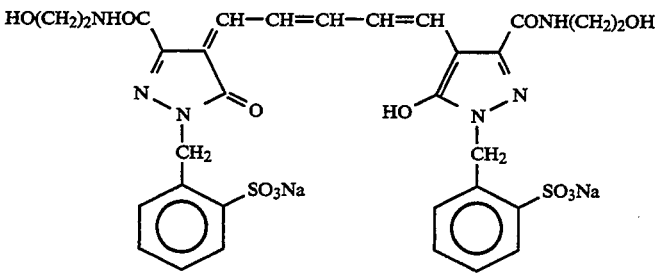

(20 mg/m²)

Layer Construction

The formulations of the various layers are set forth below. The figures indicate the coated amount (g/m²). The coated amount of silver halide emulsion is represented as calculated in terms of silver.

Support

Polyethylene-laminated paper

| | |
|---|---|
| 1st layer (white pigment-containing hydrophilic colloidal layer) | |
| Gelatin | 1.13 |
| Titanium oxide white pigment (packing of white pigment: 80 wt %) | 4.50 |
| 2nd layer (blue-sensitive emulsion layer) | |
| Silver bromochloride emulsion (6:4 (Ag molar ratio) mixture of a large size emulsion B1 of cubic grains having an average size of 0.88 μm with a grain size distribution fluctuation coefficient of 0.10 and a small size emulsion B2 of cubic grains having an average size of 0.70 μm with a grain size distribution fluctuation coefficient of 0.08, 0.53 mol % of silver bromide being localized partially on the surface of each emulsion) | 0.27 |
| Gelatin | 1.36 |
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |
| 3rd layer (color stain inhibiting layer) | |
| Gelatin | 0.99 |
| Color mixing inhibitor (Cpd-4) | 0.08 |
| Solvent (Solv-2) | 0.25 |
| Solvent (Solv-3) | 0.25 |
| 4th layer (green-sensitive emulsion layer) | |
| Silver bromochloride emulsion (6:4 (Ag molar ratio) mixture of a large size emulsion G1 of cubic grains having an average size of 0.55 μm with a grain size distribution fluctuation coefficient of 0.10 and a small size emulsion G2 of cubic grains having an average size of 0.39 μm with a grain size distribution fluctuation coefficient of 0.08, 0.8 mol % of silver bromide being localized partially on the surface of each emulsion) | 0.13 |
| Gelatin | 1.45 |
| Magenta coupler (ExM) | 0.16 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| 5th layer (color stain inhibiting layer) | |
| Gelatin | 0.70 |
| Color stain inhibitor (Cpd-4) | 0.04 |
| Dye image stabilizer (Cpd-5') | 0.02 |
| Solvent (Solv-2) | 0.18 |
| Solvent (Solv-3) | 0.18 |
| 6th layer (red-sensitive emulsion layer) | |
| Silver bromochloride emulsion (7:3 (Ag molar ratio) mixture of a large size emulsion R1 of cubic grains having an average size of 0.50 μm with a grain size distribution fluctuation coefficient of 0.08 and a small size emulsion R2 of cubic grains having an average size of 0.45 μm with a grain size distribution fluctuation coefficient of 0.11, 0.5 mol % of silver bromide being localized partially on the surface of each emulsion) | 0.20 |
| Gelatin | 0.85 |
| Cyan coupler (ExC) | 0.33 |
| Ultraviolet absorbent (UV-2) | 0.18 |
| Dye image stabilizer (Cpd-1) | 0.33 |
| Dye image stabilizer (Cpd-9) | 0.15 |
| Dye image stabilizer (Cpd-10) | 0.15 |
| Dye image stabilizer (Cpd-11) | 0.01 |
| Dye image stabilizer (Cpd-8) | 0.01 |
| Dye image stabilizer (Cpd-7) | 0.01 |
| Solvent (Solv-6) | 0.22 |
| Solvent (Solv-1) | 0.01 |
| 7th layer (ultraviolet absorbing layer) | |
| Gelatin | 0.55 |
| Ultraviolet absorbent (UV-1) | 0.40 |
| Dye image stabilizer (Cpd-12) | 0.15 |
| Dye image stabilizer (Cpd-5) | 0.02 |
| 8th layer (protective layer) | |
| Gelatin | 1.13 |
| Acryl-modified copolymer of polyvinyl alcohol (modification degree: 17%) | 0.15 |
| Liquid paraffin | 0.03 |

-continued

| | |
|---|---|
| Dye image stabilizer (Cpd-13) | 0.01 |

The chemical structure of the compound of Cpd-5' is given below. Chemical structures of other compounds are the same as those used in Example 1.

Dye Image Stabilizer (Cpd-5')

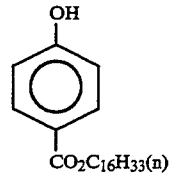

Specimens 2 to 15 were then prepared in the same manner as Specimen 1 except that the coated amount of titanium oxide and the film pH were altered as set forth in Table F. The density of titanium oxide was 80% by weight for Specimens 2 to 5, and 11 to 15 and 15% by weight for Specimens 6 to 10. The film pH value was adjusted by adding a 1N aqueous solution of sulfuric acid or sodium hydroxide to the coating solutions for the protective layer and color mixing-inhibiting layer. The film Ag value was adjusted to 8.0 for all the specimens by adjusting the amount of the aqueous solution of sodium chloride to be incorporated in the 2nd layer coating solution.

Further, Specimens 16 to 20 were prepared as comparative specimens in the same manner as Specimen 1 except that the 1st layer was not coated and the polyethylene laminate on the emulsion side of the support comprised a titanium oxide white pigment incorporated therein in an amount of 16% by weight such that the coated amount of titanium oxide was 4.5 g/m$^2$.

TABLE F

| Specimen No. | Film pH | Coated amount of $TiO_2$ (g/m$^2$) | $TiO_2$ coating method |
|---|---|---|---|
| (1) | 5.0 | 4.5 | Coated as 1st layer |
| (2) | 6.0 | 4.5 | Coated as 1st layer |
| (3) | 6.5 | 4.5 | Coated as 1st layer |
| (4) | 4.0 | 4.5 | Coated as 1st layer |
| (5) | 7.0 | 4.5 | Coated as 1st layer |
| (6) | 4.0 | 1.5 | Coated as 1st layer |
| (7) | 5.0 | 1.5 | Coated as 1st layer |
| (8) | 6.0 | 1.5 | Coated as 1st layer |
| (9) | 6.5 | 1.5 | Coated as 1st layer |
| (10) | 7.0 | 1.5 | Coated as 1st layer |
| (11) | 4.0 | 2.5 | Coated as 1st layer |
| (12) | 5.0 | 2.5 | Coated as 1st layer |
| (13) | 6.0 | 2.5 | Coated as 1st layer |
| (14) | 6.5 | 2.5 | Coated as 1st layer |
| (15) | 7.0 | 2.5 | Coated as 1st layer |
| (16) | 4.0 | 4.5 | Incorporated in polyethylene laminate |
| (17) | 5.0 | 4.5 | Incorporated in polyethylene laminate |
| (18) | 6.0 | 4.5 | Incorporated in polyethylene laminate |
| (19) | 6.5 | 4.5 | Incorporated in polyethylene laminate |
| (20) | 7.0 | 4.5 | Incorporated in polyethylene laminate |

For the evaluation of dependence on exposure temperature, these specimens were stored at humidities of 35% and 85% (temperature: 25° C.) for 30 minutes, and then subjected to gradationwise exposure for sensitometry through blue, green and red filters by means of a sensitometer (FWH, available from Fuji Photo Film Co., Ltd.; color temperature of light source: 3,200° K.) under the respective conditions. The exposure was conducted in such a manner that an exposure of 250 CMS was reached in 0.1 second. The sensitivity of these specimens were then compared. For the evaluation of the degree of desensitization upon exposure under high humidity, the sensitivity after storage at a humidity of 35% (S30) was subtracted from that after storage at a humidity of 85% (S85) to obtain a difference (S85–S30).

In order to evaluate the sensitivity change with the fluctuations of the time between the completion of exposure and the beginning of development, the specimens were exposed to light in the same manner as mentioned above, stored at a temperature of 25° C. and a relative humidity of 55% for 2 hours, and then examined for sensitivity change from before to after storage. For the evaluation of sensitivity change after storage, the sensitivity before storage was subtracted from that after storage.

For the evaluation of sensitivity, the logarithm of the reciprocal of the exposure at which the processed photographic light-sensitive material gives a density of 1.0 was used.

For the evaluation of sharpness, CTF value was used. CTF represents the attenuation of the amplitude with respect to the spatial frequency in the form of rectangular wave. The sharpness was represented by the spatial frequency (line/mm) which gives 50% CTF value. The greater this value is, the higher is the sharpness.

The specimens which had been exposed to light were processed with the following processing solutions in the following processing procedures by means of a paper processing machine.

| Processing step | Temperature | Time | Replenisher* | Tank capacity |
|---|---|---|---|---|
| Color development | 35° C. | 45 sec. | 161 ml | 17 l |
| Blix | 30–35° C. | 45 sec. | 215 ml | 17 l |
| Rinse | 35° C. | 90 sec. | 350 ml | 10 l |
| Drying | 70–80° C. | 60 sec. | | |

*The replenishment rate is represented per m$^2$ of light-sensitive material.

The various processing solutions had the following compositions:

| | Running Solution | Replenisher |
|---|---|---|
| Color developer | | |
| Water | 800 ml | 800 ml |
| Ethylenediamine-N,N,N',N'-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoanilinesulfate | 5.0 g | 7.0 g |
| N,N-bis(carboxymethyl)-hydrazine | 4.0 g | 5.0 g |
| N,N-di(sulfoethyl)-hydroxylamine.1Na | 4.0 g | 5.0 g |
| Fluorescent-brightening agent | 1.0 g | 2.0 g |

-continued

| | Running Solution | Replenisher |
|---|---|---|
| (WHITEX 4B, available from Sumitomo Chemical Co., Ltd.) | | |
| Water to make | 1,000 ml | 1,000 ml |
| pH (25° C.) | 10.05 | 10.45 |
| Blix solution (running solution was used also as replenisher) | | |
| Water | | 400 ml |
| Ammonium thiosulfate (700 g/l) | | 100 ml |
| Sodium sulfite | | 17 g |
| Ammonium ethylenediaminetetraacetate (III) | | 55 g |
| Disodium ethylenediaminetetraacetate | | 5 g |
| Ammonium bromide | | 40 g |
| Water to make | | 1,000 ml |
| pH (25° C.) | | 6.0 |

Rinse Solution (Running Solution was Used Also as Replenisher)

Ion-exchanged water (calcium and magnesium concentration: 3 ppm or less each)

The results are set forth in Table G. The results indicate the sensitivity change and CTF value of the blue-sensitive emulsion layer.

TABLE G

| Specimen No. | CTF (B) | Desensitization degree upon exposure at high humidity (B) | Sensitivity (B) | Sensitivity change when stored for 2 hours after until exposure processing (B) |
|---|---|---|---|---|
| (1) | 24.0 | −0.02 | 1.00 | +0.02 |
| (2) | 24.0 | −0.02 | 1.01 | +0.02 |
| (3) | 24.0 | −0.03 | 1.01 | +0.03 |
| (4) | 24.0 | −0.03 | 0.91 | +0.03 |
| (5) | 24.0 | −0.10 | 1.02 | +0.12 |
| (6) | 16.0 | −0.02 | 0.90 | +0.02 |
| (7) | 16.0 | −0.02 | 1.01 | +0.02 |
| (8) | 16.0 | −0.02 | 1.01 | +0.02 |
| (9) | 16.0 | −0.02 | 1.01 | +0.02 |
| (10) | 16.0 | −0.08 | 1.01 | +0.08 |
| (11) | 22.0 | −0.02 | 0.89 | +0.02 |
| (12) | 22.0 | −0.02 | 1.01 | +0.02 |
| (13) | 22.0 | −0.02 | 1.02 | +0.02 |
| (14) | 22.0 | −0.02 | 1.01 | +0.02 |
| (15) | 22.0 | −0.09 | 1.02 | +0.12 |
| (16) | 15.0 | −0.02 | 0.90 | +0.02 |
| (17) | 15.0 | −0.02 | 1.01 | +0.02 |
| (18) | 15.0 | −0.02 | 1.01 | +0.02 |
| (19) | 15.0 | −0.02 | 1.00 | +0.05 |
| (20) | 15.0 | −0.04 | 1.01 | +0.05 |

(Note)
Specimens 1 to 3, and 12 to 14 are according to the present invention while the others are comparative.

Table G shows that the sharpness can be remarkably enhanced by providing a hydrophilic colloidal layer containing a white pigment of the present invention. However, this also causes the specimens having a film pH value of 6.0 or more to exhibit a great desensitization upon exposure under high humidity conditions and a great sensitivity change with the fluctuations of the time between the completion of exposure and the beginning of processing. (See Specimens 5, 10, 15)

When the film pH value is adjusted to 4.0 or less, the sensitivity of the various emulsion layers are lowered. (See Specimens 4, 6, 11)

When the coated amount of the white pigment is relatively small, it is little disadvantageous in the problems of the present invention such as dependence of exposure on humidity and latent image stability but gives a low sharpness. (See Specimens 7 to 9)

When a white pigment is incorporated in the polyethylene laminate on the emulsion layer side of the support, the effect of enhancing sharpness is low even if the coated amount of the white pigment is increased. (See Specimens 16 to 20)

A color photographic light-sensitive material which exhibits a high sharpness, a small desensitization upon exposure under high humidity conditions and a small sensitivity change with the fluctuations of the time between the completion of exposure and the beginning of processing can be obtained only by adjusting the film pH value to the value specified herein. (See Specimens 1 to 3, and 12 to 14)

EXAMPLE 8

Coating solutions for the 2nd layer were prepared in the same manner as in that for Specimens 1 and 5 of Example 7 except that instead of forming a silver bromide-rich layer from finely divided silver bromide grains during the preparation of silver halide emulsions B1 and B2, an aqueous solution of potassium bromide was added to the system at the time as set forth in Table H to alter the halogen composition of the silver halide emulsion.

Using these coating solutions, Specimens 21 to 32 were prepared. For these specimens, the pAg value was adjusted to 8.0 in the same manner as used in Example 7. These specimens were then evaluated in the same manner as in Example 7. The results are set forth in Table I.

TABLE H

| Specimen No. | Time at which KBr was added | Added amount of KBr (mol/mol Ag) | Film pH |
|---|---|---|---|
| (1) | — | — | 5.0 |
| (2) | — | — | 7.0 |
| (21) | — (Neither added finely divided silver bromide grains) | — | 7.0 |
| (22) | After the formation of grains, 3 minutes before the addition of sulfur sensitizer | 0.0053 | 7.0 |
| (23) | After the addition of sulfur sensitizer, 20 minutes during chemical sensitization | 0.0053 | 7.0 |
| (24) | After the addition of chemical sensitization stopping agent, during the preparation of coating solution | 0.00040 | 7.0 |
| (25) | After the addition of chemical sensitization stopping agent, during the preparation of coating solution | 0.0053 | 7.0 |
| (26) | When the formation of grains is finished by 80% by volume | 0.0053 | 7.0 |
| (27) | — (Neither added finely divided silver bromide grains) | — | 5.0 |
| (28) | After the formation of grains, 3 minutes before the addition of sulfur sensitizer | 0.0053 | 5.0 |
| (29) | After the addition of sulfur sensitizer, 20 minutes during chemical sensitization | 0.0053 | 5.0 |
| (30) | After the addition of | 0.00040 | 5.0 |

TABLE H-continued

| Specimen No. | Time at which KBr was added | Added amount of KBr (mol/mol Ag) | Film pH |
|---|---|---|---|
| | chemical sensitization stopping agent, during the preparation of coating solution | | |
| (31) | After the addition of chemical sensitization stopping agent, during the preparation of coating solution | 0.0053 | 5.0 |
| (32) | When the formation of grains is finished by 80% by volume | 0.0053 | 7.0 |

(Note)
In this experiment, the chemical sensitization was suspended at the time of addition of 1-(5-methyl-ureidophenyl)-5-mercaptotetrazole during the preparation of the emulsion.

TABLE I

| Specimen No. | CTF (B) | Desensitization degree upon exposure at high humidity (B) | Sensitivity change when stored for 2 hours after exposure until processing (B) |
|---|---|---|---|
| (1) | 24.0 | −0.03 | +0.02 |
| (5) | 24.0 | −0.10 | +0.12 |
| (21) | 24.0 | −0.20 | +0.10 |
| (22) | 24.0 | −0.15 | +0.12 |
| (23) | 24.0 | −0.15 | +0.12 |
| (24) | 24.0 | −0.19 | +0.11 |
| (25) | 24.0 | −0.15 | +0.12 |
| (26) | 24.0 | −0.14 | +0.12 |
| (27) | 24.0 | −0.04 | +0.02 |
| (28) | 24.0 | ±0 | +0.02 |
| (29) | 24.0 | ±0 | +0.02 |
| (30) | 24.0 | −0.05 | +0.02 |
| (31) | 24.0 | ±0 | +0.02 |
| (32) | 24.0 | −0.01 | +0.02 |

(Note)
Specimens 1, and 27 to 32 are according to the present invention while the others are comparative.

Table I shows that the addition of a water-soluble bromide provides a remarkable attainment of the effects of the present invention.

This effect can be attained with a gold-sulfur sensitized emulsion.

EXAMPLE 9

Specimens 33 to 37 were prepared in the same manner as Specimen 12 of Example 7 except that the proportion of gelatin and titanium oxide in the 1st layer were altered to obtain titanium oxide packings as set forth in Table E, respectively. The coated amount of titanium oxide was adjusted to 2.5 g/m$^2$ for all the specimens. These specimens were then evaluated for sharpness in the same manner as in Example 7. The results are set forth in Table J.

TABLE J

| Specimen No. | $TiO_2$ packing (wt %) | Coated amount of $TiO_2$ (g/m$^2$) | Film pH | CFT (B) |
|---|---|---|---|---|
| (12) | 80 | 2.5 | 5.0 | 22.0 |
| (33) | 60 | 2.5 | 5.0 | 21.0 |
| (34) | 40 | 2.5 | 5.0 | 21.0 |
| (35) | 20 | 2.5 | 5.0 | 20.0 |
| (36) | 15 | 2.5 | 5.0 | 14.0 |
| (37) | 10 | 2.5 | 5.0 | 12.0 |

Table J shows that the specimens comprising a hydrophilic colloidal layer having a white pigment packing of less than 20% by weight exhibit a poor sharpness.

In accordance with the present invention, a photographic light-sensitive material can be obtained which can be rapidly processed and exhibits a high sharpness, a small sensitivity change with the change in the humidity upon exposure and a small sensitivity change with the fluctuations of the time interval between the completion of exposure and the beginning of processing.

EXAMPLE 10

Specimens 38 to 54 were prepared in the same manner as Specimens 1, 2, 4, 5, 6, 8, and 10 of Example 7 except that the amount of the aqueous solution of sodium chloride to be added to the 2nd layer coating solution was altered to obtain film pAg values as set forth in Table K, respectively.

TABLE K

| Specimen No. | Film pH | Film pAq | Coated amount of $TiO_2$ (g/m$^2$) | $TiO_2$ coating method |
|---|---|---|---|---|
| (2) | 6.0 | 8.0 | 4.5 | Coated as 1st layer |
| (38) | 6.0 | 5.8 | 4.5 | Coated as 1st layer |
| (39) | 6.0 | 10.2 | 4.5 | Coated as 1st layer |
| (4) | 4.0 | 8.0 | 4.5 | Coated as 1st layer |
| (40) | 4.0 | 5.8 | 4.5 | Coated as 1st layer |
| (41) | 4.0 | 10.2 | 4.5 | Coated as 1st layer |
| (5) | 7.0 | 8.0 | 4.5 | Coated as 1st layer |
| (42) | 7.0 | 5.8 | 4.5 | Coated as 1st layer |
| (43) | 7.0 | 10.2 | 4.5 | Coated as 1st layer |
| (6) | 4.0 | 8.0 | 1.5 | Coated as 1st layer |
| (44) | 4.0 | 5.8 | 1.5 | Coated as 1st layer |
| (45) | 4.0 | 10.2 | 1.5 | Coated as 1st layer |
| (8) | 6.0 | 8.0 | 1.5 | Coated as 1st layer |
| (46) | 6.0 | 5.8 | 1.5 | Coated as 1st layer |
| (47) | 6.0 | 10.2 | 1.5 | Coated as 1st layer |
| (10) | 7.0 | 8.0 | 1.5 | Coated as 1st layer |
| (48) | 7.0 | 5.8 | 1.5 | Coated as 1st layer |
| (49) | 7.0 | 10.2 | 1.5 | Coated as 1st layer |
| (1) | 5.0 | 8.0 | 4.5 | Coated as 1st layer |
| (50) | 5.0 | 5.8 | 4.5 | Coated as 1st layer |
| (51) | 5.0 | 10.2 | 4.5 | Coated as 1st layer |
| (52) | 6.0 | 9.5 | 4.5 | Coated as 1st layer |
| (53) | 6.0 | 7.5 | 4.5 | Coated as 1st layer |
| (54) | 6.0 | 6.5 | 4.5 | Coated as 1st layer |

These specimens were evaluated in the same manner as in Example 7.

The results are set forth in Table L.

TABLE L

| Specimen No. | CTF (B) | Desensitization degree upon exposure at high humidity (B) | Sensitivity (B) | Sensitivity change when stored for 2 hours after exposure until processing (B) |
|---|---|---|---|---|
| (2) | 24.0 | −0.02 | 1.01 | +0.02 |
| (38) | 24.0 | −0.02 | 0.91 | +0.02 |
| (39) | 24.0 | −0.10 | 1.02 | +0.10 |
| (4) | 24.0 | −0.03 | 0.91 | +0.03 |
| (40) | 24.0 | −0.02 | 0.82 | +0.02 |
| (41) | 24.0 | −0.03 | 0.93 | +0.03 |
| (5) | 24.0 | −0.10 | 1.02 | +0.12 |
| (42) | 24.0 | −0.09 | 0.99 | +0.11 |
| (43) | 24.0 | −0.11 | 1.02 | +0.12 |
| (6) | 16.0 | −0.02 | 0.90 | +0.02 |
| (44) | 16.0 | −0.02 | 0.82 | +0.02 |
| (45) | 16.0 | −0.02 | 0.91 | +0.02 |
| (8) | 16.0 | −0.02 | 1.01 | +0.02 |
| (46) | 16.0 | −0.02 | 1.01 | +0.02 |
| (47) | 16.0 | −0.02 | 1.02 | +0.02 |
| (10) | 16.0 | −0.08 | 1.01 | +0.08 |
| (48) | 16.0 | −0.03 | 0.98 | +0.03 |
| (49) | 16.0 | −0.08 | 1.01 | +0.08 |
| (1) | 24.0 | −0.02 | 1.00 | +0.02 |
| (50) | 24.0 | −0.02 | 0.91 | +0.10 |
| (51) | 24.0 | −0.10 | 1.02 | +0.10 |

TABLE L-continued

| Specimen No. | CTF (B) | Desensitization degree upon exposure at high humidity (B) | Sensitivity (B) | Sensitivity change when stored for 2 hours after exposure until processing (B) |
|---|---|---|---|---|
| (52) | 24.0 | −0.02 | 0.98 | +0.02 |
| (53) | 24.0 | −0.02 | 1.02 | +0.02 |
| (54) | 24.0 | −0.03 | 1.01 | +0.03 |

(Note)
Specimens 1, 2, and 52 to 54 are according to the present invention while the others are comparative.

Table L shows that even when the film pH value is as specified herein, the sensitivity shows a drop if the film pAg value falls below 6.0. When the film pAg value exceeds 10.0, it causes a great desensitization upon exposure under high humidity conditions and a great sensitivity change with the fluctuations of the time between the completion of exposure and the beginning of processing.

These results show that the effects of the present invention become remarkable with photographic light-sensitive materials having a high sharpness.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising on a support a photographic constituting layer containing at least one light-sensitive emulsion layer and at least one hydrophilic colloidal layer containing a white pigment between said support and said light-sensitive emulsion layer, wherein said white pigment is incorporated in an amount in the range of 20% by weight or more, at least one of layers constituting said light-sensitive emulsion layer comprises silver bromochloride emulsion grains or silver chloride emulsion grains having a silver chloride content of 90 mol % or more sensitized with a gold compound at a pH in the range of 5.0 to 7.5, and either a light-sensitive layer or a light-insensitive layer in the material comprises at least one of compounds represented by the following general formulae (I) to (IX):

(I)

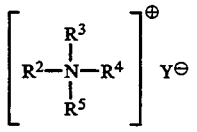

(II)

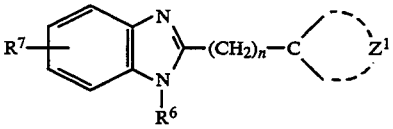

(III)

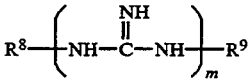

(IV)

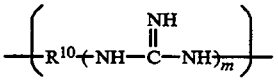

-continued (V)

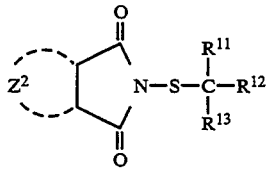

(VI)

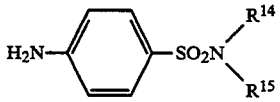

(VII)

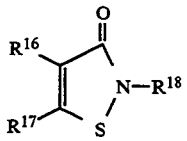

(VIII)

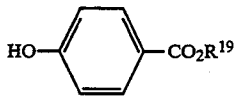

(IX)

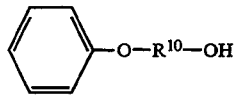

wherein $R^2$, $R^3$, $R^4$, $R^5$, $R^6$, $R^8$ and $R^9$ each represents a hydrogen atom, alkyl group or aryl group; $R^7$ represents a hydrogen atom, alkyl group, aryl group, nitro group, carboxyl group, sulfo group, sulfamoyl group, hydroxyl group, halogen atom, alkoxy group or thiazolyl group; $R^{10}$ represents an alkylene group or arylene group; $R^{11}$, $R^{12}$ and $R^{13}$ each represents a halogen atom or alkyl group; $R^{14}$ and $R^{15}$ each represents a hydrogen atom, alkyl group, aryl group or nitrogen-containing heterocyclic residue; $R^{16}$ and $R^{17}$ each represents a hydrogen atom, halogen atom, alkyl group, aryl group or aryloxy group, with the proviso that $R^{16}$ and $R^{17}$ may be connected to each other to form a benzene ring; $R^{18}$ represents a hydrogen atom or alkyl group; $R^{19}$ represents an alkyl group or aryl group; Y represents a halogen atom; $Z^1$ represents a nonmetallic atom group necessary for the formation of a thiazolyl ring; $Z^2$ represents a nonmetallic atom group necessary for the formation of a 6-membered ring; n represents an integer 0 or 1; and m represents an integer 1 or 2.

2. A silver halide color photographic material comprising on a support a photographic constituting layer comprising at least one light-sensitive silver halide emulsion layer containing a yellow dye-forming coupler, at least one light-sensitive silver halide emulsion layer containing a magenta dye-forming coupler, at least one light-sensitive silver halide emulsion layer containing a cyan dye-forming coupler, and at least one light-insensitive hydrophilic colloidal layer, wherein (1) at least one of layers constituting said light-sensitive silver halide emulsion layer comprises silver bromochloride emulsion grains having a silver chloride content of 90 mol % or more or silver chloride emulsion grains which are sensitized with a gold compound at a pH in the range of 5.0 to 7.5, (2) a hydrophilic colloidal layer containing a white pigment in an amount in the range of 20% by weight or more is provided between said support and the nearest silver halide emulsion layer, and (3) either a light-sensitive emulsion layer or a light-insensitive layer in the material comprises at least one of compounds represented by the general formulae (I) to (IX) claimed in claim 1.

3. A silver halide photographic material comprising on a support a photographic constituting layer comprising at least one light-sensitive silver halide emulsion layer containing a yellow dye-forming coupler, at least one light-sensitive silver halide emulsion layer containing a magenta dye-forming coupler, at least one light-sensitive silver halide emulsion layer containing a cyan dye-forming coupler, and at least one light-insensitive hydrophilic colloidal layer, wherein (1) at least one of layers constituting said light-sensitive silver halide emulsion layer comprises silver bromochloride emulsion grains having a silver chloride content of 90 mol % or more or silver chloride emulsion grains which are sensitized with a gold compound at a pH in the range of 5.0 to 7.5, (2) a hydrophilic colloidal layer containing a white pigment in an amount in the range of 20% by weight or more is provided between said support and the nearest silver halide emulsion layer, and (3) either a light-sensitive emulsion layer or a light-insensitive layer in the material comprises at least one aminoglycoside selected from the group consisting of gentamicin, amikacin, tobramycin, dibekacin, arbekacin, micronomicin, icepamicin, sisomicin, netilmicin and astromicin, or at least one of compounds represented by the general formulae (VII) to (IX) claimed in claim 1.

4. The silver halide color photographic material according to claim 2, wherein at least one of layers constituting said photographic constituting layer provided on said support is a colored layer decolorable upon developing processing.

5. A silver halide color photographic material according to claim 1, wherein either a light-sensitive emulsion layer or a light-insensitive emulsion layer in the material comprises at least one of the compounds represented by the general formulae (I) to (VI).

6. A silver halide color photographic material according to claim 1, wherein either a light-sensitive emulsion layer or a light-insensitive emulsion layer in the material comprises at least one of the compounds represented by the general formulae (I) and (III) to (VI).

7. A silver halide color photographic material according to claim 2, wherein either a light-sensitive emulsion layer or a light-insensitive emulsion layer in the material comprises at least one of the compounds represented by the general formulae (I) to (VI).

8. A silver halide color photographic material according to claim 2, wherein either a light-sensitive emulsion layer or a light-insensitive emulsion layer in the material comprises at least one of the compounds represented by the general formulae (I) and (III) to (VI).

* * * * *